US011000966B2

(12) United States Patent
Ishiguro et al.

(10) Patent No.: US 11,000,966 B2
(45) Date of Patent: May 11, 2021

(54) MULTISTAGE DRYING APPARATUS AND MULTISTAGE DRYING METHOD FOR SHEET MATERIAL TO BE TREATED

(71) Applicant: TAIHEI MACHINERY WORKS, LTD., Aichi (JP)

(72) Inventors: Masaru Ishiguro, Aichi (JP); Keisuke Mizutani, Aichi (JP); Wataru Kato, Aichi (JP); Noriyuki Sato, Aichi (JP); Kazuya Aoyama, Aichi (JP)

(73) Assignee: Taihei Machinery Works, Ltd., Aichi (JP)

( * ) Notice: Subject to any disclaimer, the term of this patent is extended or adjusted under 35 U.S.C. 154(b) by 87 days.

(21) Appl. No.: 16/323,760

(22) PCT Filed: Jun. 26, 2017

(86) PCT No.: PCT/JP2017/023369
§ 371 (c)(1),
(2) Date: Feb. 6, 2019

(87) PCT Pub. No.: WO2018/030004
PCT Pub. Date: Feb. 15, 2018

(65) Prior Publication Data

US 2019/0176359 A1 Jun. 13, 2019

(30) Foreign Application Priority Data

Aug. 9, 2016 (JP) ..... JP2016-156476

(51) Int. Cl.
*F26B 25/00* (2006.01)
*B27D 3/02* (2006.01)
(Continued)

(52) U.S. Cl.
CPC ..... *B27D 3/02* (2013.01); *F26B 3/20* (2013.01); *F26B 15/12* (2013.01); *F26B 15/14* (2013.01);
(Continued)

(58) Field of Classification Search
CPC ..... B27D 3/02; F26B 25/00; F26B 25/001; F26B 25/003; F26B 25/004; F26B 15/00;
(Continued)

(56) References Cited

U.S. PATENT DOCUMENTS 3,170,189 A * 2/1965 Hutter ..... B27D 3/02 425/339
8,006,614 B2 8/2011 Yamada et al.
2011/0120654 A1* 5/2011 Yamada ..... B27D 3/02 156/358

FOREIGN PATENT DOCUMENTS

CA 2137408 C 7/2001
CA 2778862 A1 11/2013
(Continued)

OTHER PUBLICATIONS

Canadian Office Action for patent application CA3033048 dated Jan. 24, 2020.
(Continued)

*Primary Examiner* — John P McCormack
(74) *Attorney, Agent, or Firm* — Thomas | Horstemeyer, LLP

(57) ABSTRACT

A horizontal multistage press apparatus 1 (multistage drying apparatus) includes conveyance paths R1 to R4 (first to fourth conveyance paths) in which the veneer sheet W1 (sheet material to be treated) is carried out in a standing state. The conveyance path R1 is positioned over between the loader device 10 and the hot press device 20, the conveyance path R2 is positioned over between the hot press
(Continued)

device 20 and the open transpiration device 40, the conveyance path R3 is positioned over between the open transpiration device 40 and the temperature control press device 50, and the conveyance path R4 is positioned over between the temperature control press device 50 and the unloader device 60. The conveyance paths R1 to R4 are arranged in a straight line in plan view.

8 Claims, 45 Drawing Sheets

(51) Int. Cl.

| | |
|---|---|
| ***F26B 3/20*** | (2006.01) |
| ***F26B 15/14*** | (2006.01) |
| ***F26B 15/12*** | (2006.01) |
| ***F26B 21/10*** | (2006.01) |

(52) U.S. Cl.
CPC ..... *F26B 21/10* (2013.01); *F26B 25/004* (2013.01); *F26B 2210/14* (2013.01)

(58) Field of Classification Search
CPC ..... F26B 15/14; F26B 15/12; F26B 21/10; F26B 3/18; F26B 3/20; F26B 2210/14; F26B 9/085
USPC ..... 34/236, 519, 524, 526; 414/226.01, 414/225.01, 222.01, 222.03, 226.02, 414/226.03
See application file for complete search history.

(56) References Cited

FOREIGN PATENT DOCUMENTS

| | | | |
|---|---|---|---|
| FR | 2021839 | A1 | 7/1970 |
| JP | S415073 | B1 | 3/1966 |
| JP | S4828169 | B1 | 8/1973 |
| JP | S60259402 | A | 12/1985 |
| JP | S6399903 | A | 5/1988 |
| JP | H0753364 | B2 | 3/1993 |
| JP | H07186107 | A | 7/1995 |
| JP | 2007313863 | A | 12/2007 |
| JP | 2007313864 | A | 12/2007 |
| JP | 2008027681 | A | 2/2008 |
| JP | 2011201016 | A | 10/2011 |

OTHER PUBLICATIONS

International Search Report for PCT/JP2017/023369 dated Sep. 19, 2017.

* cited by examiner

MULTISTAGE DRYING APPARATUS AND MULTISTAGE DRYING METHOD FOR SHEET MATERIAL TO BE TREATED

CROSS-REFERENCE TO RELATED APPLICATIONS

This present application is a National Stage entry of International Application No. PCT/JP2017/023369, filed Jun. 26, 2017, which claims priority to Japanese Patent Application No. 2016-156476, filed Aug. 9, 2016. The disclosures of the foregoing applications are incorporated herein in their entireties.

FIELD OF THE INVENTION

The invention relates to a multistage drying apparatus and a multistage drying method for a sheet material to be treated.

DESCRIPTION OF THE RELATED ART

A vertical multistage drying apparatus in which a plurality of sheet materials to be treated such as laminated sheets and veneer sheets in a horizontal state are stacked in the up-down direction, and the sheet materials are conveyed in a horizontal state from a loader device to an unloader device through a hot press device (vertical system in which sheet materials and hot plates held in a horizontal direction are alternately stacked in the up-down direction and pressurized and heated), an open transpiration device, and furthermore, and a cold press device (vertical system in which sheet materials and cooling plates held in the horizontal direction are alternately stacked in the up-down direction and pressurized and cooled) is known (see, for example, Patent Documents 1 and 2 below).

CITATION LIST

Patent Document

[Patent Document 1] Japanese Patent No. 2857049
[Patent Document 2] Japanese Examined Patent Publication No. S41-5073

SUMMARY OF INVENTION

Technical Problem

However, in the vertical multistage drying apparatuses described in the above. Patent Documents 1 and 2, there has been a problem that the space occupied by the entire device (floor space) becomes too wide in order to convey and pressurize, a sheet material to be treated such as a veneer sheet having a surface (for example, 1 m×2 m) much wider than a thickness (for example, 2 to 10 mm) in a horizontal state. In addition, when the sheet material to be treated is a veneer sheet, in the transpiration step of water vapor in the open transpiration device, the higher the upper layer side is, the higher the moisture content tends to be due to water vapor evaporating from the lower layer side. Therefore, it is necessary to set the drying time in the transpiration step long in order to secure transpiration of the veneer sheet on the upper layer side, and it has been difficult to execute the subsequent treatment (for example, gluing step) at an early stage In addition, since inconsistency tends to occur in the moisture state between the upper layer side and the lower layer side, it has not been easy to keep the quality of the veneer sheet, such as the occurrence condition of cracks and warpage, constant. On the other hand, when it is necessary to execute the subsequent treatment at an early stage, it has been inevitable to perform laborious work of taking out only the veneer sheet on the upper layer side and the like and re-drying it.

In addition, when the sheet material to be treated is plywood, the plywood bonded by hot pressing is normally sawed to prescribed dimensions with the four-side edge portions sawed by a four-side sawing device in the next step, such as a double saw or a double-end tenoner, and commercialized. However, since the plywood immediately after pressurized heating holds a temperature of about 100° C., the plywood is already thermally expanded, and if the plywood is sawed on four sides with the prescribed dimension intact, the plywood shrinks into below the prescribed dimensions at the normal temperature. In order to avoid this, the plywood immediately after pressurized heating has needed work of temporarily piling the plywood into a heap before sawing the plywood on four sides, and leaving the plywood for a predetermined time (1 to 2 day-and-nights on average) into a normal temperature. Due to this, a plurality of heaps constantly occur within the limited installation area of the plywood factory, resulting in a reduction in working efficiency.

Furthermore, the above Patent Document 1 discloses that the veneer sheet or the like after the transpiration step can be cooled with a cold plate of cold pressing with a distorted veneer sheet being corrected into a beautiful planar shape without any crack. Although there is no further mention of this cold plate, the cold plate is typically considered to be used at a temperature of the steel plate being the material thereof, or at a temperature obtained by circulating tap water or the like in the cold plate. However, the temperature of the steel plate or of the water circulated in the cold plate depends on the outside air temperature, and the temperature of the steel plate or the water temperature changes throughout the year. For example, the cold plate temperature changes within the range of about maximum 30° C. to 40° C. due to temperature difference between summer and winter, and along with this, the finished temperature of the veneer sheet to be pressurized and cooled is in a state high in summer and low in winter, and constantly variable, which hinders the work in subsequent steps. For example, the veneer sheet is coated with glue by a subsequent gluing step and bonded to plywood or laminated materials, and it is necessary to adjust the viscosity of glue based on the finished temperature of the veneer sheet, so that in adjusting the viscosity of glue, a compounding ratio of a curing accelerator, an extender and/or filler, and the like to be added to adhesive resin has to be determined, and the viscosity of glue has to be adjusted each time.

An object of the invention is to provide a multistage drying apparatus and a multistage drying method making it possible to manufacture, without any extra time and effort while reducing the space to be occupied by the entire apparatus, a sheet material to be treated typified by a veneer sheet maintained at the desired finished temperature.

Means for Solving the Problem and Effects of the Invention

In order to solve the above problems, in the multistage drying apparatus for a sheet material to be treated according to the invention includes:

a multistage drying apparatus for a sheet material to be treated including in order from an upstream side in a conveying direction:

a loader device configured to load a plurality of sheet materials to be treated, a hot press device configured to sandwich, pressurize, and heat each sheet material to be treated from both surfaces with a first contact plate, an open transpiration device configured to evaporate water vapor from a surface of each sheet material to be treated, a temperature control press device configured to sandwich, pressurizes, and temperature-control each sheet material to be treated from both surfaces with a second contact plate, and an unloader device configured to unload a plurality of sheet materials to be treated, the multistage drying apparatus for a sheet material to be treated including:

a first conveyance path positioned over the loader device and the hot press device, the first conveyance path in which a plurality of sheet materials to be treated set in a standing state by the loader device are carried out while being held in parallel along a conveying direction, and are carried into a press position of the hot press device in a standing state;

a second conveyance path positioned over the hot press device and the open transpiration device, the second conveyance path in which a plurality of sheet materials to be treated released from pressing force by the first contact plate are carried out in a standing state from a press position of the hot press device, and are carried into an open transpiration position of the open transpiration device in a standing state while being held in parallel along a conveying direction;

a third conveyance path positioned over the open transpiration device and the temperature control press device, the third conveyance path in which a plurality of sheet materials to be treated from which water vapor is evaporated are carried out in a standing state from an open transpiration position of the open transpiration device, and are carried into a press position of the temperature control press device in a standing state while being held in parallel along a conveying direction; and a fourth conveyance path positioned over the temperature control press device and the unloader device, the fourth conveyance path in which a plurality of sheet materials to be treated released from pressing force by the second contact plate are carried out in a standing state from a press position of the temperature control press device, and are carried into an unloader position of the unloader device in a standing state while being held in parallel along a conveying direction. The first to fourth conveyance paths are arranged in a straight line in plan view, water vapor is configured to be evaporated from both surfaces of each sheet material to be treated held in the open transpiration position in a standing state, and a finished temperature of each sheet material to be treated is maintained at a desired temperature by the temperature control press device.

In addition, in order to solve the above problems, in the multistage drying method for a sheet material to be treated according to the invention includes:

a multistage drying method for a sheet material to be treated including:

a loader step of loading a plurality of sheet materials to be treated, a hot press step of sandwiching, pressurizing, and heating each sheet material to be treated from both sides with a first contact plate, an open transpiration step of evaporating water vapor from a surface of each sheet material to be treated, a temperature control press step of sandwiching, pressurizing, and temperature-controlling each sheet material to be treated from both sides with a second contact plate, and an unloader step of unloading a plurality of sheet materials to be treated, the multistage drying method for a sheet material to be treated including:

a first conveyance step performed between the loader step and the hot press step, the first conveyance step of carrying out while holding in parallel along a conveying direction a plurality of sheet materials to be treated set in a standing state by the loader step, and of carrying in a standing state the plurality of sheet materials to be treated into a press position when performing the hot press step;

a second conveyance step performed between the hot press step and the open transpiration step, the second conveyance step of carrying out a plurality of sheet materials to be treated released from pressing force by the first contact plate in a standing state from a press position when performing the hot press step, and of carrying in a standing state while holding in parallel along a conveying direction the plurality of sheet materials to be treated into an open transpiration position when performing the open transpiration step;

a third conveyance step performed between the open transpiration step and the temperature control press step, the third conveyance step of carrying out a plurality of sheet materials to be treated from which water vapor is evaporated in a standing state from the open transpiration position, and of carrying in a standing state while holding in parallel along a conveying direction the plurality of sheet materials to be treated into a press position when performing the temperature control press step; and a fourth conveyance step performed between the temperature control press step and the unloader step, the fourth conveyance step of carrying out a plurality of sheet materials to be treated released from pressing force by the second contact plate in a standing state from a press position when performing the temperature control press step, and of carrying in a standing state while holding in parallel along a conveying direction the plurality of sheet materials to be treated into an unloader position when performing the of the unloader step. The first to fourth conveyance steps are performed along a conveyance path in a straight line in plan view, water vapor is configured to be evaporated from both surfaces in a standing state of each sheet material to be treated in the open transpiration step, and a finished temperature of each sheet material to be treated is maintained at a desired temperature by the temperature control press step.

In the multistage drying apparatus for a sheet material to be treated in the invention and the multistage drying method using it, the sheet material to be treated is conveyed in a standing state from the loader device to the unloader device through the hot press device (horizontal type in which sheet materials to be treated held in the up-down direction and hot plates are overlapped alternately in the horizontal direction, pressurized, and heated), the open transpiration device, and furthermore, the temperature control press device (horizontal type in which sheet materials to be treated held in the up-down direction and temperature control plates are overlapped alternately in the horizontal direction, pressurized, and temperature-controlled). Thus, since each sheet material to be treated is conveyed and pressurized in a standing state, the space occupied by the entire apparatus (floor space) can be set smaller than a multistage drying apparatus for a sheet material to be treated of the vertical type.

In addition, in the open transpiration device, each sheet material to be treated is opened and held in a standing state, and water vapor can be evaporated from both surfaces of the sheet material to be treated. Therefore, the transpiration becomes uniform in each sheet material to be treated, and since inconsistency is hard to occur in the moisture state between the upper part and the lower part of each sheet material to be treated, it is also possible to keep constant the quality of the sheet material to be treated, such as the occurrence condition of cracks and warpage.

Furthermore, since it is possible to set the finished temperature of the sheet material to be treated to a desired temperature with the temperature control press device, in manufacturing plywood or laminated materials, it is also possible to make uniform the viscosity of glue throughout the year in the gluing step being the next step. Therefore, it is unnecessary to adjust the viscosity of glue every time according to the change in the outside air temperature, and labor-saving can be achieved in the subsequent steps. In addition, when the sheet material to be treated is plywood, since the desired finished temperature is obtained by the temperature control press device, the thermal expansion state is eliminated, and the plywood can be immediately sawed on the four sides by the four-side sawing device in the next step without temporarily piled. Thus, it is possible to improve the work efficiency.

DESCRIPTION OF EMBODIMENTS

Hereinafter, embodiments of the invention will be described with reference to the drawings.

Example 1

Figure 1:
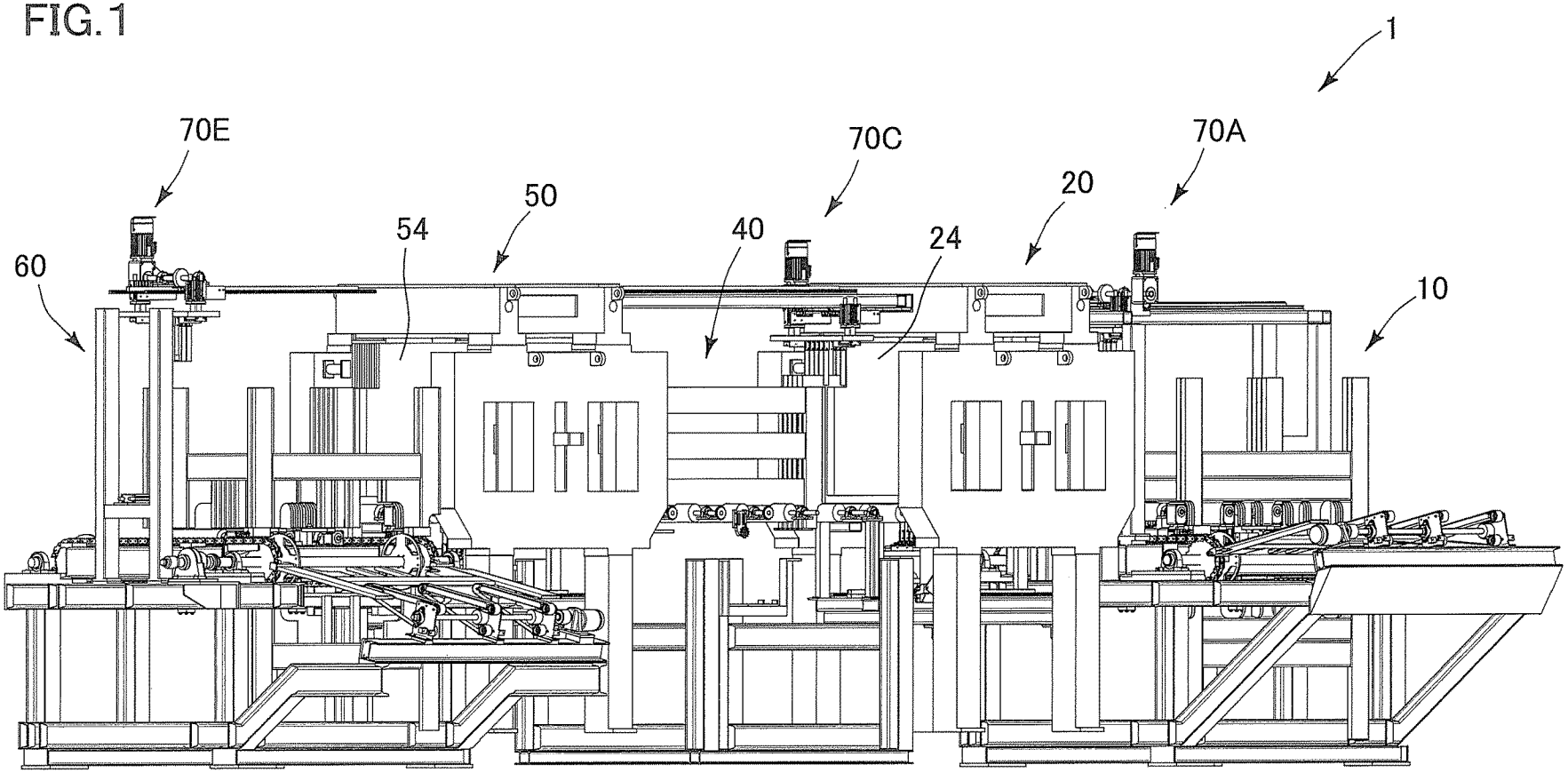
FIG. 1 is a perspective view showing a main part of a horizontal multistage press apparatus to which the invention is applied.
Figure 2:
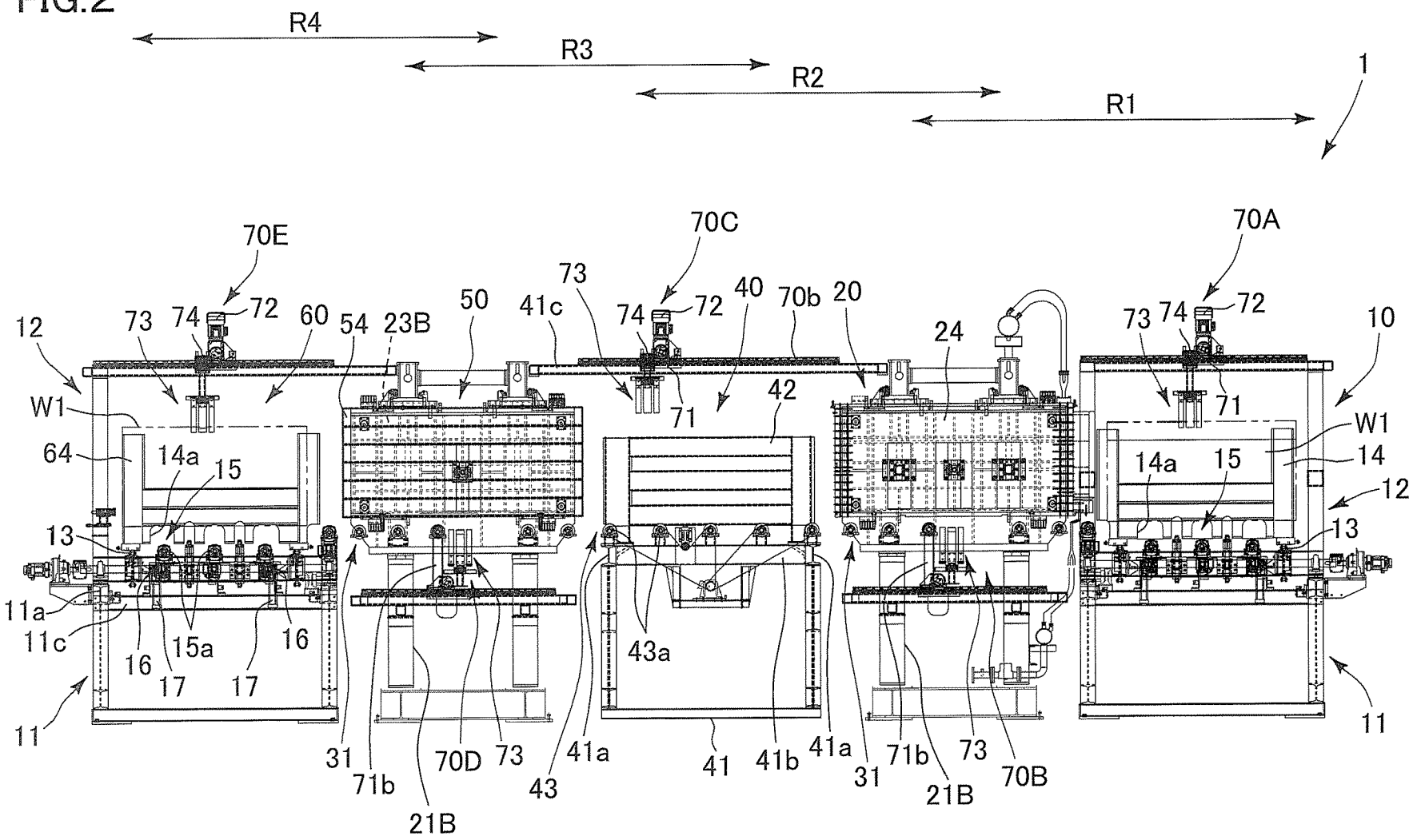
FIG. 2 is a front view of FIG. 1.
Figure 3:
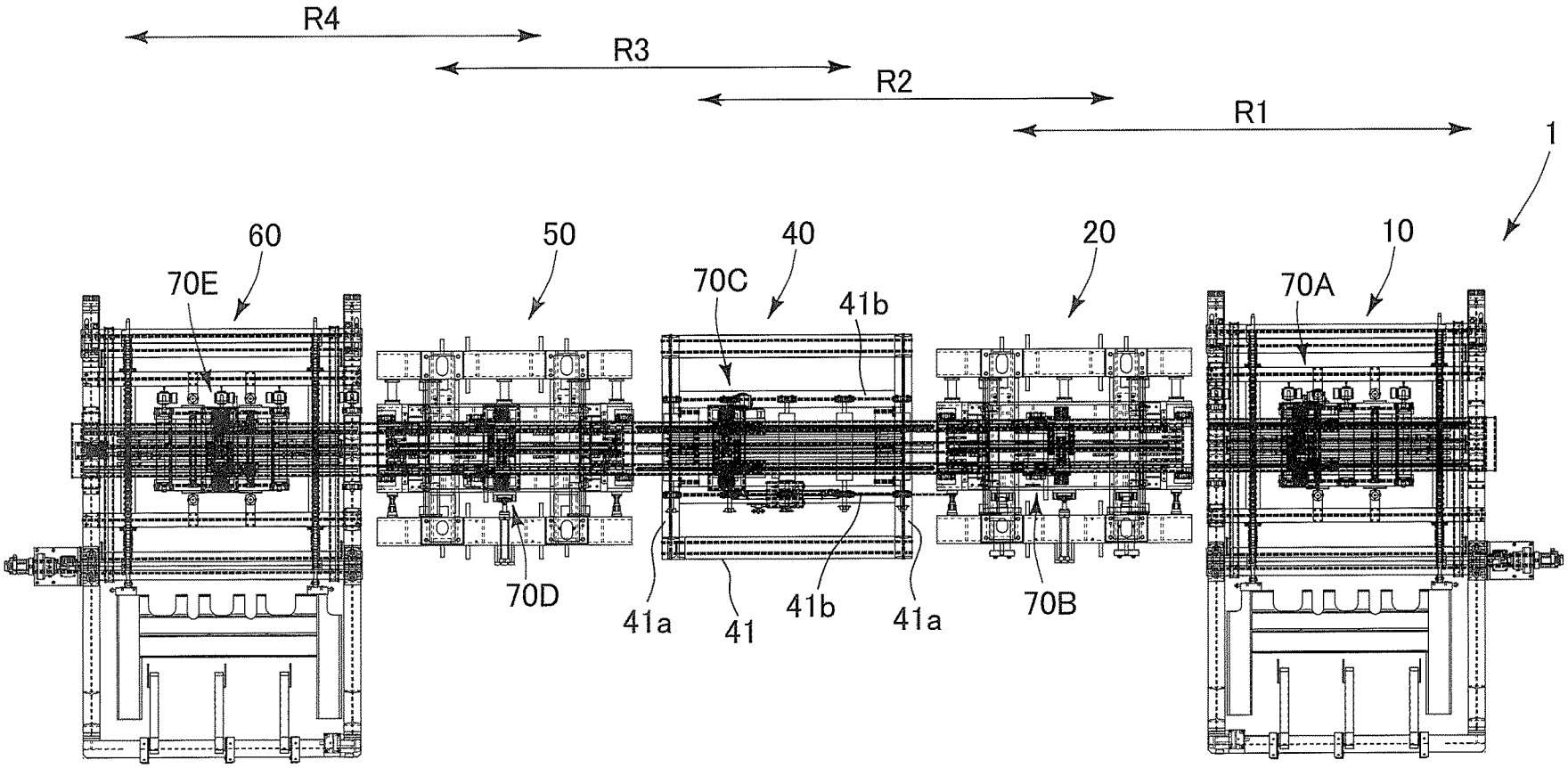
FIG. 3 is a plan view of FIG. 1.
Figure 7A:
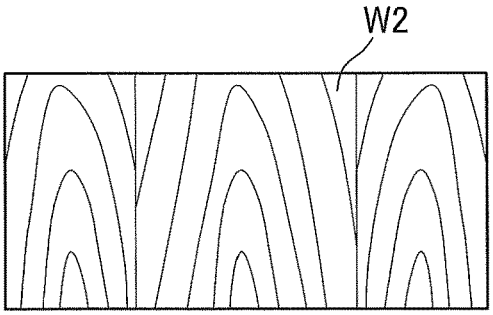
FIG. 7A is a front view showing an example of a veneer sheet as a sheet material to be treated.

FIGS. 1 to 3 show main parts of a horizontal multistage press apparatus 1 to which a multistage conveyance apparatus and a multistage press apparatus for a sheet material to be treated according to the invention are applied. The horizontal multistage press apparatus 1 has a function of treating to pressurize and dry a rectangular plate-shaped veneer sheet W1 as a sheet material to be treated (see FIGS. 7A and 7C; hereinafter referred to as "veneer sheet W1"). It should be noted that the sheet material to be treated is not limited to a veneer sheet, and for example, a laminated material, plywood, a decorative laminated sheet or the like can be used.

The horizontal multistage press apparatus 1 includes: a loader device 10 for loading a plurality of veneer sheets W1 for drying, a hot press device 20 for sandwiching each veneer sheet W1 from both sides with a hot plate 24 (first contact plate) to pressurize and heat the corresponding veneer sheet W1, an open transpiration device 40 for evaporating water vapor from the surface of each veneer sheet W1, a temperature control press device 50 for sandwiching each veneer sheet W1 from both sides with a temperature control plate 54 (second contact plate) to pressurize, temperature-control, and keep the corresponding veneer sheet W1 at a desired finished temperature, and an unloader device 60 for unloading a plurality of temperature-controlled veneer sheets W1, in this order from the upstream side in the conveying direction.

The loader device 10 functions as a carry-in unit, causes the veneer sheet W1 to stand from a substantially horizontal state (including inclined range of about ±45° with respect to the horizontal plane), and holds the veneer sheet W1 in a standing state to carry the veneer sheet W1 into the hot press device 20. The hot press device 20 functions as a pressurizing and heating unit, pressurizes and heats the veneer sheet W1 in the standing state one by one for a predetermined time with the veneer sheet W1 sandwiched between the hot plates 24 (for example, held for 5 to 10 minutes in a state where the hot plate temperature is 180° C.), and carries the heated and dried veneer sheet W1 into the open transpiration device 40.

The open transpiration device 40 functions as an open section unit (atmospheric release unit), promotes evaporation of surplus moisture remaining inside the veneer sheet W1 to the atmosphere (for example, holding for a few minutes in a state where the veneer sheet temperature is 90° C.) while holding each veneer sheet W1 in a standing state, and carries the evaporated veneer sheet W1 into the temperature control press device 50. The temperature control press device 50 functions as a pressurizing and temperature-control unit, pressurizes and temperature-controls the veneer sheet W1 in the standing state one by one for a predetermined time with the veneer sheet W1 sandwiched between the temperature control plates 54 (for example, held for a few minutes in a state where the temperature-control plate temperature is 25 to 35° C.), and carries the temperature-controlled veneer sheet W1 into the unloader device 60.

The unloader device 60 functions as a carry-out unit, returns the veneer sheet W1 after the drying treatment to a substantially horizontal state, and carries the veneer sheet W1 out of the device 60. In the following, each device will be described in more detail below. It should be noted that in the following description, the left-right direction in FIG. 2 is defined as the left-right direction in the horizontal multistage press apparatus 1, the up-down direction in FIG. 2 is defined as the up-down direction in the horizontal multistage press apparatus 1, and the front-back direction in FIG. 2 is defined as the front-back direction in the horizontal multistage press apparatus 1.

First, the loader device 10 will be described. As shown in FIGS. 4A to 6, 23, and the like, the loader device 10 includes a lower frame 11 serving as a base and a gate-shaped upper frame 12 erected on the lower frame 11. The lower frame 11 includes a pair of beams 11*a* extended in the front-back direction and a pair of beams 11*b* extended in the left-right direction. These beams 11*a* and 11*b* are connected in a form intersecting at right angles in a plan view. It should be noted that in FIG. 23 and the like, some members constituting the loader device 10 are omitted.

On the upper part of the beam 11*a*, a chain conveyor 13 is installed. A loader shelf 14 is connected to the chain conveyor 13 via a connecting member 13*a* at predetermined pitches. The loader shelf 14 has a substantially U-shaped plate shape, receives a veneer sheet W1 from a feed mechanism (not shown) in a substantially horizontal position D1 (see FIG. 6) on the front side of the loader device 10 along with the rotation of the chain conveyor 13 by the forward rotation drive of the chain Conveyor motor 203 (see FIG. 14) described below, and causes the veneer sheet W1 to completely stand in the standing position D2 while supporting and gradually raising the veneer sheet W1 along with the further forward rotation drive of the chain conveyor 13. Each veneer sheet W1 reaching the standing position D2 is held in the standing state due to contact with the front and rear loader shelves 14. The number of the veneer sheets W1 to be accommodated in the standing position D2 by the loader shelves 14 can be set to, for example, about 10 to 200.

The loader unit conveyor 15 is supported by the beam 11*b* so as to be movable up and down along the guide 17 by the conveyor elevating cylinder 16. The conveyor elevating cylinder 16 is provided on a beam 11*c* built parallel to the beam 11*b* (see FIG. 4A). When the loader unit conveyor 15 includes a plurality of rollers 15*a*, a plurality of cutouts 14*a* are formed in the base end portion corresponding to the U-shaped bottom side of the loader shelf 14. Each cutout 14*a* is provided corresponding to the roller 15*a* of the loader unit conveyor 15.

The loader unit conveyor 15 is in the descent position (original position, see FIG. 4A) during the forward rotation drive of the chain conveyor 13, and is in the ascent position (operation position, see FIG. 5) during the drive stop of the chain conveyor 13 and the forward rotation drive of the loader unit conveyor 15. When the loader unit conveyor 15 is in the ascent position (operation position), the roller 15*a* of the loader unit conveyor 15 is set so that the roller 15*a* is positioned in the corresponding cutout 14*a*, and a conveying surface F1 (see FIG. 28) horizontally continuous with the conveying surface F2 of the hot press unit roller conveyor 31 described below is formed.

In this state, the roller 15*a* of the loader unit conveyor 15 is at the same height position as the rollers 31*a* to 31*c* (see FIG. 11) of the hot press unit roller conveyor 31 of the hot press device 20 described below, and is made to be carried into the hot press device 20 along with the rotation of the roller 15*a* due to the forward rotation drive of a loader unit conveyor motor 204 described below (see FIG. 14) without each veneer sheet W1 (indicated by two-dot chain lines in FIGS. 4A and 5) in the standing position D2 being interfered by the chain conveyor 13.

Figure 4A:
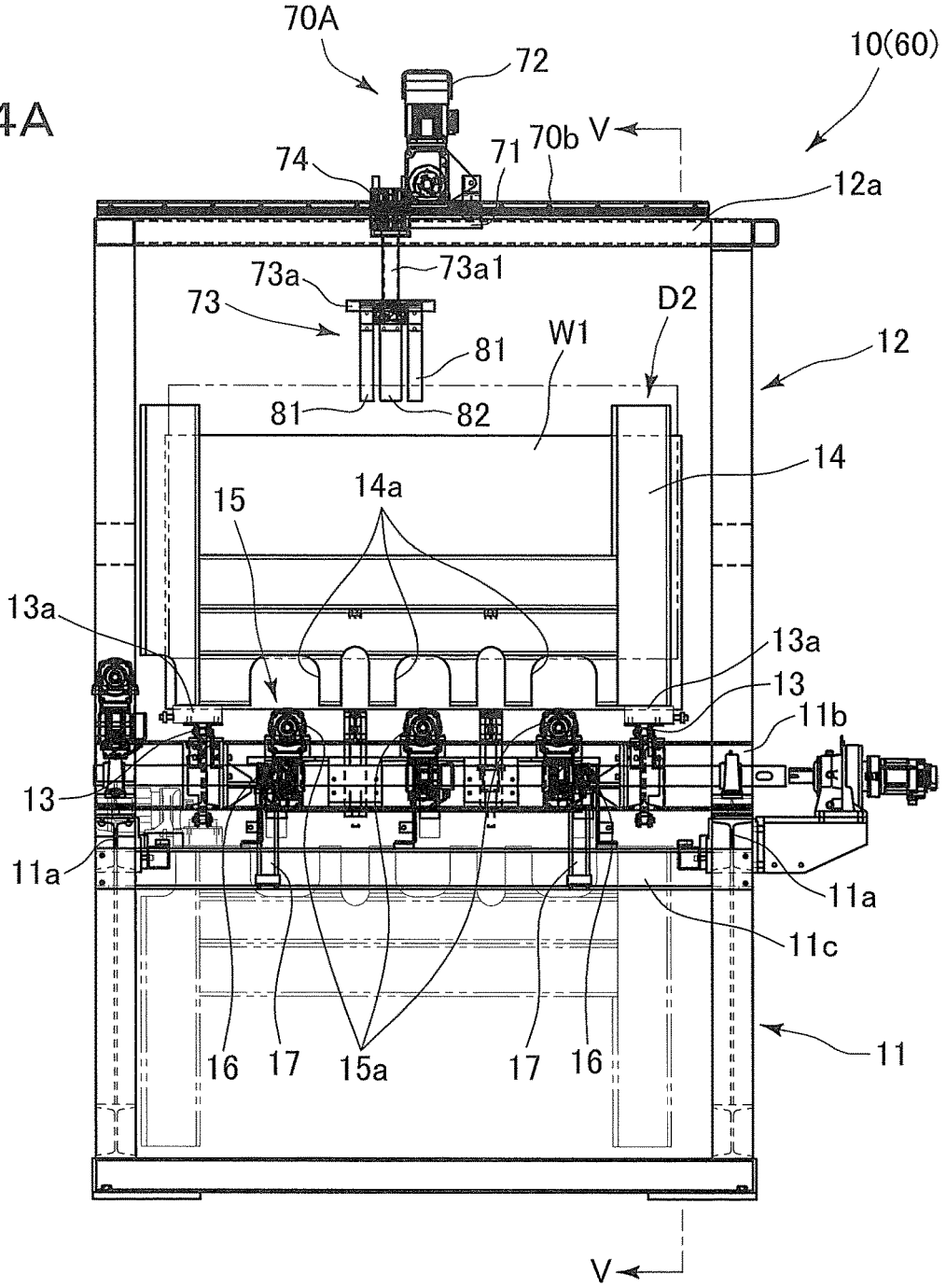
FIG. 4A is an enlarged front view of a loader device shown in FIG. 2.
Figure 4B:
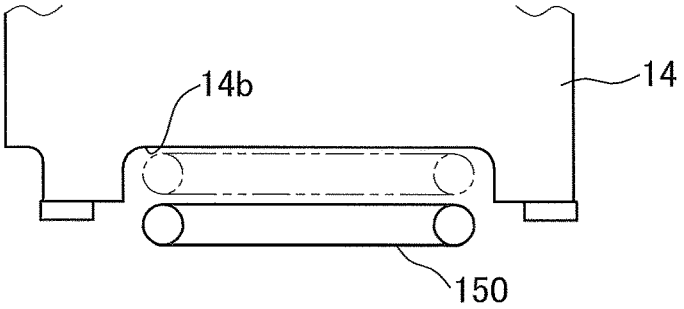
FIG. 4B is a schematic diagram showing a modified example of a loader Shelf in FIG. 4A.

It should be noted that as shown in FIG. 4B, if the shape of the cutout 14*a* of the loader shelf 14 is changed to a rectangular cutout 14*b* and the loader unit conveyor 15 is made into a belt conveyor 150 using a belt material having a high friction coefficient, the lower end of the veneer sheet W1 can be placed on the conveyor more reliably. That is, for example, as in the veneer sheet W2 shown in FIG. 7A, as long as the veneer sheet W2 is obtained by joining plate pieces so that the fiber direction is in a direction orthogonal to the longitudinal direction of the veneer sheet W2 (width direction), when the veneer sheet W2 is erected so that its width direction is the up-down direction, even if the veneer sheet W2 comes into contact with the roller 15*a*, it is possible to avoid the lower end thereof from being rounded due to the strength of the veneer sheet W2 itself (see FIG. 7B). As a result, the lower end of the veneer sheet W2 can be reliably placed on the roller 15*a*.

Figure 7B:
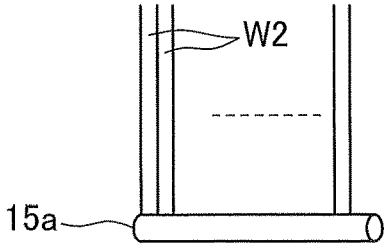
FIG. 7B is an explanatory diagram showing a state in which the veneer sheet in FIG. 7A is supported by a roller.
Figure 7C:
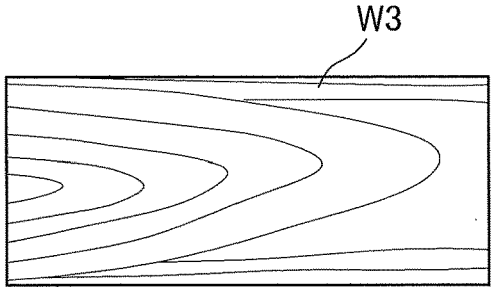
FIG. 7C is a front view showing another example of a veneer sheet as a sheet material to be treated.
Figure 7D:
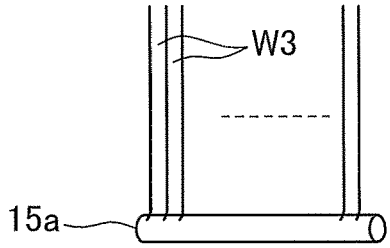
FIG. 7D is an explanatory diagram showing a state in which the veneer sheet in FIG. 7C is supported by a roller.
Figure 7E:
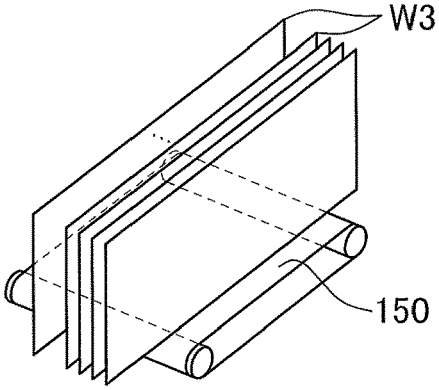
FIG. 7E is an explanatory diagram showing a state in which the veneer sheet is supported by a belt conveyor.
Figure 8:
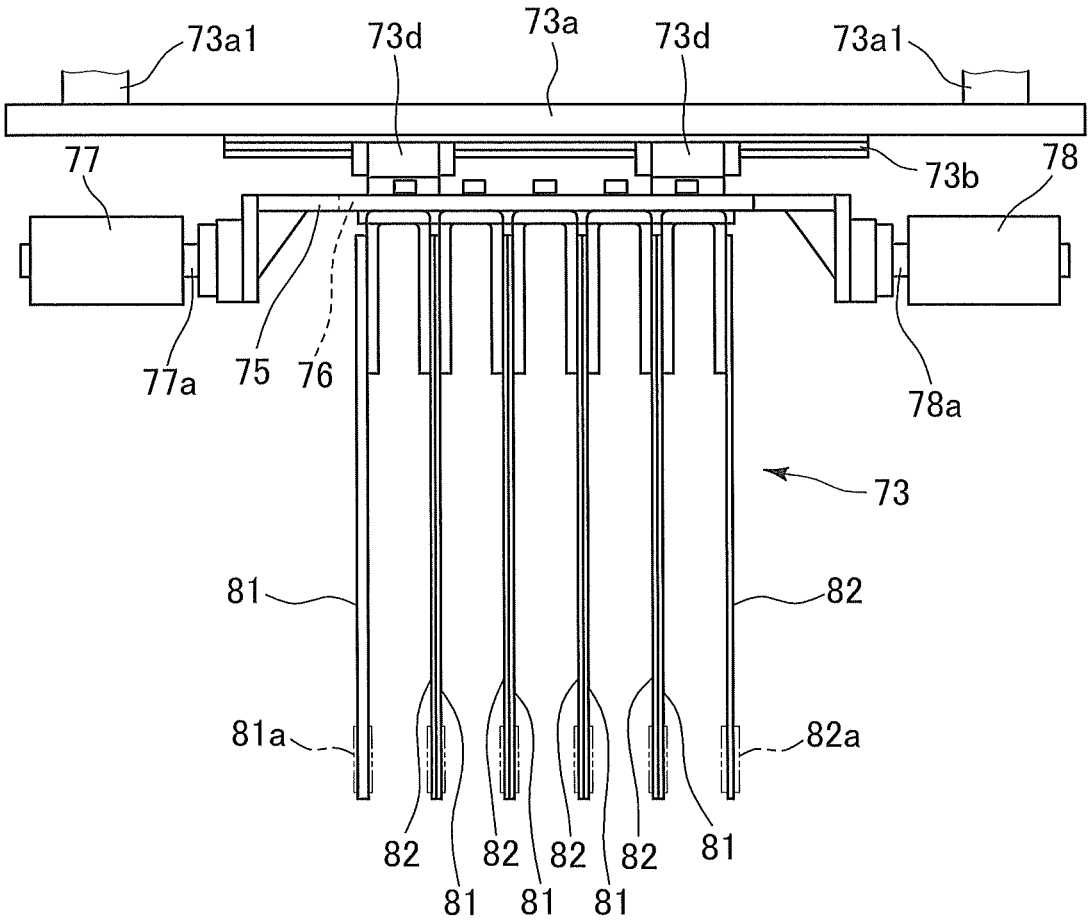
FIG. 8 is an enlarged front view of a gripping member used in each device in FIG. 1.
Figure 9:
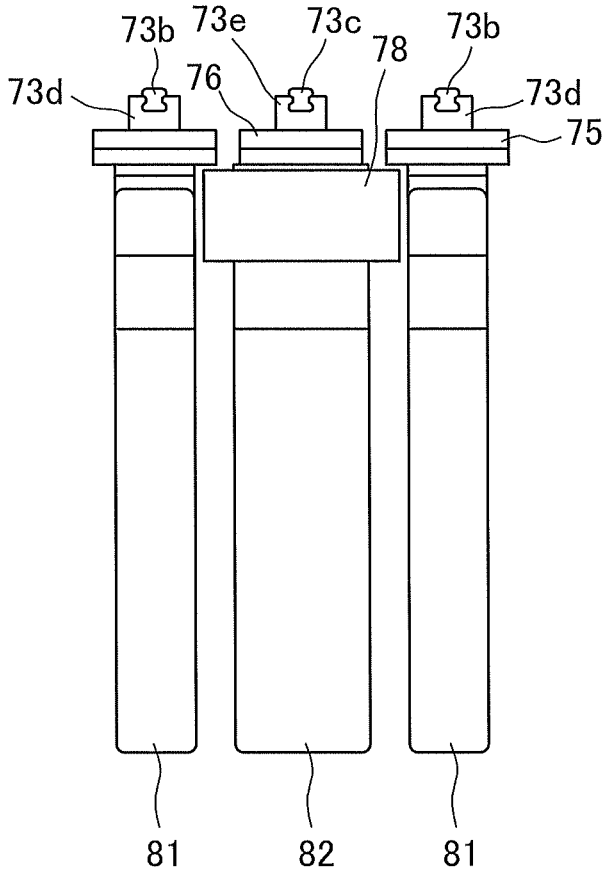
FIG. 9 is a side view of FIG. 8.

However, for example, as in the veneer sheet W3 shown in FIG. 7C, if the fiber direction is parallel to the longitudinal direction of the veneer sheet W3, when the veneer sheet W3 comes into contact with the roller 15*a*, the lower end thereof tends to be rounded due to vibrations or the like when the veneer sheet W3 is sent from the roller 15*a* to the roller 15*a* (see FIG. 7D). This tendency to be rounded occurs particularly conspicuously in a veneer sheet in which the fiber direction is parallel to the longitudinal direction of the veneer sheet W3 or in a wet state before drying, and as a result, it is highly likely that the veneer sheet W3 is clogged between the rollers 15*a*. Thus, changing the roller conveyor to the belt conveyor 150 (see FIG. 7E) allows the veneer sheet to be conveyed more reliably regardless of the type and nature of the veneer sheet in which the veneer sheet W3 is clogged between the rollers 15*a*. Therefore, in the loader device 10, a conveyor for supporting and conveying the lower end of the veneer sheet W1 may be replaced with the belt conveyor 150 from the rollers 15*a* to be adopted. In this case, in the base end portion corresponding to the U-shaped bottom side of the loader shelf 14, a rectangular cutout 14*b* in which the belt conveyor 150 can intervene is formed in place of a plurality of cutouts 14*a* (see FIG. 4B).

The lower frame 11 is provided with a loader unit conveyor 15, while the upper frame 12 is provided with a loader unit gripping body 70A. The loader unit gripping body 70A includes a traveling body 71 supported by laterally extended three beams 12*a* constituting the constituent members of the upper frame 12, the traveling body 71 movable along the beams 12*a*, a traveling body motor 72 with a speed reducer for driving the traveling body 71, a gripping member 73 capable of gripping the veneer sheet W1, and a pair of gripping member elevating cylinders 74 for supporting and connecting the gripping member 73 so as to be movable up and down with respect to the traveling body 71.

The beams 12*a* each are arranged in parallel with each other at equal intervals. Guide rails 70*a* are laid on the upper surfaces of the beams 12*a* on both sides and a rack gear 70*b* is laid on the upper surface of the middle beam 12*a*. The traveling body 71 is placed on the guide rail 70*a* via the slide guide 71*a*, and the traveling body motor 72 is gear-coupled to the rack gear 70*b* via the intermediate drive shaft 72*a* and the pinion gear 72*b*. Thus, the traveling body 71 laterally moves along the guide rail 70*a* along with the forward and reverse drive of the traveling body motor 72.

It should be noted that the drive means of the traveling body 71 is not limited to the one adopting the traveling body motor 72, and in addition to or instead of this, for example, a drive system mainly including a fluid cylinder (hydraulic pressure or pneumatic pressure) may be adopted. The drive transmission means of the traveling body 71 is not limited to the one adopting the gear coupling, and in addition to or instead of this, for example, a drive transmission system mainly including a pulley and a timing belt may be adopted.

Figure 5:
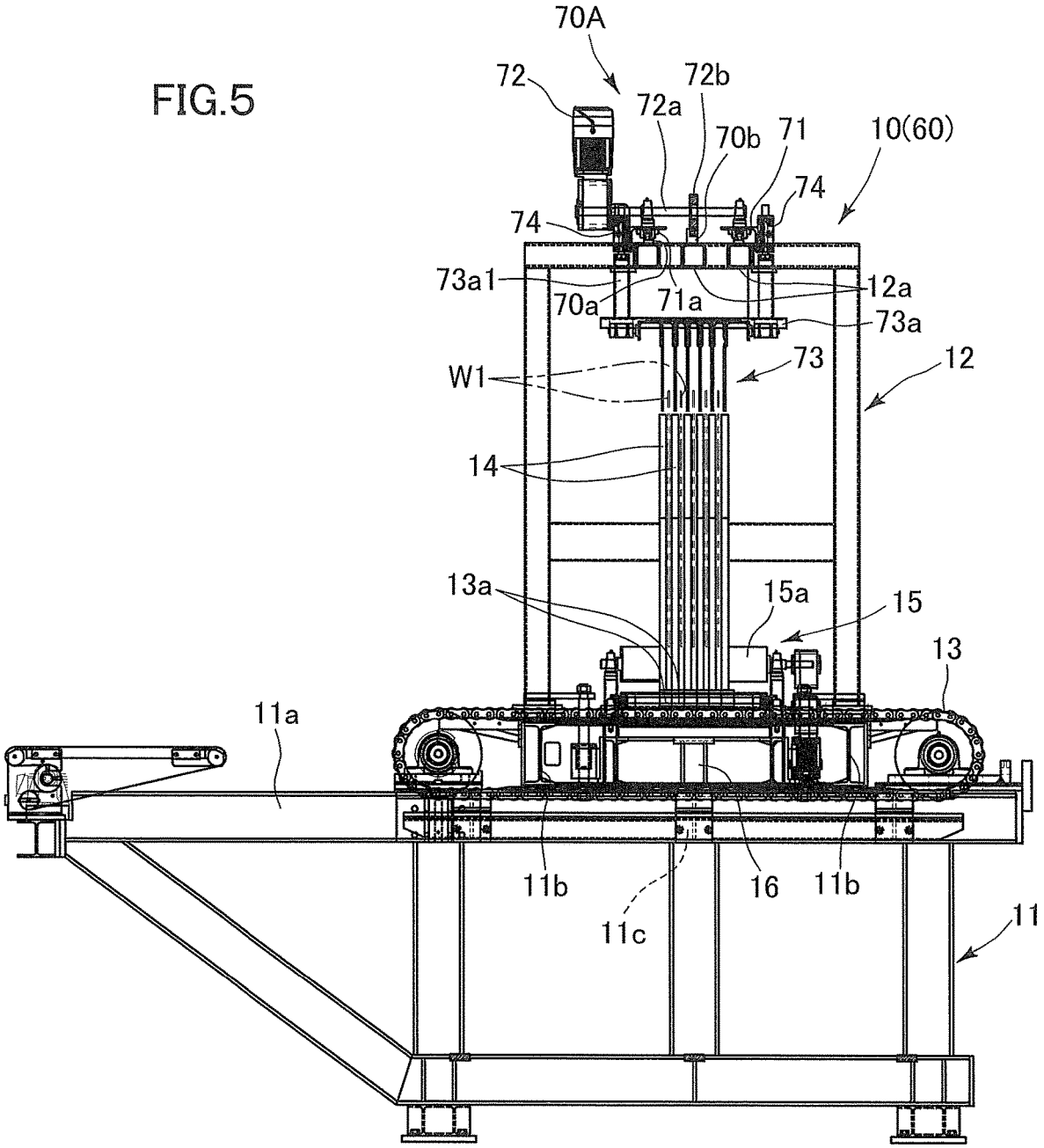
FIG. 5 is a side view showing a state after the ascent of a loader unit conveyor in FIG. 4A.
Figure 6:
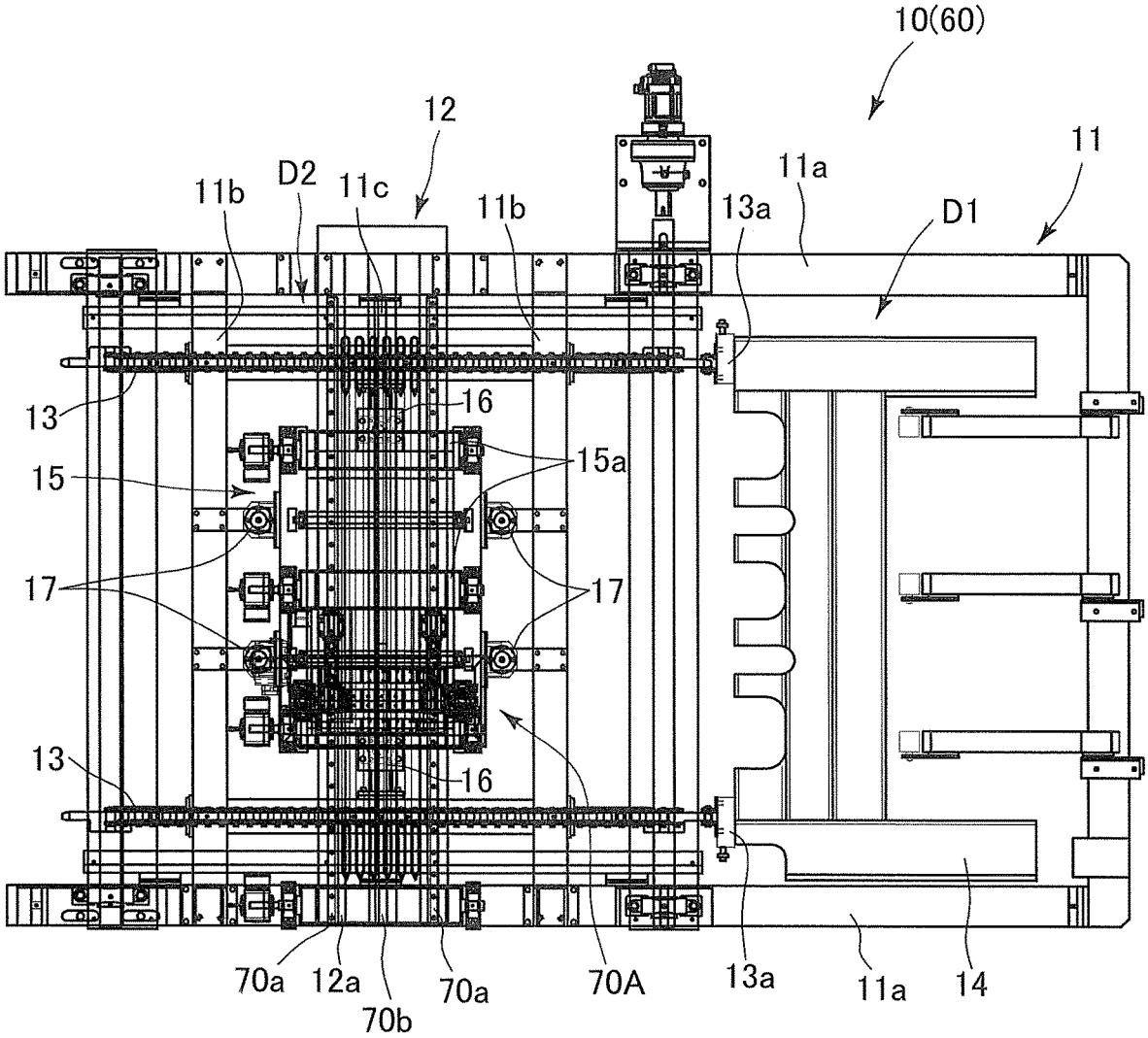
FIG. 6 is a plan view of FIG. 4A.
Figure 26:
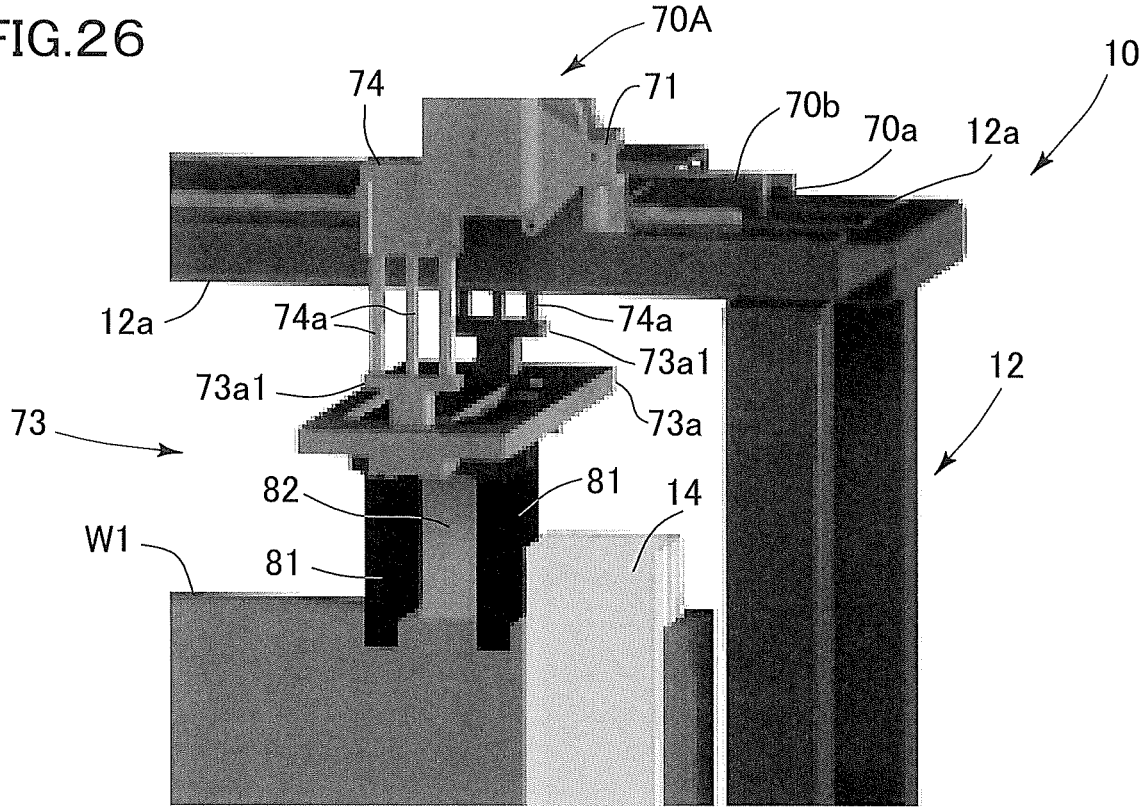

As shown in FIGS. 4A, 5, 26, and the like, the gripping member 73 includes a rectangular frame-shaped main body 73*a* arranged so as to extend in the front-back direction on the lower side of the beam 12*a*. A protruding portion 73*a*1 protruding upward is formed on the upper surface of each end portion in the front-back direction of the main body 73*a* and a tip of the piston rod 74*a* of the corresponding gripping member elevating cylinder 74 is connected to each protruding portion 73*a*1. On the lower surface of the main body 73*a*, three guide rails 73*b*, 73*c*, and 73*b* are arranged in parallel and at equal intervals as shown in FIGS. 8 to 10A and 10B.

On the respective guide rails 73*b* on both sides, outer gripping piece blocks 75 are suspended via the slide guides 73*d*, and on the middle guide rail 73*c*, an inner gripping piece block 76 is suspended via the slide guide 73*e*. The outer gripping piece blocks 75 are connected to each other on one end side to form a substantially U shape and the inner gripping piece block 76 is arranged inside the U shape in the outer gripping piece blocks 75. A tip of the piston rod 77*a* of the gripping piece cylinder 77 is connected to one end portion corresponding to the bottom side of the U shape of the outer gripping piece blocks 75, and an end of the piston rod 78*a* of the gripping piece cylinder 78 is connected to the end portion of the inner gripping piece block 76 corresponding to the tip side of the U shape of the outer gripping piece blocks 75.

On the lower surfaces of the Outer gripping piece block 75 and the inner gripping piece block 76, a plurality of gripping pieces 81 and 82 are respectively provided downward in a protruding manner at predetermined intervals (for example, the length about the thickness of the loader shelf 14) in the longitudinal direction of the gripping piece block. The gripping pieces 81 and 82 are provided so as to be associated with each veneer sheet W1 (in FIG. 10A, a case where ten gripping pieces 81 in all (five on each side) and five gripping pieces 82 are provided is illustrated). The gripping piece 81 is, for example, formed of a resin that can be bent and deformed, and the gripping piece 82 is, for example, formed of a flat spring made of steel. Nonslip portions 81*a* and 82*a* are respectively formed in the tip portions of the gripping pieces 81 and 82 by, for example, rubber adhesion.

Figure 10A:
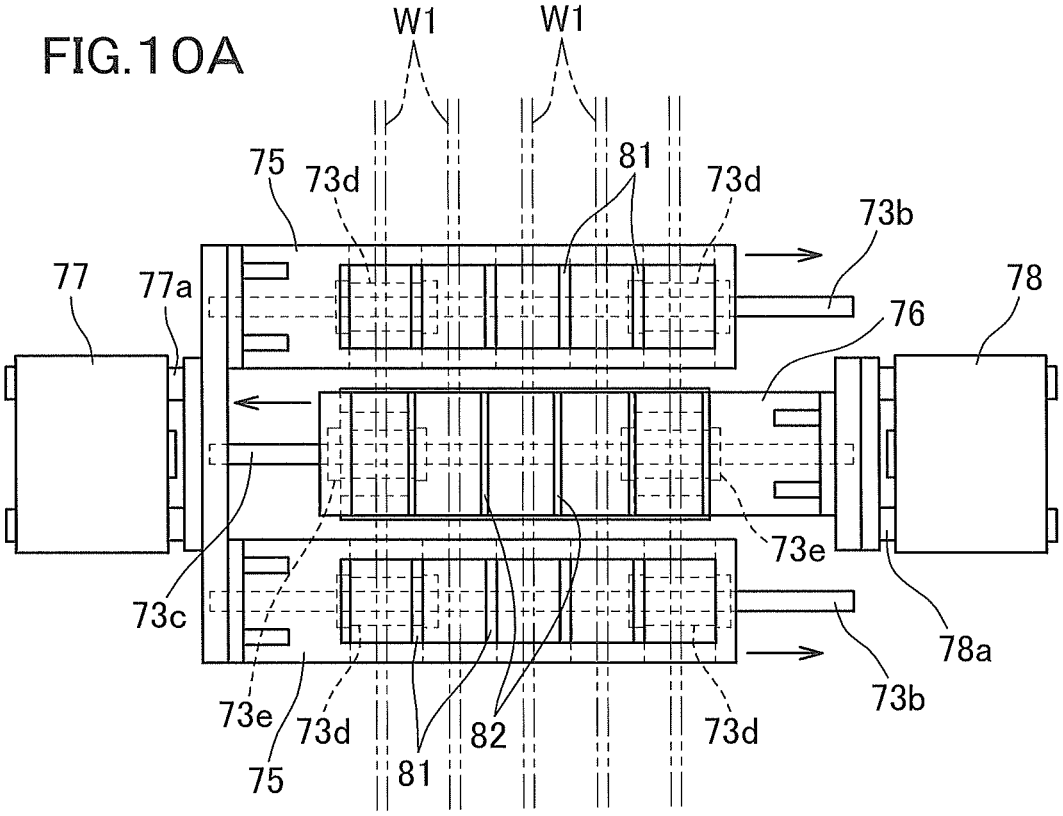
FIG. 10A is a bottom view of FIG. 8.

Along with the drive of the gripping piece cylinders 77 and 78, the outer gripping piece block 75 and the inner gripping piece block 76 approach and leave each other. Then, when the gripping member 73 approaches the veneer sheet W1 held in the standing state by the loader shelf 14, in a state where the outer gripping piece block 75 and the inner gripping piece block 76 are separated as shown in FIG. 10A, the gripping pieces 81 and 82 are allowed to freely enter and exit between the respective veneer sheets W1.

Figure 10B:
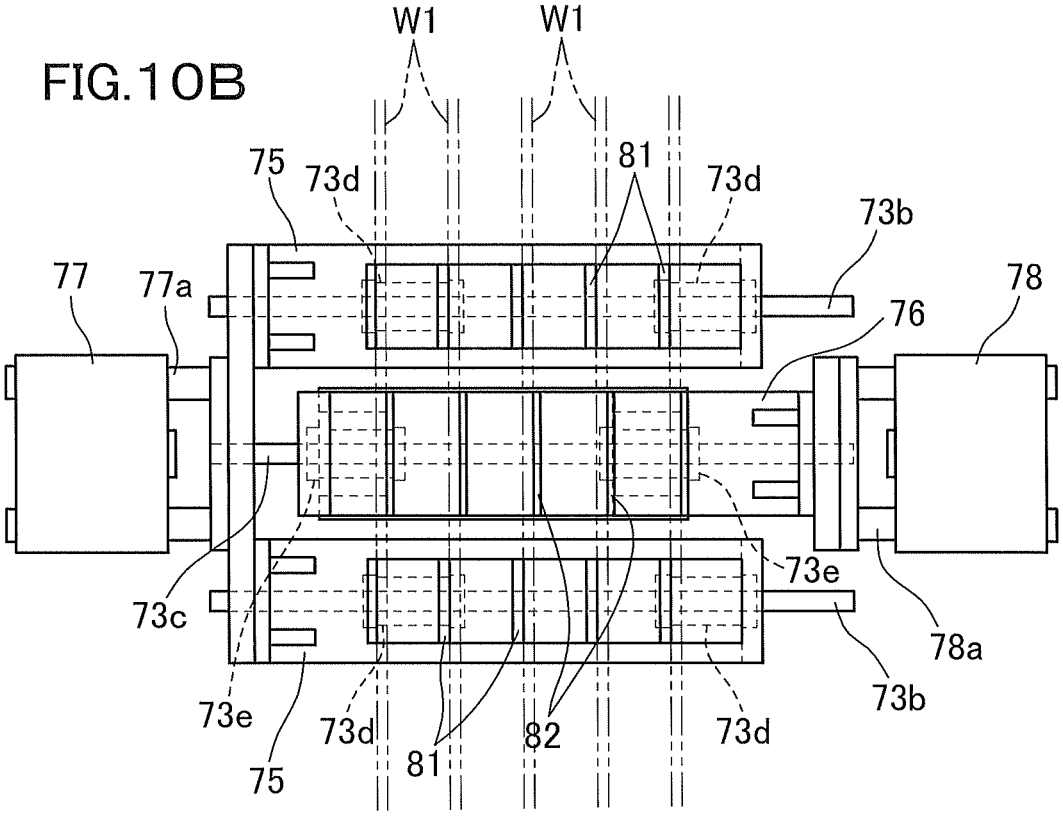
FIG. 10B is an operation state diagram of FIG. 10A.

When the gripping piece cylinders 77 and 78 are driven with the gripping pieces 81 and 82 entering between the respective veneer sheets W1, as shown, in FIG. 10B, the outer gripping piece block 75 and the inner gripping piece block 76 approach each other, and each veneer sheet W1 is gripped in the upper position by the sandwiching operation between the pair of gripping pieces 81 approximately side-by-side in the left-right direction and the gripping piece 82 in the middle. It should be noted that not only in the mode of driving both of the gripping piece cylinders 77 and 78 but also in the configuration in which only one of the gripping piece cylinders 77 and 78 is driven, it is possible to grip or release the veneer sheet W1 in the same manner as described above.

Then, with the upper part of the veneer sheet W1 gripped by the gripping member 73 and the lower part of the veneer sheet W1 supported by the belt conveyor 150 (roller 15*a*), the gripping member 73 and the loader unit conveyor 15 of the loader unit gripping body 70A are configured to move in synchronization with the upper and lower parts.

In the first example, the loader device 10 corresponds to a first treatment device, the loader unit gripping body 70A corresponds to an upper part gripping body, and the loader unit conveyor 15 corresponds to a first conveyance body. In addition, the loader unit gripping body 70A and the loader unit conveyor 15 correspond to an upstream side conveyance body.

Figure 11:
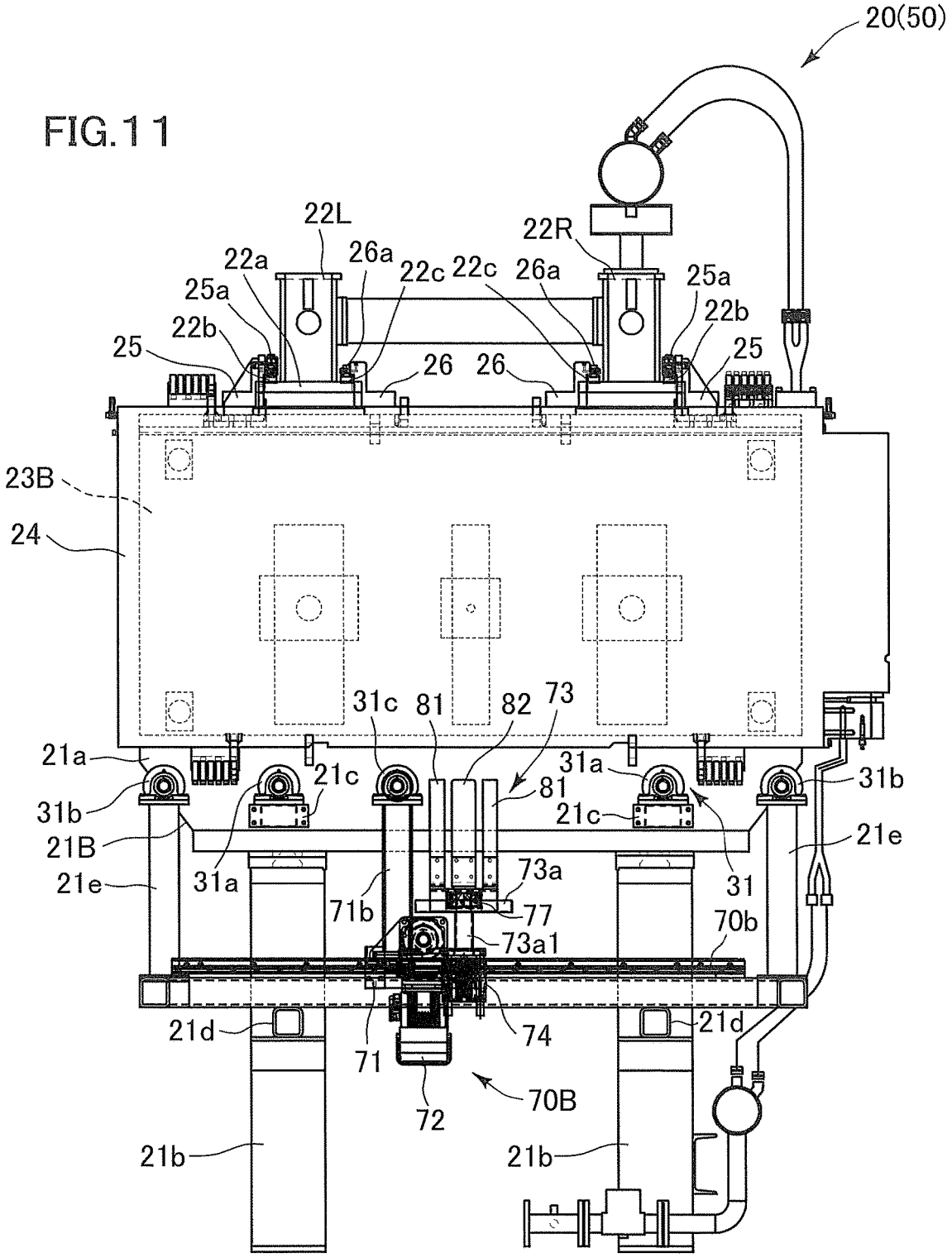
FIG. 11 is an enlarged front view of the hot press device shown in FIG. 2.
Figure 12:
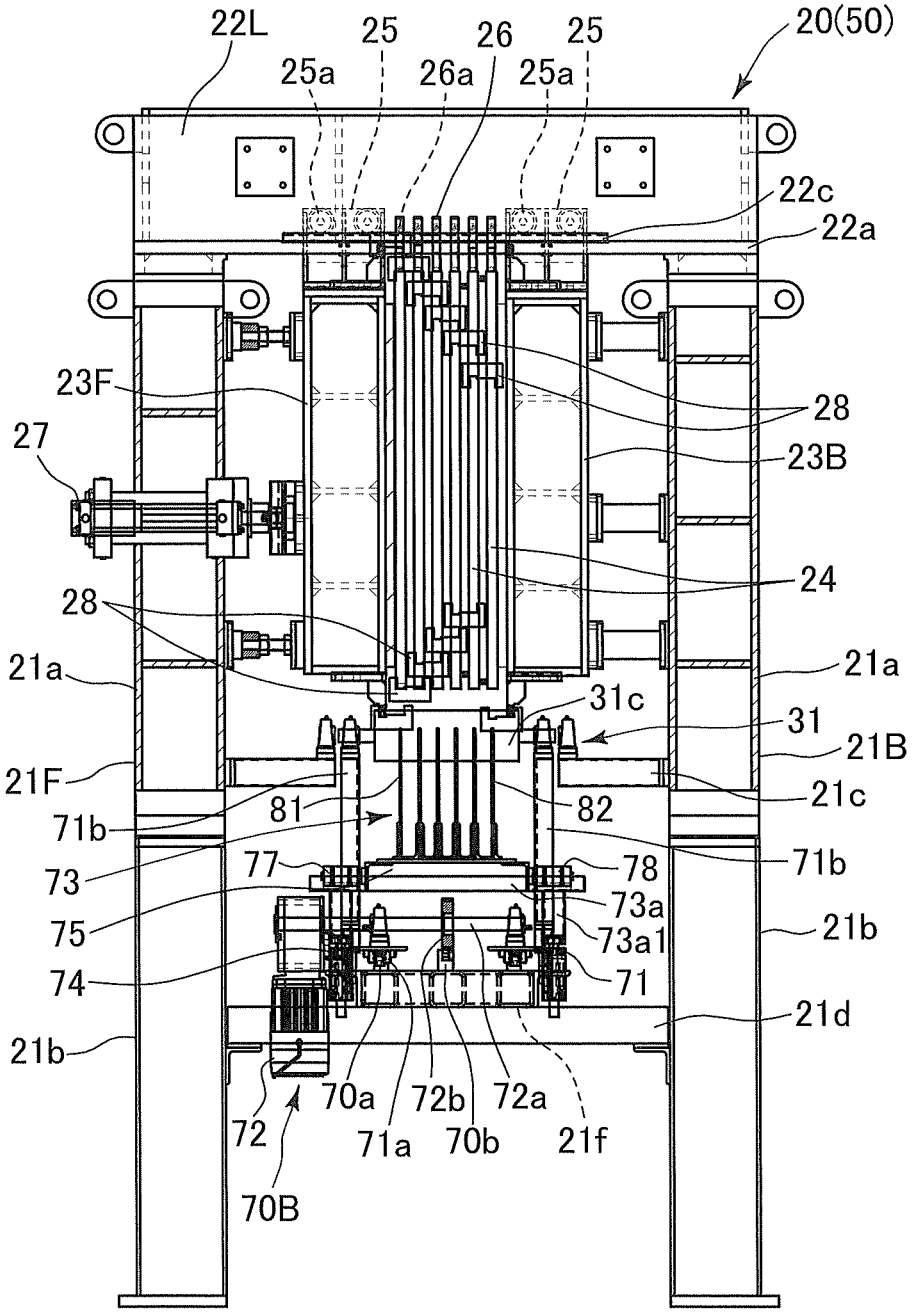
FIG. 12 is a side view of FIG. 11.
Figure 28:
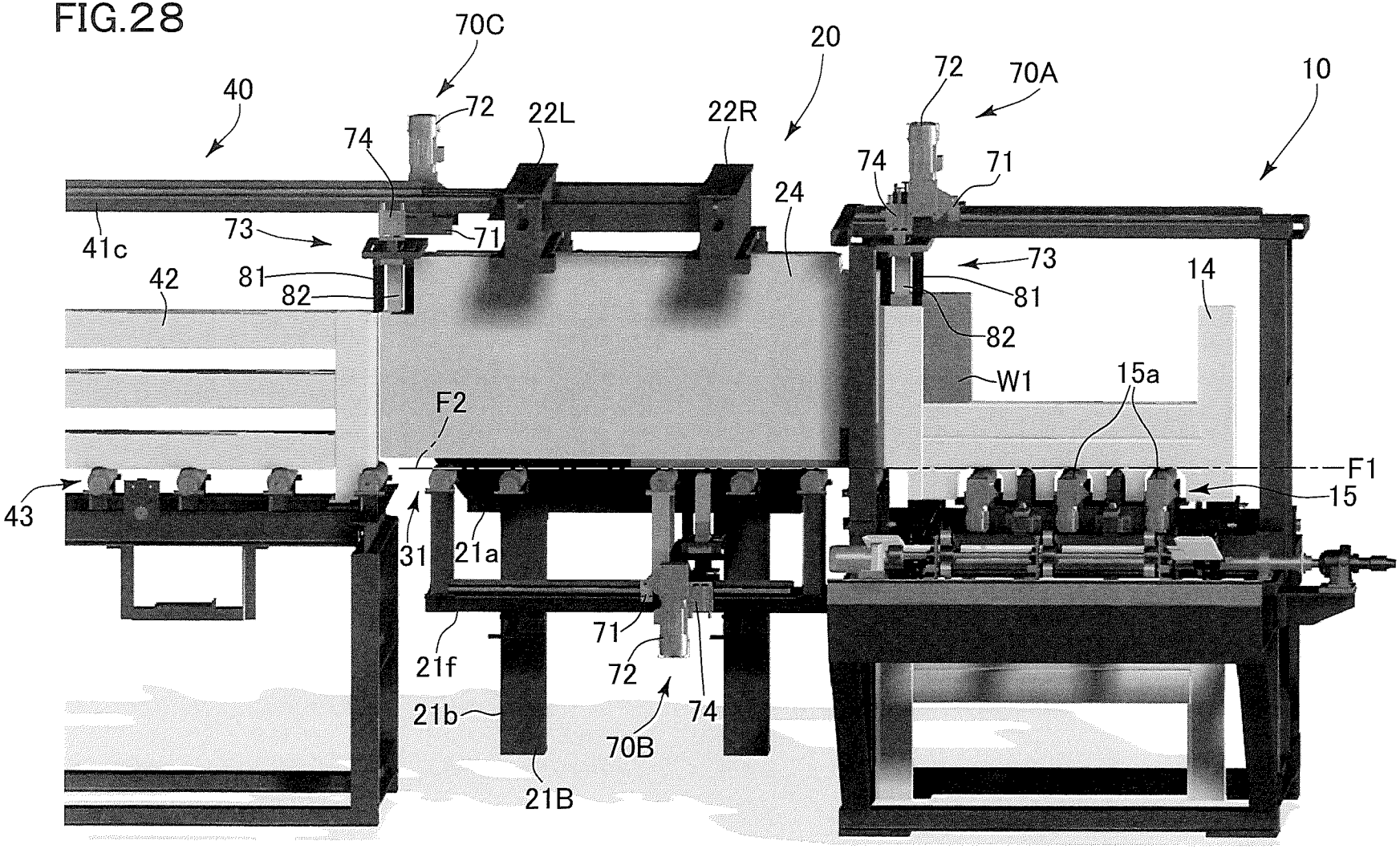

Next, the hot press device 20 will be described. As shown in FIGS. 11, 12, 28, and the like, the hot press device 20 includes base frames 21F and 21B erected as a pair in the front-back direction, and a pair of beams 22L and 22R in the left-right direction built at the upper ends of the base frames 21F and 21B. Each of the base frames 21F and 21B includes a rectangular main body wall portion 21*a* and a pair of leg portions 21*b*. Between the main body wall portions 21*a*, a pair of pressing plates 23F and 23B in the front-back direction, and multistage hot plates 24 between the pressing plates 23F and 23B are arranged. It should be, noted that in FIGS. 11, 28, and the like, some members constituting the hot press device 20 such as the base frame 21F and the pressing plate 23F are omitted.

At the lower end of each of the beams 22L and 22R, a flange portion 22*a* is formed so as to horizontally protrude in the left-right direction, and rails 22*b* and 22C are respectively laid on the outer side and inner side upper surfaces of the flange portion 22*a*. The pressing-plates 23F and 23B are suspended and supported by the outer rail 22*b* via the bracket 25 including the support roller 25*a*, and each hot plate 24 is suspended and supported by the inner rail 22*c* via the bracket 26 including the support roller 26*a*.

A plurality of press cylinders 27 (for example, hydraulic cylinders; three press cylinders are illustrated in FIG. 11) are inserted at predetermined intervals in the left-right direction in the central part of the main body wall portion 21*a* of the base frame 21F and the tip of the ram 27*a* is attached to the pressing plate 23F. It should be noted that in the first example, the back side pressing plate 23B is configured to be fixed to the main body wall portion 21*a* of the base frame 21B, and only the front side pressing plate 23F is configured to move in accordance with the expansion and contraction operation of the press cylinder 27.

Figure 13A:
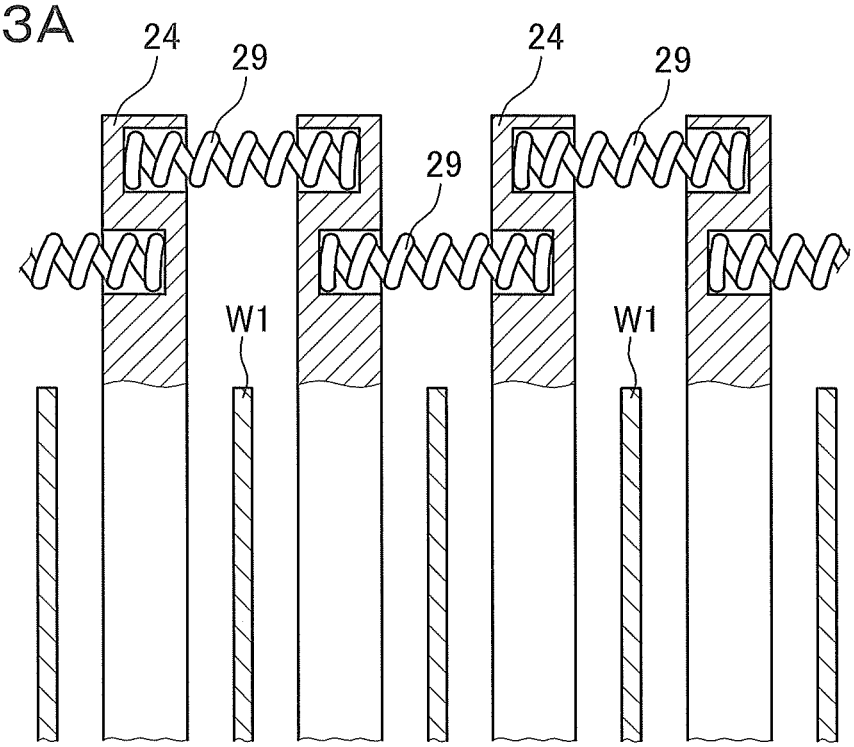
FIG. 13A is an enlarged side view when the hot plate in FIG. 12 is in an open state in a configuration using a spring member.
Figure 13B:
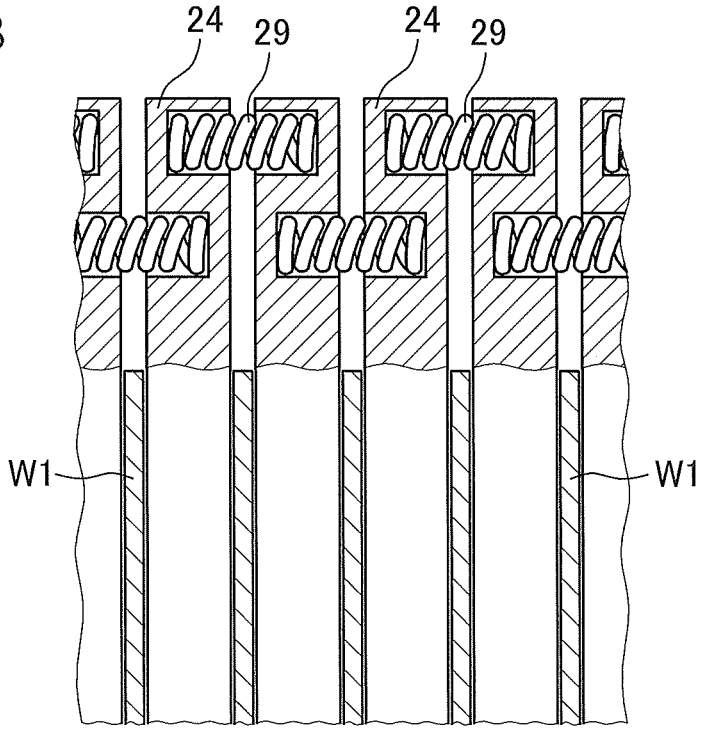
FIG. 13B is an enlarged side view when the hot plate in FIG. 13A is in a closed state.

Between adjacent hot plates 24 and between the hot plates 24 at the front and back ends and the pressing plates 23F and 23B, a space regulating member 28 for preventing the spreading not less than a predetermined interval during the press opening is interposed (see FIG. 12; specifically, see Japanese Patent No. 4781168, JP S60-259402 A, and the like). In addition, as shown in FIGS. 13A and 13B, between adjacent hot plates 24, a spring member 29 is interposed so that adjacent hot plates 24 approach each Other by approximately the same distance during the press closing by the pressing plates 23F and 23B, and the distance between adjacent hot plates 24 is kept approximately the same while being changed.

The spring member 29 interposed between the adjacent hot plates 24 allows simultaneous pressing on the veneer sheets W1 (closing each veneer sheet W1 simultaneously by pressing the pressing plates 23F and 23B) to be performed, prevents the breakage due to pressure concentration on a specific veneer sheet W1, and allows the thickness of each veneer sheet W1 to be satisfactorily made uniform.

Figure 13C:
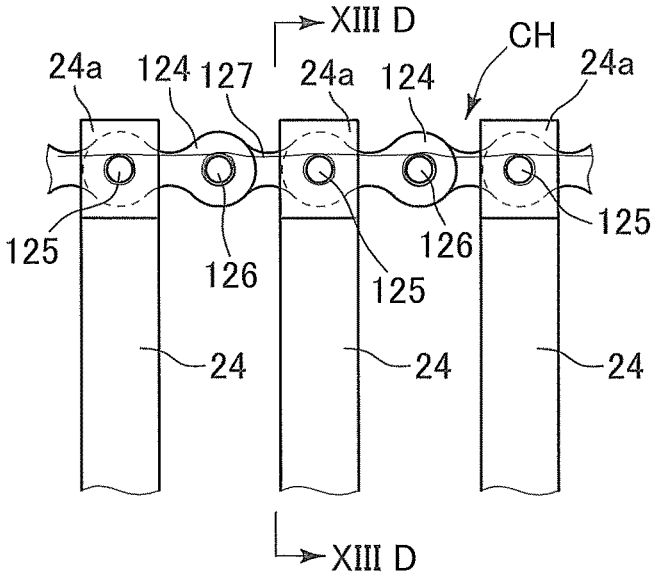
FIG. 13C is an enlarged side view when the hot plate in FIG. 12 is in an open state in a configuration using a link.
Figure 13D:
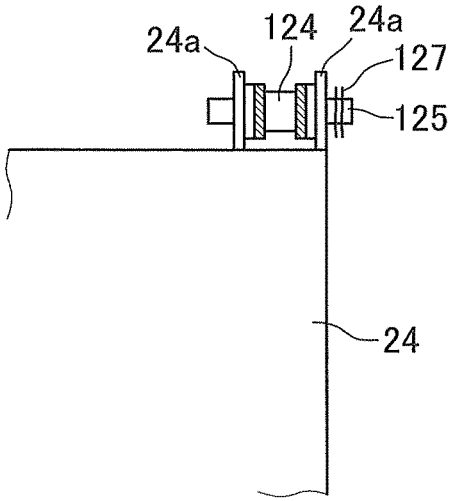
FIG. 13D is a cross-sectional view taken along the line XIIID-XIIID in FIG. 13C.
Figure 13E:
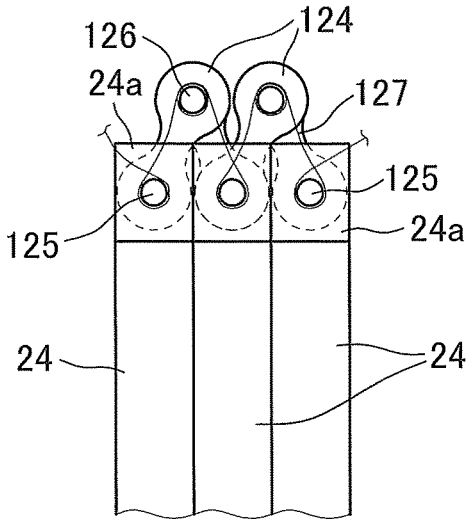
FIG. 13E is an enlarged side view when the hot plate in FIG. 13C is in a closed state.

In addition, instead of the coiled spring member 29, it is also possible to adopt a configuration using a chain CH as shown in FIGS. 13C to 13E, for example. In this configuration, a pair of bearings 24*a* is mounted to both sides of the upper part of the hot plate 24 so as to protrude upward at predetermined intervals, and one end portion of a pair of links 124 is interposed between the bearings 24*a* and is pivotally mounted by a fixing pin 125 inserted between the bearings 24*a*. The other end portion of the link 124 is connected by an intermediate pin 126 to the other end portion of the link pivotally mounted at one end to the adjacent hot plate 24, and each hot plate 24 is connected by a chain CH including a pair of links 124 as a unit body.

From the beginning to the end of this chain CH, a linear spring 127 is wound around a pivotally mounting portion by the fixing pin 125 of each link 124 as a unit body and a connecting portion by the intermediate pin 126, and the connecting portion of each link 124 by the intermediate pin 126 is configured to protrude outward (upward) by substantially the same amount when the front and back hot plates 24 are contracted and closed (see FIG. 13E). When the front and back hot plates 24 expand from this state, the connection portion of each link 124 by the intermediate pin 126 descends by substantially the same amount toward the inside (downward), the angle with the intermediate pin 126 as an apex in the triangle formed by the intermediate pin 126 and one end portion of each link 124 changes from an acute angle to an obtuse angle, and each link 124 is configured to be substantially linear when the free end of the space regulating member 28 is locked to the bracket to reach the press opening (see FIG. 13C). Even when this chain CH is used, simultaneous pressing on each veneer sheet W1 becomes possible, breakage due to pressure concentration on a specific veneer sheet W1 can be prevented, the thickness of each veneer sheet W1 can be made well uniform.

Below the hot plate 24, a hot press unit roller conveyor 31 for supporting the veneer sheet W1 in a standing state from the lower side, capable of carrying in the veneer sheet W1 from the loader device 10 to the hot press device 20, and furthermore, from the hot press device 20 toward the open transpiration device 40 is arranged. The hot press unit roller conveyor 31 includes a plurality of rollers 31*a* to 31*c* having a roller length over all the veneer sheets W1 between the hot plates 24 in order to carry in the veneer sheet W1 (in FIG. 11, a total of 5 rollers are illustrated).

Figure 30:
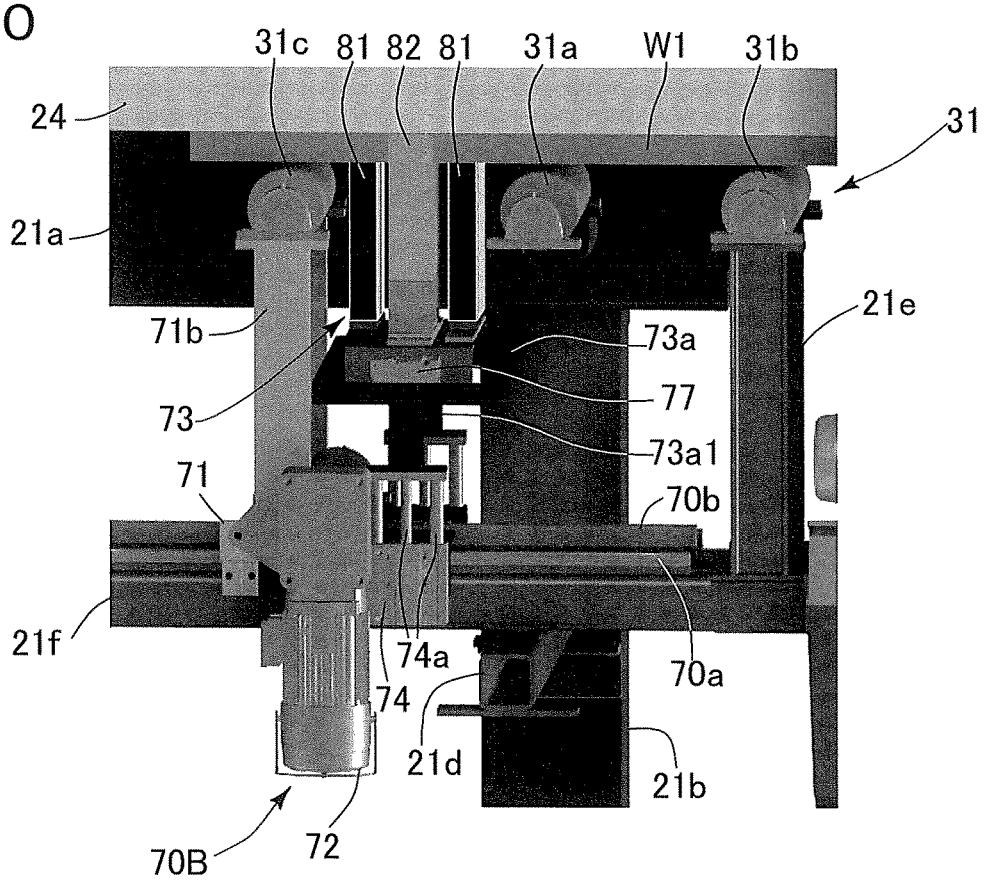

It should be noted that in a state where the veneer sheet W1 is supported by the rollers 31*a* to 31*c* of the hot press unit roller conveyor 31, the lower part of the veneer sheet W1 protrudes from the lower end of the hot plate 24 in a suspended state (see FIGS. 28 and 30). The protruding portion of the veneer sheet W1 is a portion to be gripped by the gripping pieces 81 and 82 of the gripping member 73 of the hot press unit gripping body 70B described below. Then, since the protruding portion of the veneer sheet W1 cannot be pressurized and heated by the hot plate 24, the protruding portion is finally cut off.

The rollers 31*a* to 31*c* are arranged at the same height position so as to form a horizontal conveyance surface F1, and the rollers 31*b*, 31*a*, 31*c*, 31*a*, and 31*b* are arranged in this order from the left to the right. Of the rollers 31*a* to 31*c*, the rollers 31*a* and 31*b* are of a fixed type, while the roller 31*c* is configured to be able to reciprocate along the conveying direction between the rollers 31*a* adjacent in the left-right direction.

Specifically, the roller 31*a* is supported on both main body wall portions 21*a* of the base frames 21F and 21B by bearings fixed to the upper surface of the frame-shaped bracket 21*c*. In addition, beams 21*d* are respectively built on the opposing leg portions 21*b* on the left side and the opposing leg portions 21*b* on the right side of the base frames 21F and 21B, and a long plate-shaped bracket 21*e* is erected on the upper surface of each beam 21*d*. The roller 31*b* is supported by a bearing fixed to the upper end of the bracket 21*e*. The roller 31*c* will be described below.

Below the hot press unit roller conveyor 31, a hot press unit gripping body 70B is provided. Three beams 21*f* extend in the left-right direction on the upper surfaces of the beams 21*d* arranged on the left and right sides. The hot press unit gripping body 70B is configured in the same manner as the loader unit gripping body 70A. Therefore, in the following description, in the hot press unit gripping body 70B shown in FIGS. 11, 12, 20, and the like, the same reference numerals are denoted to the members performing the same functions as the members constituting the loader unit gripping body 70A and the description will be omitted, and differences from the loader unit gripping body 70A will be mainly described.

The loader unit gripping body 70A and the hot press unit gripping body 70B are different in that: due to the difference in the basic structure that the loader unit gripping body 70A is configured to be capable of gripping the upper part of the veneer sheet W1, whereas the hot press unit gripping body 70B is configured to be capable of gripping the lower part of the veneer sheet W1; in the loader unit gripping body 70A, the slide guide 73*d* of the gripping member 73 is suspended on the guide rail 73*b*, whereas in the hot press unit gripping body 70B, the slide guide 73*d* of the gripping member 73 is placed on the guide rail 73*b*; and the loader unit gripping body 70A is configured not to include rollers contributing to the conveyance of the veneer sheet W1, whereas the hot press unit gripping body 70B is configured to include the roller 31*c* contributing to the conveyance of the veneer sheet W1.

The roller 31*c* is integrally attached to the traveling body 71 via a long plate-shaped linkage bracket 71*b*. That is, along with the traveling body 71 moving left and right along the guide rail 70*a*, the traveling body 71 and the roller 31*c* synchronously move in the conveying direction (left direction) while holding the veneer sheet W1 gripped by the gripping member 73 integrally at predetermined intervals. Thus, the roller 31*c* is not a fixed type unlike the rollers 31*a* and 31*b*, but functions in the same manner as the rollers 31*a* and 31*b* in that the lower end surface of the veneer sheet W1 is supported from the lower side, and greatly contributes to stably carrying in the veneer sheet W1.

It should be noted that in the first example, no driving means for driving the roller 31*c* is provided, but a driving means for the roller 31*c* may be provided and the roller 31*c* may be configured to be driven. Moreover, in addition to or in place of providing the mechanism including the roller 31*c* and the linkage bracket 71*b* on the left side (forward moving side) of the gripping member 73, for example, a mechanism having a similar configuration may be provided on the right side (backward moving aide) of the conveyance member 73.

In the first example, the hot press device 20 corresponds to a second treatment device, the hot press unit gripping body 70B corresponds to a lower part gripping body, and the hot press unit roller conveyor 31 corresponds to a second conveyance body. In addition, the hot press unit gripping body 70B and the hot press unit roller conveyor 31 correspond to a downstream side conveyance body. Furthermore, the traveling body 71, the linkage bracket 71*b*, and the like of the hot press unit gripping body 70B correspond to a linkage mechanism, and the roller 31*c* of the hot press unit roller conveyor 31 corresponds to an auxiliary conveyance body.

Next, the open transpiration device 40 will be described. As shown in FIGS. 2, 3, 36, 39, and the like, the open transpiration device 40 includes a frame 41. It should be noted that in FIG. 36, 39, and the like, a part of members of the open transpiration device 40 is omitted. The frame 41 includes a pair of beams 41*a* extended in the front-back direction and a pair of beams 41*b* extended in the left-right direction. On the upper part of the beam 41*a*, a plurality of open shelves 42 are erected in a standing state at the same intervals as those between the hot plates 24 during the opening in the hot press device 20. The plurality of veneer sheets W1 are accommodated between the open shelves 42 one by one, and water vapor can be evaporated from both surfaces in a standing state.

In the upper part of the beam 41*b*, an open transpiration unit roller conveyor 43 for supporting the veneer sheet W1 in a standing state from the lower side, capable of carrying in the veneer sheet W1 from the hot press device 20 to the open transpiration device 40, and furthermore, from the open transpiration device 40 toward the temperature control press device 50 is arranged. The open transpiration unit roller conveyor 43 includes a plurality of rollers 43*a* having a roller length over all the veneer sheets W1 between the open shelves 42. The open transpiration unit roller conveyor 43 has a conveyance surface F2 at the same height as the hot press unit roller conveyor 31.

Each veneer sheet W1 is prevented from falling down due to contact with the corresponding open shelf 42, and each lower end thereof is supported so as to be conveyable by a roller 43*a*, and is held in a standing state in the open shelf 42. It should be noted that in the open transpiration device 40, since each veneer sheet W1 only has to be held for only a certain period of time, unlike the loader unit conveyor 15, the open transpiration unit roller conveyor 43 is not configured to be capable of going up and down.

An open transpiration unit gripping body 70C is provided above the open shelf 42. While being supported by the three beams 41*c* extended to the left and right over the beam 22L of the hot press device 20 and the beam 22R of the temperature control press device 50, the open transpiration unit gripping body 70C is movable along these beams 41*c*. The open transpiration unit gripping body 70C is configured in the same manner as the loader unit gripping body 70A.

However, as described above, since the open transpiration unit roller conveyor 43 is not configured to be movable up and down, the gripping member elevating cylinder 74 of the open transpiration unit gripping body 70C is not driven, and only the traveling body motor 72 of the open transpiration unit gripping body 70C, is driven. That is, the open transpiration unit gripping body 70C moves only in the left-right direction along the beam 41*c*. Since the other configuration is the same as that of the loader unit gripping body 70A, in the open transpiration unit gripping body 70C shown in FIGS. 2, 36, 39, and the like, the same reference numerals are denoted to the members performing the same functions as the members constituting the loader unit gripping body 70A, and the description thereof is omitted.

In the first example, the open transpiration device 40 corresponds to a first treatment device, the open transpiration unit gripping body 70C corresponds to an upper part gripping body, and the open transpiration unit roller conveyor 43 corresponds to a first conveyance body. In addition, the open transpiration unit gripping body 70C and the open transpiration unit roller conveyor 43 correspond to the upstream side conveyance body.

The temperature control press device 50 is configured in the same manner as the hot press device 20. Therefore, in the temperature control press device 50 shown in FIGS. 2, 3, 42, and the like, the same reference numerals are denoted to the members performing the same functions as those of the hot press device 20, the description thereof is omitted, and differences from the hot press device 20 will be described. It should be noted that in FIG. 42 and the like, some members constituting the temperature control press device 50 are omitted.

Due to the difference in the basic structure that the hot press device 20 is configured to pressurize and heat the veneer sheet W1, whereas the temperature control press device 50 is configured to pressurize and temperature-control the veneer sheet W1, the hot plate 24 (first contact plate) of the hot press device 20 is configured to supply and discharge a heating medium such as high temperature steam or hot oil in order to contact-heat and dry the veneer sheet W1 and to maintain the temperature of the heating medium according to the type of the veneer sheet W1. In contrast, both are different in that the temperature control plate 54

(second contact plate) of the temperature control press device 50 is configured to control the veneer sheet W1 dried due to providing and discharging of a temperature control medium such as water, hot water, and hot oil, energization, or the like to a desired finished temperature (for example, a veneer sheet temperature is 25° C. to 35° C.).

The temperature control press device 50 includes a temperature control press unit roller conveyor 31 having a conveyance surface F2 at the same height as the open transpiration unit roller conveyor 43. Below the temperature control press unit roller conveyor 31, a temperature control press unit gripping body 70D is provided. The temperature control press unit gripping body 70D is configured in the same manner as the hot press unit gripping body 70B. Therefore, in the temperature control press unit gripping body 70D shown in FIGS. 2, 3, 42, and the like, the same reference numerals are denoted to the members performing the same functions as those of the members constituting the hot press unit gripping body 70B, and the description thereof is omitted.

In the first example, the temperature control press device 50 corresponds to a second treatment device, the temperature control press unit gripping body 70D corresponds to a lower part gripping body, and the temperature control press unit roller conveyor 31 corresponds to a second conveyance body. In addition, the temperature control press unit gripping body 70D and the temperature control press unit roller conveyor 31 correspond to a downstream side conveyance body. Furthermore, the traveling body 71, the linkage bracket 71*b*, and the like of the temperature control press unit gripping body 70D correspond to a linkage mechanism, and the roller 31*c* of the temperature control press unit roller conveyor 31 corresponds to an auxiliary conveyance body.

In addition, in the first example, the loader unit gripping body 70A, the loader unit conveyor 15, the hot press unit gripping body 70B, and the hot press unit roller conveyor 31 correspond to preceding conveyance devices, and the open transpiration unit gripping body 70C, the open transpiration unit roller conveyor 43, the temperature control press unit gripping body 70D, and the temperature control press unit roller conveyor 31 correspond to subsequent conveying devices.

Figure 48:
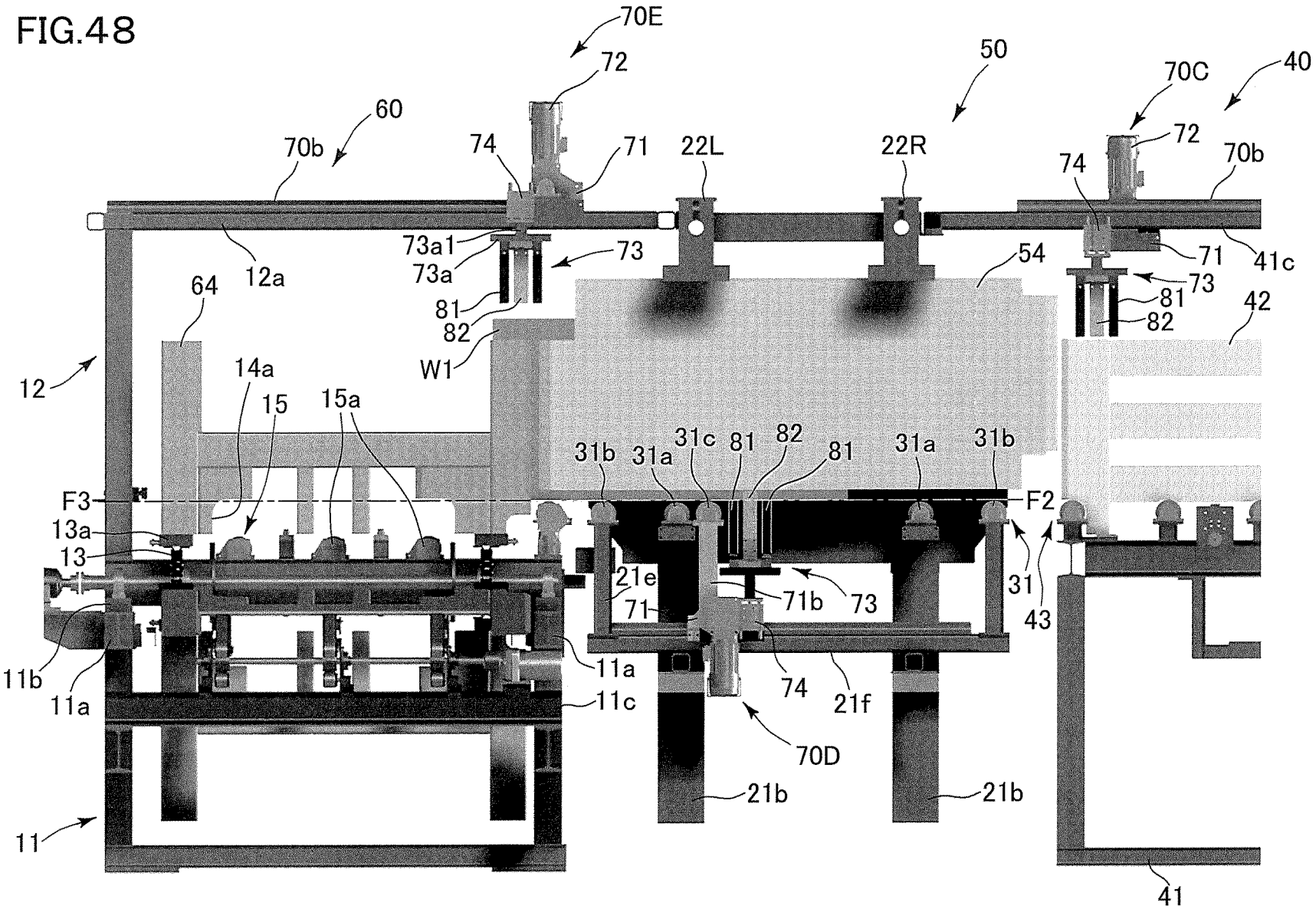
FIGS. 48 to 53 are 3D image explanatory diagrams corresponding to the contents of the fourth conveyance treatment in FIG. 21.
Figure 49:
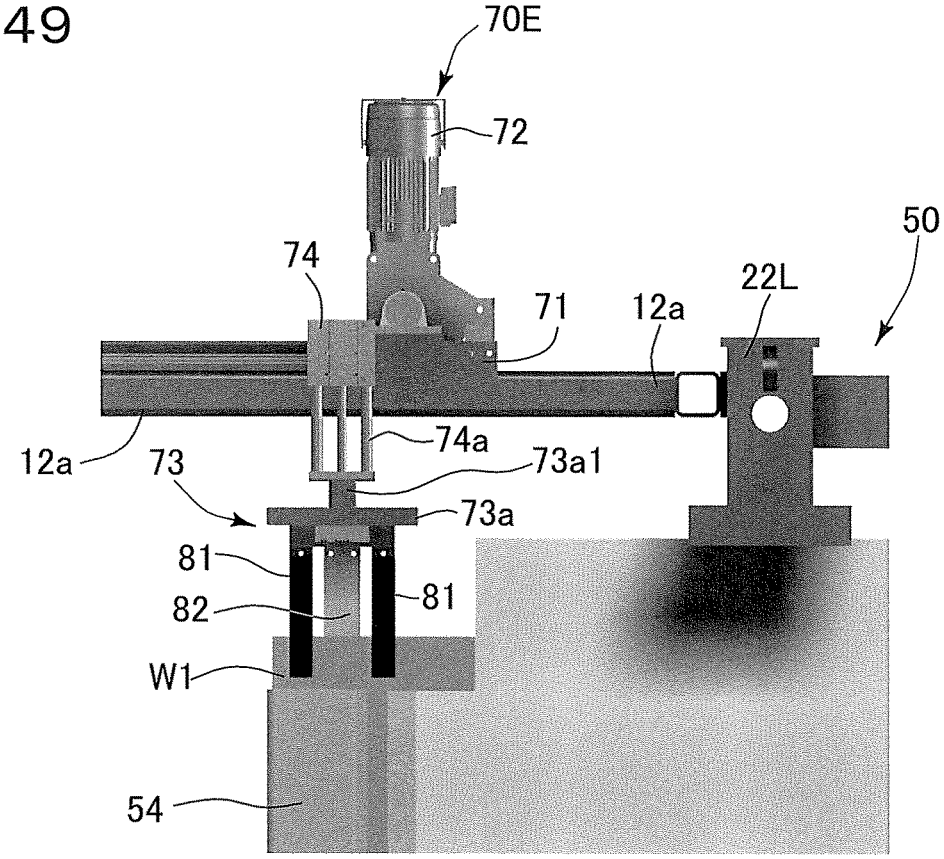
Figure 50:
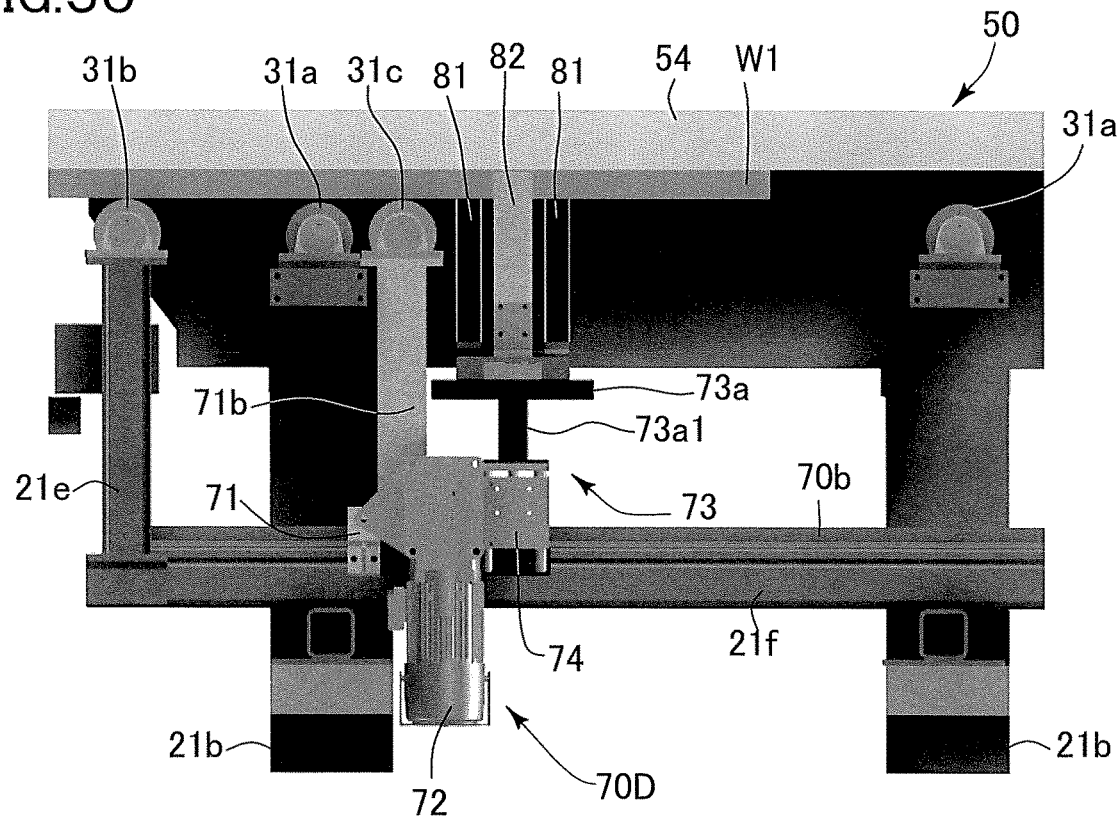

In addition, the unloader device 60 is configured in the same manner as the loader device 10 except that the unloader device 60 includes an unloader shelf 64 instead of the loader shelf 14. Therefore, in the unloader device 60 shown in FIGS. 2, 3, 48, and the like, the same reference numerals are denoted to the members performing the same functions as those of the members constituting the loader device 10, and the description thereof is omitted. It should be noted that in FIG. 48 and the like, some members constituting the unloader device 60 are omitted. The unloader device 60 corresponds to a third treatment device.

Next, the conveyance paths R1 to R4 of the first example will be described. As shown in FIGS. 2 and 3, the conveyance paths R1 to R4 are arranged in a straight line in a plan view. The conveyance path R1 is a path positioned over the loader device 10 and the hot press device 20, the path for carrying out a plurality of veneer sheets W1 set in a standing state by the loader device 10 while holding them in parallel along the conveying direction and for carrying the plurality of veneer sheets W1 into the press position of the hot press device 20 (predetermined position between the hot plates 24) with the plurality of veneer sheets W1 being in the standing state. The conveyance steps of the veneer sheet W1 in the conveyance path R1 are performed by the drive control of the loader unit gripping body 70A, the loader unit conveyor 15, the hot press unit gripping body 70B, and the hot press unit roller conveyor 31. The conveyance path R1 corresponds to a first conveyance path.

The conveyance path R2 is a path positioned over the hot press device 20 and the open transpiration device 40, the path for carrying out a plurality of veneer sheets W1 released from pressure due to the hot plate 24 from the press position of the hot press device 20 in a standing state and for carrying the plurality of veneer sheets W1 in a standing state into the open transpiration position (predetermined position between the open shelves 42) of the open transpiration device 40 while holding the plurality of veneer sheets W1 in parallel along the conveying direction. The conveyance steps of the veneer sheet W1 in the conveyance path R2 are performed by the drive control of the hot press unit gripping body 70B, the hot press unit roller conveyor 31, the open transpiration unit gripping body 70C, and the open transpiration unit roller conveyor 43. The conveyance path R2 corresponds to a second conveyance path.

The conveyance path R3 is a path positioned over the open transpiration device 40 and the temperature control press device 50, the path for carrying out a plurality of veneer sheets W1 from which water vapor is evaporated from the open transpiration position of the open transpiration device 40 in a standing state and for carrying the plurality of veneer sheets W1 in a standing state into the press position (predetermined position between the temperature control plates 54) of the temperature control press device 50 while holding the plurality of veneer sheets W1 in parallel along the conveying direction. The conveyance steps of the veneer sheet W1 in the conveyance path R3 are performed by the drive control of the open transpiration unit gripping body 70C, the open transpiration unit roller conveyor 43, the temperature control press unit gripping body 70D, and the temperature control press unit roller conveyor 31. The conveyance path R3 corresponds to a third conveyance path.

The conveyance path R4 is a path positioned over the temperature control press device 50 and the unloader device 60, the path for carrying out a plurality of veneer sheets W1 released from pressure due to the temperature control plate 54 from the press position of the temperature control press device 50 it a standing state and for carrying the plurality of veneer sheets W1 in a standing state into the unloader position (predetermined position between the unloader shelves 64) of the unloader device 60 while holding the plurality of veneer sheets W1 in parallel along the conveying direction. The conveyance steps of the veneer sheet W1 in the conveyance path R4 are performed by the drive control of the temperature control press unit gripping body 70D, the temperature control press unit roller conveyor 31, the unloader unit gripping body 70E, and the unloader unit roller conveyor 15. The conveyance path R4 corresponds to a fourth conveyance path.

Figure 14:
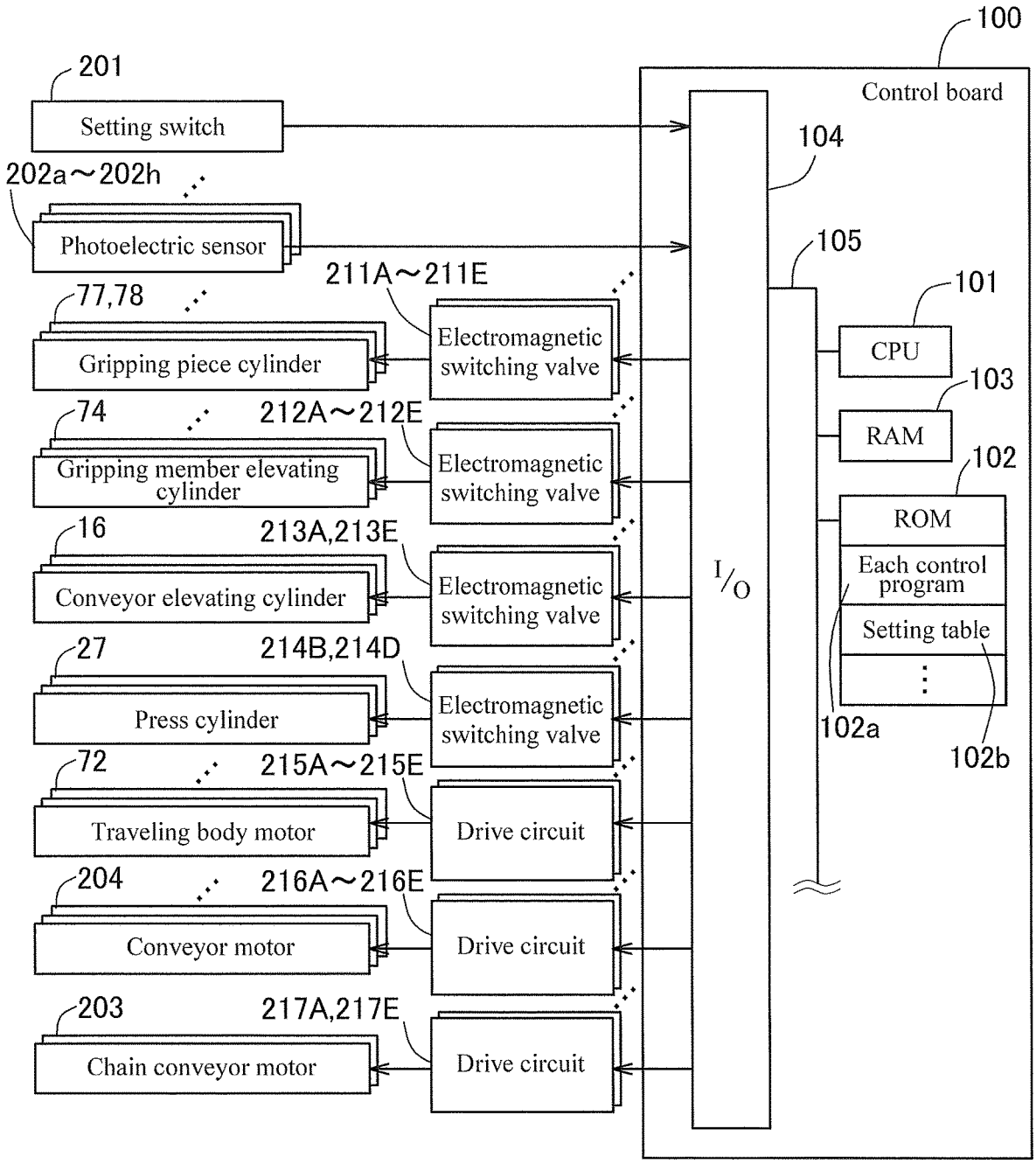
FIG. 14 is a block diagram showing the electrical configuration of the horizontal multistage press apparatus shown in FIG. 1.

Next, with reference to FIG. 14, the electrical configuration of the conveyance control of this example will be described. The control board 100 for functioning as a control unit of the horizontal multistage press apparatus 1 mainly includes a CPU 101 being an arithmetic device, a ROM 102 being read only memory device, a RAM 103 being a readable/writable main memory and used as a work area, and an input/output interface (I/O) 104. These devices are connected to each other by a bus 105 so as to be capable of mutual transmission and reception. The ROM 102 stores in advance a control program 102*a* for executing conveyance treatment, a setting table 102*b* for initially setting the size of a surface to be pressurized of the veneer sheet W1, and the like.

To the input/output interface 104, a setting switch 201 and a plurality of photoelectric sensors 202*a* to 202*h* are connected so as to function as input means. In addition, the gripping piece cylinders 77 and 78 via the electromagnetic switching valves 211A to 211E, the gripping member elevating cylinder 74 via the electromagnetic switching valves 212A to 212E, the traveling body motor 72 via the drive circuits 215A to 215E, and the conveyor motor 204 via the drive circuits 216A to 216E are connected to the input/output interface 104 for each device 10, 20, 40, 50, and 60 so as to function as output means.

In addition, the conveyor elevating cylinder 16 via the electromagnetic switching valves 213A and 213E, and the chain conveyor motor 203 via the drive circuits 217A and 217E are connected to the input/output interface 104 for each device 10 and 60 so as to function as output means. Furthermore, the press cylinder 27 is connected to the input/output interface 104 via the electromagnetic switching valves 214B and 214D for each of the devices 20 and 50 so as to function as an output means.

It should be noted that the electromagnetic switching valves 211A to 211E are normally switched to the grip releasing position. Therefore, each of the gripping piece cylinders 77 and 78 is normally in the contracted state, and the gripping pieces 81 and 82 of the gripping member 73 are in the expanded state (grip releasing state). When each of the electromagnetic switching valves 211A to 211E is switched to the gripping position, the corresponding gripping piece cylinders 77 and 78 are in an elongated state, and the gripping pieces 81 and 82 of the gripping member 73 are in a shrunk state (gripping state).

The setting switch 201 is an electrostatic type touch switch displayed on, for example, a push button or a touch panel, and is used when information on the veneer sheet W1 such as the number of sheets to be treated of the veneer sheet W1 and the size of the surface to be pressurized, the temperature setting of the temperature control plate 54, and the like are input into the control board 100. For setting the temperature of the temperature control plate 54, in the method of supplying and discharging the temperature control medium such as water hot water, hot oil, and the like into the temperature control plate 54, according to the outside air temperature during temperature control, water is adopted in the summer season, and hot water, hot oil, and the like are adopted in the winter season, and when the energization type temperature control plate 54 is used, a desired temperature is input. That is, when the veneer sheet W1 is accommodated in a standing state between the open shelves 42 and water vapor is evaporated from both surfaces thereof, in the winter, there are cases where the veneer sheet temperature (for example, the veneer sheet temperature is 0° C. to 10° C.) is lower than the desired finished temperature (for example, the veneer sheet temperature is 25° C. to 35° C.), and in this case, on the contrary, in the method of supplying and discharging the temperature control medium to raise the temperature of the veneer sheet W1, hot water, hot oil, and the like will be adopted.

The photoelectric sensor 202*a* detects that the loader unit gripping body 70A reaches the operation position (grip releasing position) in the loader device (that a part of the veneer sheet W1 is carried into between the hot plates 24). The photoelectric sensor 202*b* detects that the open transpiration unit gripping body 70C reaches the operation position (grip releasing position) in the open transpiration device 40 (that a part of the veneer sheet W1 is carried into between the temperature control plates 54). The photoelectric sensor 202*c* detects that the unloader unit gripping body 70E reaches the operation position (grip releasing position) in the unloader device 60 (that the veneer sheet W1 is carried into the unloader shelf 64).

The photoelectric sensor 202*d* detects that the veneer sheet W1 is held in the loader shelf 14. The photoelectric sensor 202*e* detects that the veneer sheet W1 is held in the hot press device 20. The photoelectric sensor 202*f* detects that the veneer sheet W1 is held in the open shelf 42. The photoelectric sensor 202*g* detects that the veneer sheet W1 is held in the temperature control press device 50. The photoelectric sensor 202*h* detects that the veneer sheet W1 is held in the unloader shelf 64. A plurality of photoelectric sensors 202*a* to 202*h* are prepared for each position where a corresponding one of the sensors is provided, and an optimum one is selected according to the size of the veneer sheet W1. It should be noted that not limited to a transmission non-contact type detector such as a photoelectric sensor, for example, a contact type or reflective type non-contact type detector may be used.

Next, a procedure for drying the veneer sheet W1 using the horizontal multistage press apparatus 1 having the above-described configuration will be described with reference the 3D image explanatory diagram schematically representing a main part of the horizontal multistage press apparatus 1 as shown in FIGS. 23 to 54. In this case, the control board 100 executes the program indicating the veneer sheet drying treatment as the main routine shown in the flowchart in FIG. 15. It should be noted that the flowchart in FIG. 15 corresponds to one of the respective control programs 102*a* stored in the ROM 102 of the control board 100.

Figure 15:
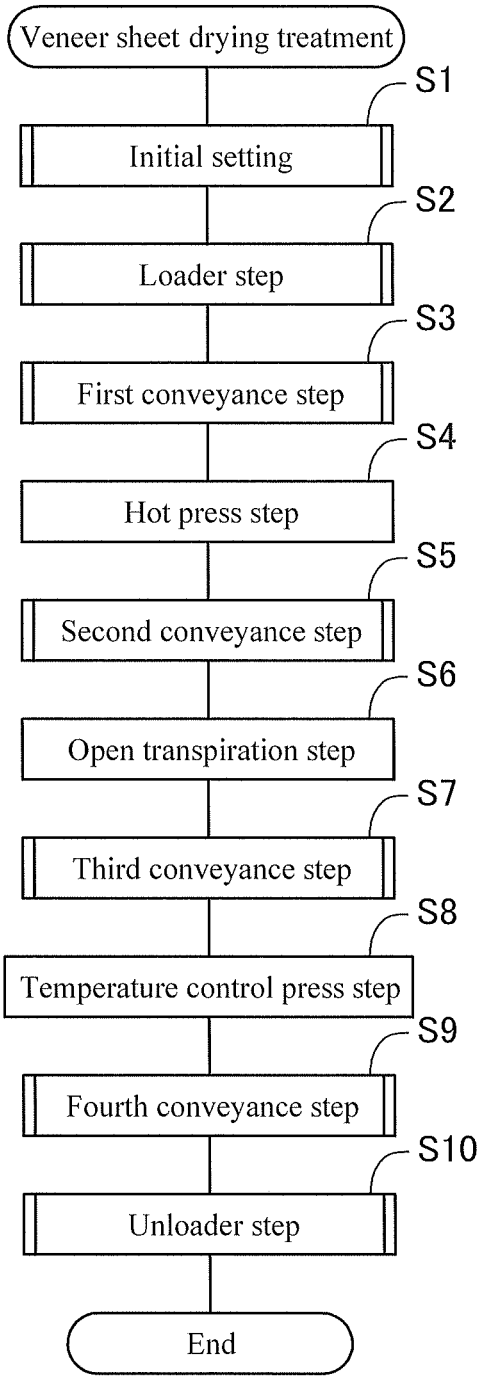
FIG. 15 is a flowchart showing veneer sheet drying treatment executed by the control board in FIG. 14.

In the veneer sheet drying treatment program in FIG. 15, the loader step S2, the hot press step S4, the open transpiration step S6, the temperature control press step S8, and the unloader step S10 respectively correspond to the flow of treatment in the loader device 10, the hot press device 20, the Open transpiration device 40, the temperature control press device 50, and the unloader device 60. Meanwhile, the first conveyance step S3, the second conveyance step S5, the third conveyance step S7, and the fourth conveyance step S9 respectively correspond to the flow of treatment in the conveyance paths R1 to R4.

Figure 16:
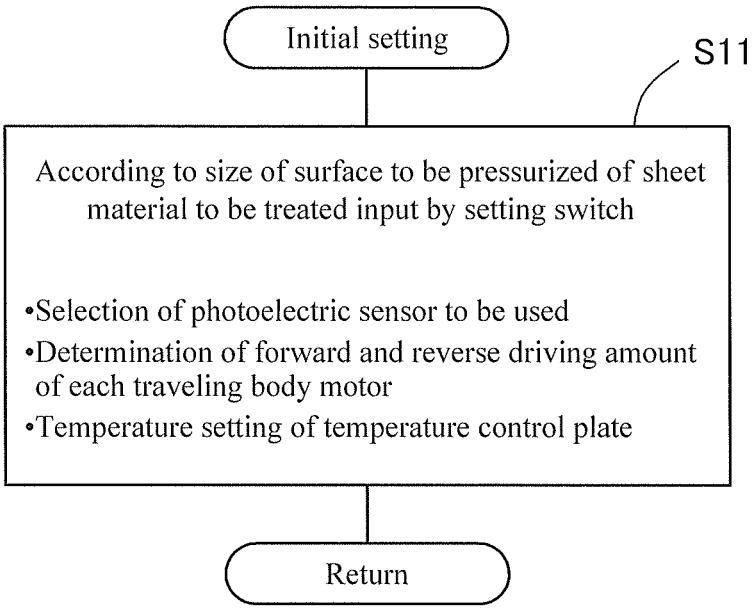
FIG. 16 is a flowchart showing the contents of the initial setting in step S1 in FIG. 15.
Figure 17:
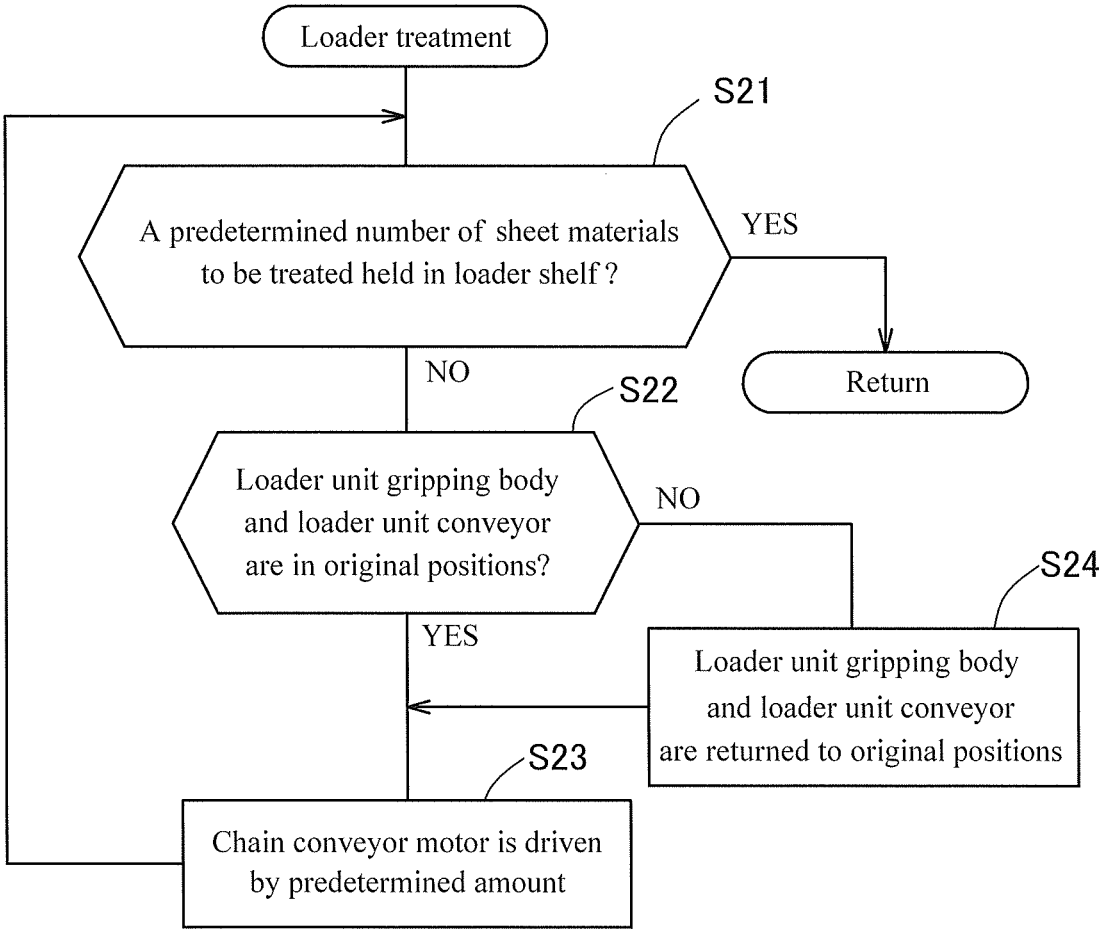
FIG. 17 is a flowchart showing the contents of the loader step in step S2 in FIG. 15.
Figure 21:
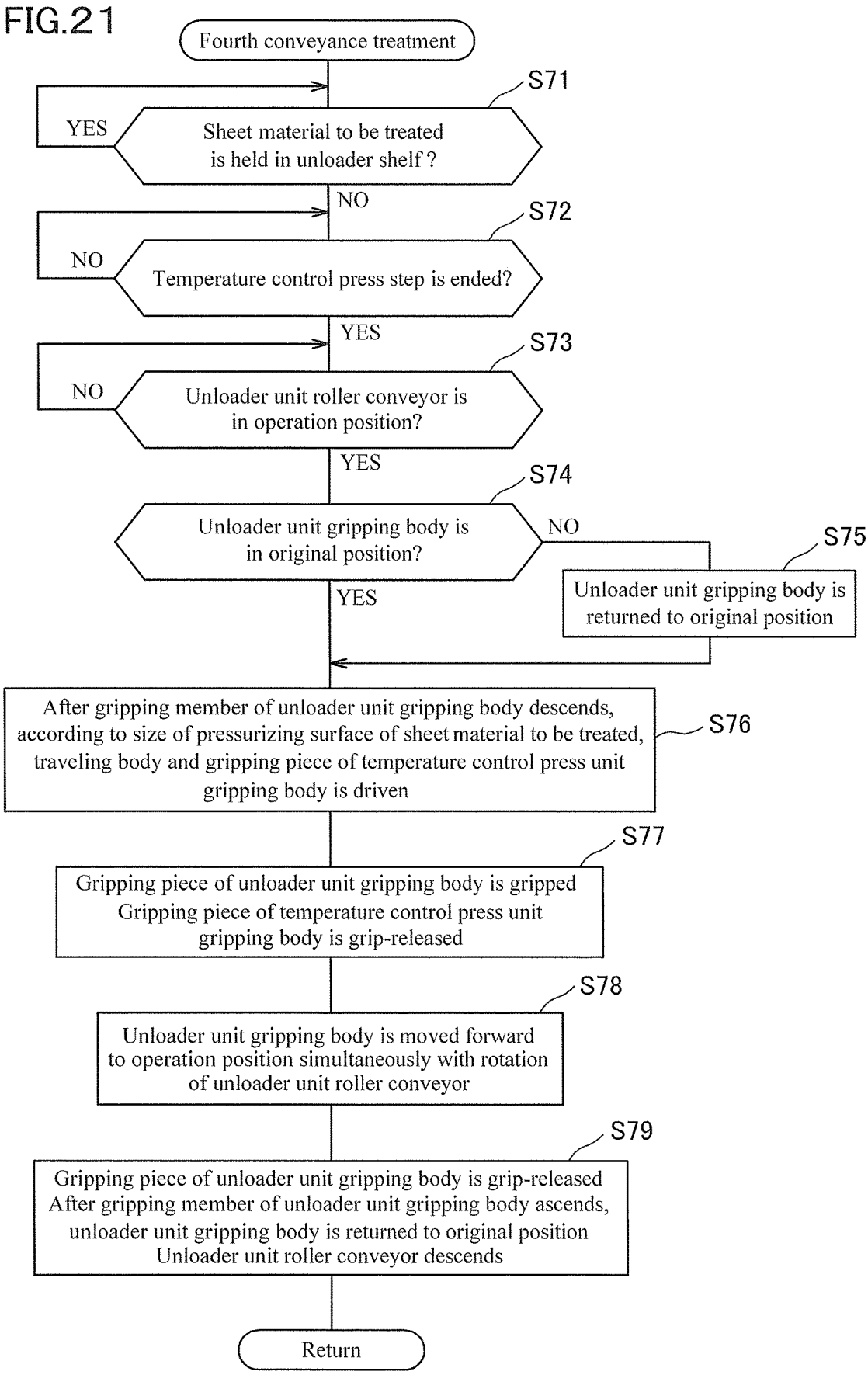
FIG. 21 is a flowchart showing the contents of a fourth conveyance step in step S9 in FIG. 15.
Figure 22:
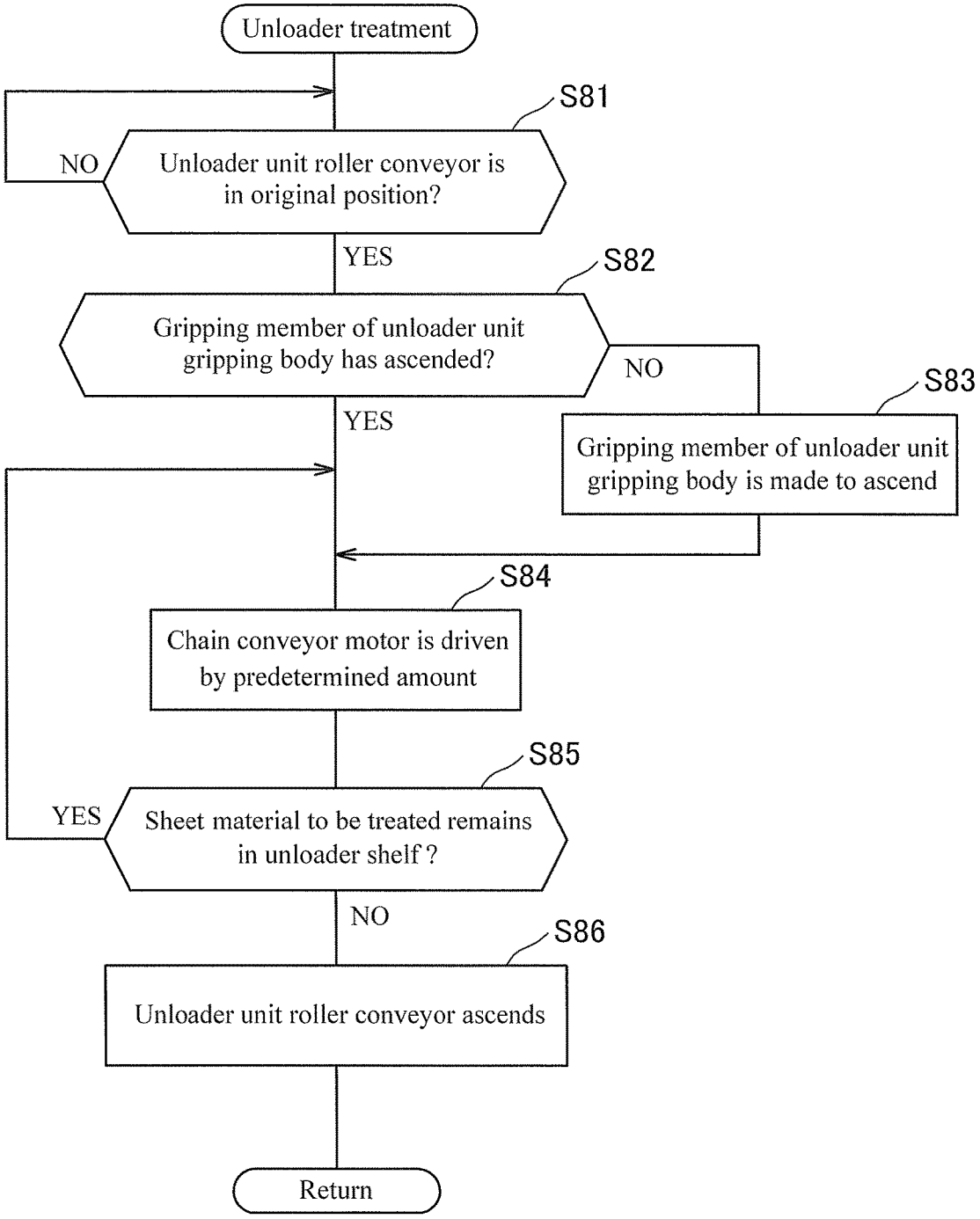
FIG. 22 is a flowchart showing the contents of an unloader step in step S10 in FIG. 15.
Figure 23:
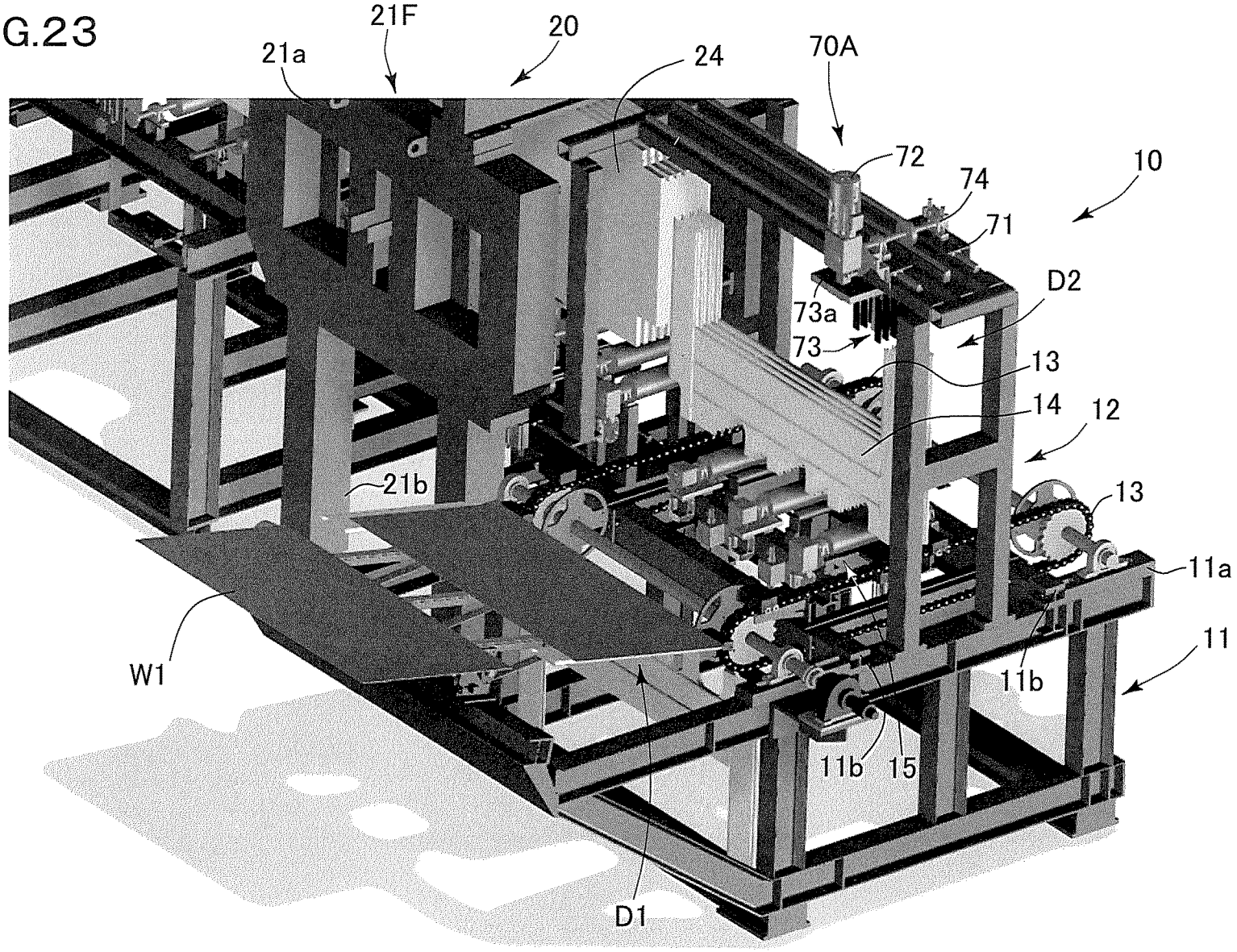
FIG. 23 is a 3D image explanatory diagram corresponding to the contents of the loader treatment in FIG. 17.
Figure 24:
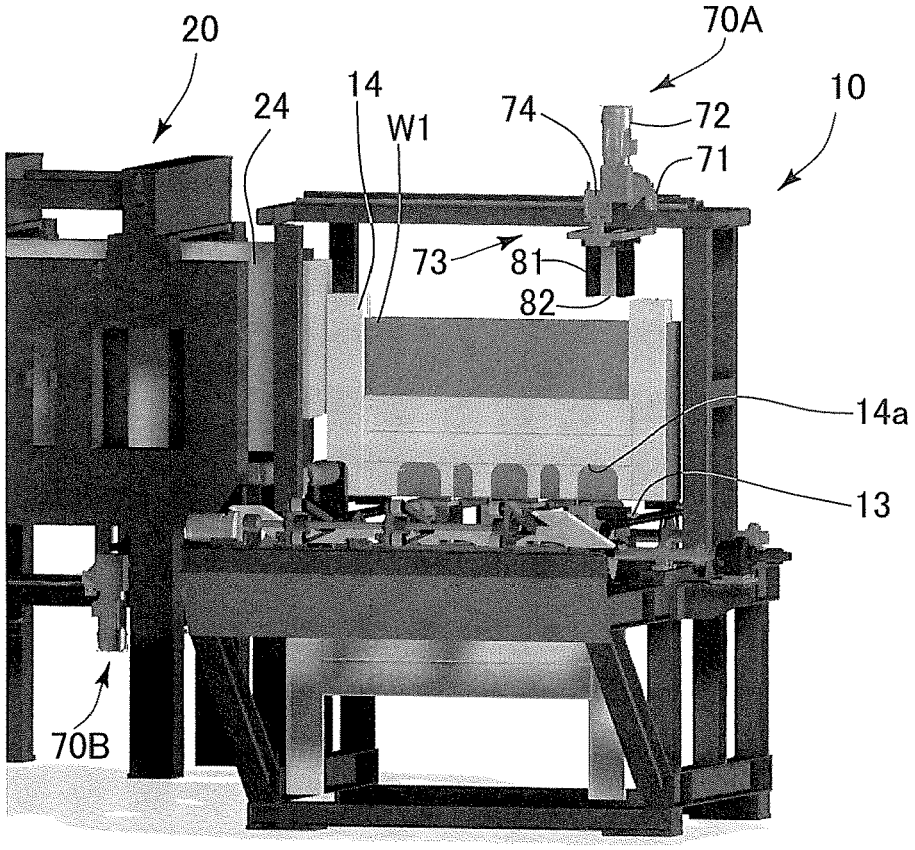
FIGS. 24 to 35 are 3D image explanatory diagrams corresponding to the contents of the first conveyance treatment in FIG. 18.

Then, in the initial setting S1, the loader step S2, and the unloader step S10, an initial setting program in FIG. 16, a loader treatment program in FIG. 17, and an unloader treatment program in FIG. 22 as subroutines are respectively executed. In addition, in the first conveyance step S3, the second conveyance step S5, the third conveyance step S7, and the fourth conveyance step S9, the first conveyance treatment program in FIG. 18, the second conveyance treatment program in FIG. 19, the third conveyance treatment program in FIG. 20, and the fourth conveyance treatment program in FIG. 21 as subroutines are respectively executed. In this case, each subroutine is designed to be independently executed.

In the initial setting S1 in FIG. 15, the control board 100 executes the initial setting treatment program shown in the flowchart in FIG. 16. Specifically, the control board 100 inputs veneer sheet information on the number of treatment sheets of the veneer sheet W1 from the setting switch 201 and the size of the surface to be pressurized. Based on the input contents, the setting table 102*b* of the ROM 102 is referred and the photoelectric sensors 202*a* to 202*h* in the optimum position are selected according to the size of the veneer sheet W1. In addition, the movement between the original position and the operation position of each traveling body 71 in the loader unit gripping body 70A, the hot press unit gripping body 70B, the open transpiration unit gripping body 70C, the temperature control press unit gripping body 70D, and the unloader unit gripping body 70E is set as, for example, the forward/reverse drive amount of the traveling body motor 72 (S11).

In the loader step S2 in FIG. 15, the control board 100 executes the loader treatment program shown in the flowchart in FIG. 17. In S21, it is determined whether or not a predetermined number of veneer sheets W1 (sheet material to be treated) are held in the loader shelf 14. If S21 is executed first, since no veneer sheet W1 is held in the loader shelf 14 (see FIG. 23), "NO" is determined in S21, and in S22, it is determined whether or not the loader unit gripping body 70A and the loader unit conveyor 15 are in the original positions. This is because when the chain conveyor 13 is driven in a state in which the loader unit gripping body 70A and the loader unit conveyor 15 are in the operation positions (ascent position), the veneer sheet W1 interferes with the loader unit conveyor 15.

If the loader unit gripping body 70A and the loader unit conveyor 15 are in the operation positions ("NO" in S21), after the loader unit gripping body 70A and the loader unit conveyor 15 are returned to their original positions (S24), the chain conveyor 13 is driven by only a predetermined rotation amount (S23), and the veneer sheets W1 are sent one by one into the loader shelf 14. Thereafter, the treatment in S21, S22 (determined as "YES"), and S23 is repeatedly executed in this order, and on the condition that a predetermined number of veneer sheets W1 are held in the loader shelf 14 ("YES" in S21), the loader treatment is ended. The loader step S2 corresponds to a first treatment step.

Figure 18:
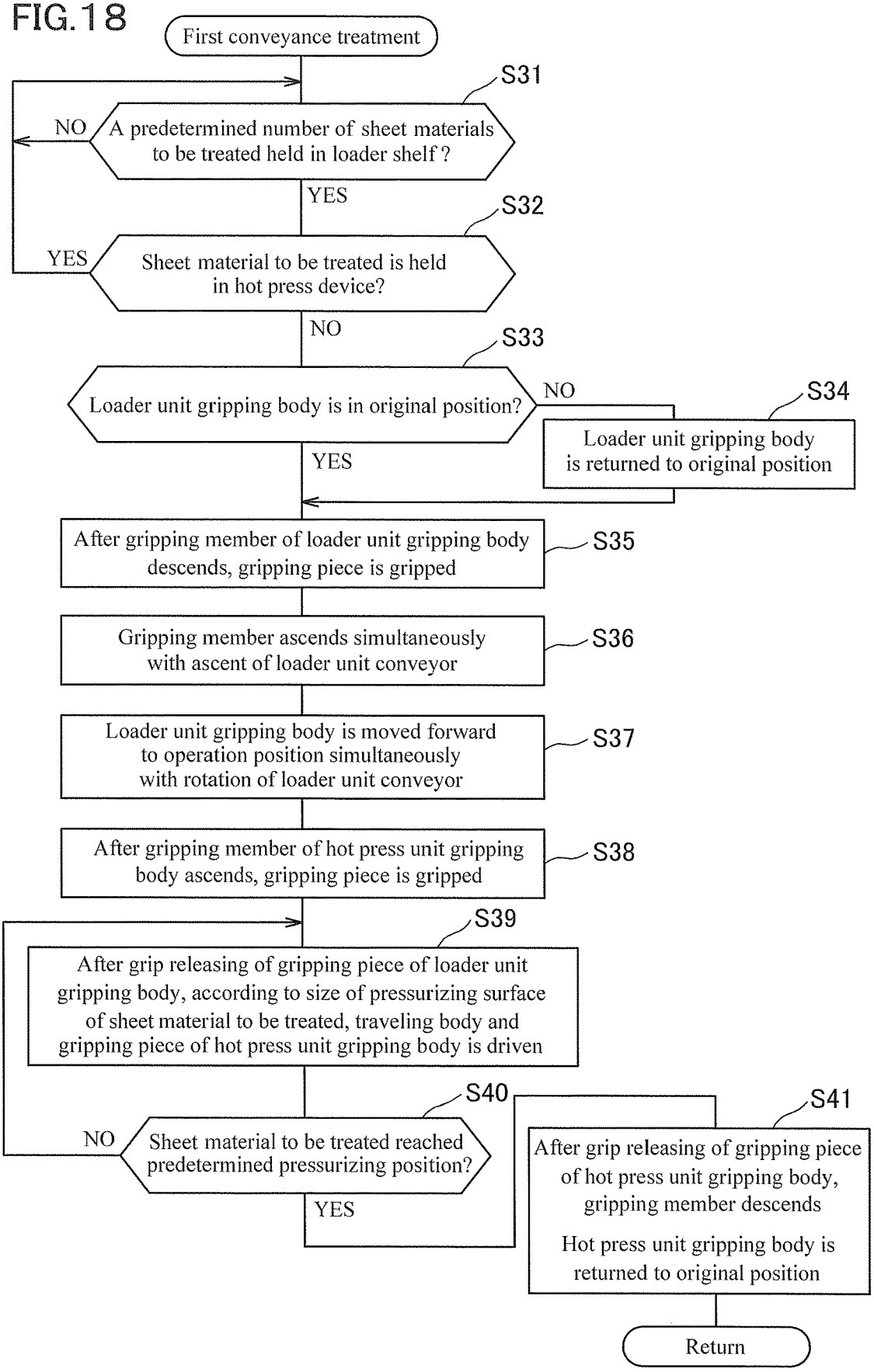
FIG. 18 is a flowchart showing the contents of a first conveyance step in step S3 in FIG. 15.

The control board 100 executes the first conveyance treatment program shown in the flowchart in FIG. 18 in the first conveyance step S3 in FIG. 15. If a predetermined number of veneer sheets W1 (sheet material to be treated) are held in the loader shelf 14 ("YES" in S31), no veneer sheet W1 is detected in the hot press device 20 by the photoelectric sensor 202*e* ("NO" in S32), and the loader unit gripping body 70A is in its original position (gripping position) (see FIG. 24, "YES" in S33), the control board 100 switches the electromagnetic switching valve 212A to the descent position, and lowers the gripping member 73 along with the elongation operation of the gripping member elevating cylinder 74.

Figure 25:
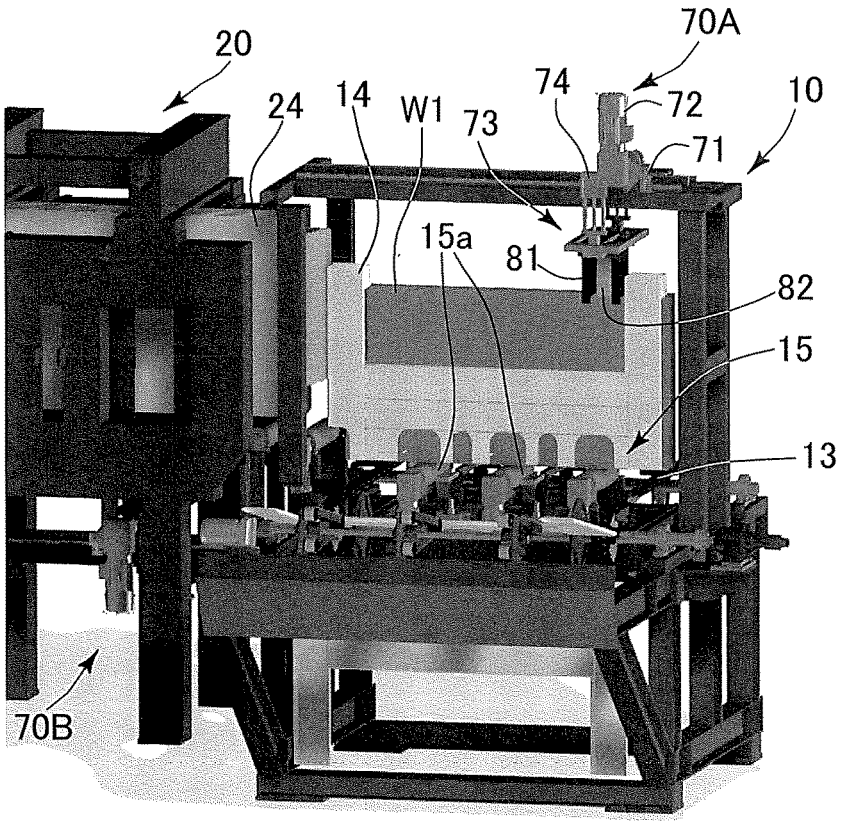

Thus, as shown in FIG. 25, the gripping pieces 81 and 82 of the gripping member 73 enter the gap between the plurality of veneer sheets W1 held in the loader shelf 14 in a standing state (gripping position). After the gripping member 73 is lowered, the electromagnetic switching valve 211A is switched to the gripping position, and along with the elongation operation of the gripping piece cylinders 77 and 78, the gripping pieces 81 and 82 are made to grip both side surfaces in the upper part of each of the plurality of veneer sheets W1 (see S35 and FIG. 26). It should be noted that if the loader unit gripping body 70A is not in the original position ("NO" in S33), the traveling body motor 72 is driven in the reverse direction to return the loader unit gripping body 70A to the original position (S34).

Figure 27:
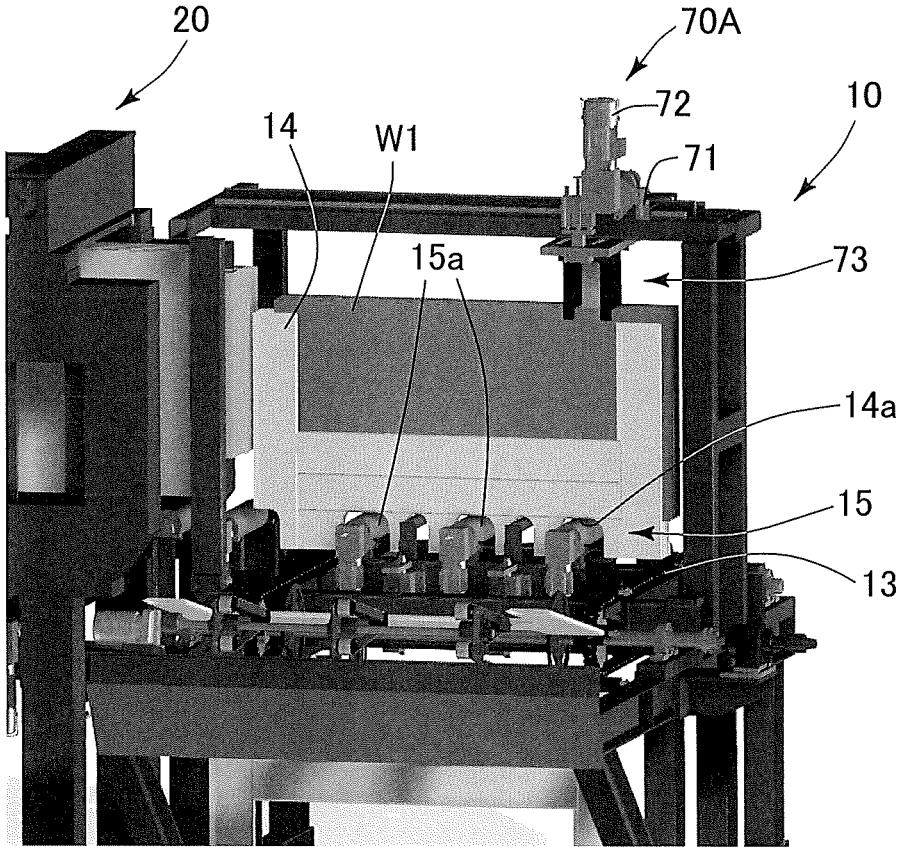

Next, as shown in FIG. 27, the electromagnetic switching valve 213A is switched to the ascent position, and along with the elongation operation of the conveyor elevating cylinder 16, the loader unit conveyor 15 is Made to rise to the operation position. At this time, the drive of the gripping member elevating cylinder 74 is synchronized with the drive of the conveyor elevating cylinder 16, and simultaneously with the ascent of the loader unit conveyor 15, the gripping member 73 is raised (S36). In this state, while both side surfaces in the upper part of each of the plurality of veneer sheets W1 are suspended by the gripping pieces 81 and 82, the lower end of each of the veneer sheets W1 is lifted by the belt conveyor 150 (roller 15*a*) of the loader unit conveyor 15.

As described above, in the first example, using a simple control method of synchronous drive between the conveyor elevating cylinder 16 and the gripping member elevating cylinder 74 causes the conveyance surface F1 of the loader unit conveyor 15 to coincide with the conveyance surface F2 of the hot press unit roller conveyor 31. Thus, the chain conveyor 13 for causing the veneer sheet W1 to stand up and the loader unit conveyor 15 for carrying the veneer sheet W1 into the hot press device 20 from the loader device 10 are made compatible.

Next, as shown in FIG. 28, the traveling body motor 72 of the loader unit gripping body 70A is driven to rotate forward and the traveling body 71 is made to move forward to the operation position (grip releasing position). At this time, the drive of the loader unit conveyor motor 204 is synchronized with the drive of the traveling body motor 72, and the belt conveyor 150 (the roller 15*a*) is rotated for a predetermined time in accordance with the moving speed of the traveling body 71 (S37). Thus, the plurality of veneer sheets W1 enter between the hot plates 24 of the hot press device 20 along the respective approach paths.

Figure 29:
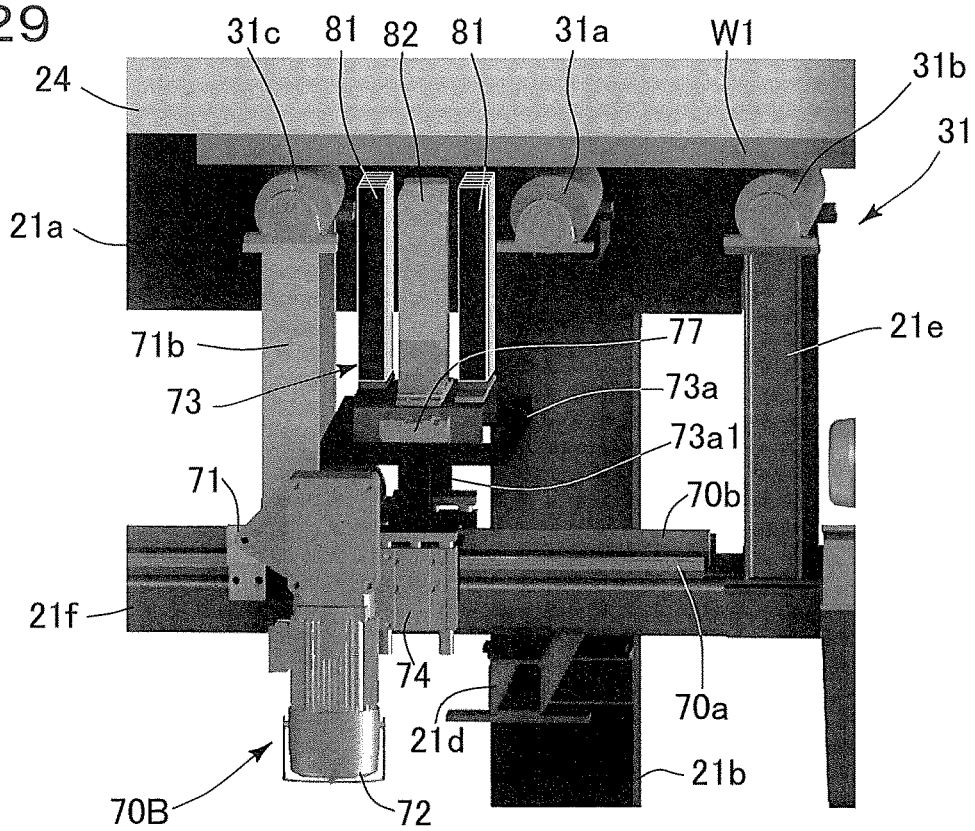

At this time, as shown in FIG. 29, for example, the hot press unit gripping body 70B is in a standby state with the position where the upper end of the gripping member 73 is opposed to the lower end of the left end portion (starting end portion) of the veneer sheet W1 as its original position. The roller 31*c* supports and guides the lower end of the veneer sheet W1 entering between the hot plates 24 together with the rollers 31*a* and 31*b*.

After execution of the treatment in S37, on the condition that the loader unit gripping body 70A reaching the operation position (grip releasing position) is detected by the photoelectric sensor 202*a*, the electromagnetic switching valve 212B is switched to the ascent position, and along with the elongation operation of the gripping member elevating cylinder 74 of the hot press unit gripping body 70B, the gripping member 73 is made to ascend. The gripping pieces 81 and 82 of the gripping member 73 in the expanded state enter the gap between the plurality of veneer sheets W1 held in the standing state between the hot plates 24. After the gripping member 73 is raised, the electromagnetic switching valve 211B is switched to the gripping position, and along with the elongation operation of the gripping piece cylinders 77 and 78, the gripping pieces 81 and 82 are made to grip both side surfaces in the lower part of each of the plurality of veneer sheets W1 (see S38 and FIG. 30).

Figure 31:
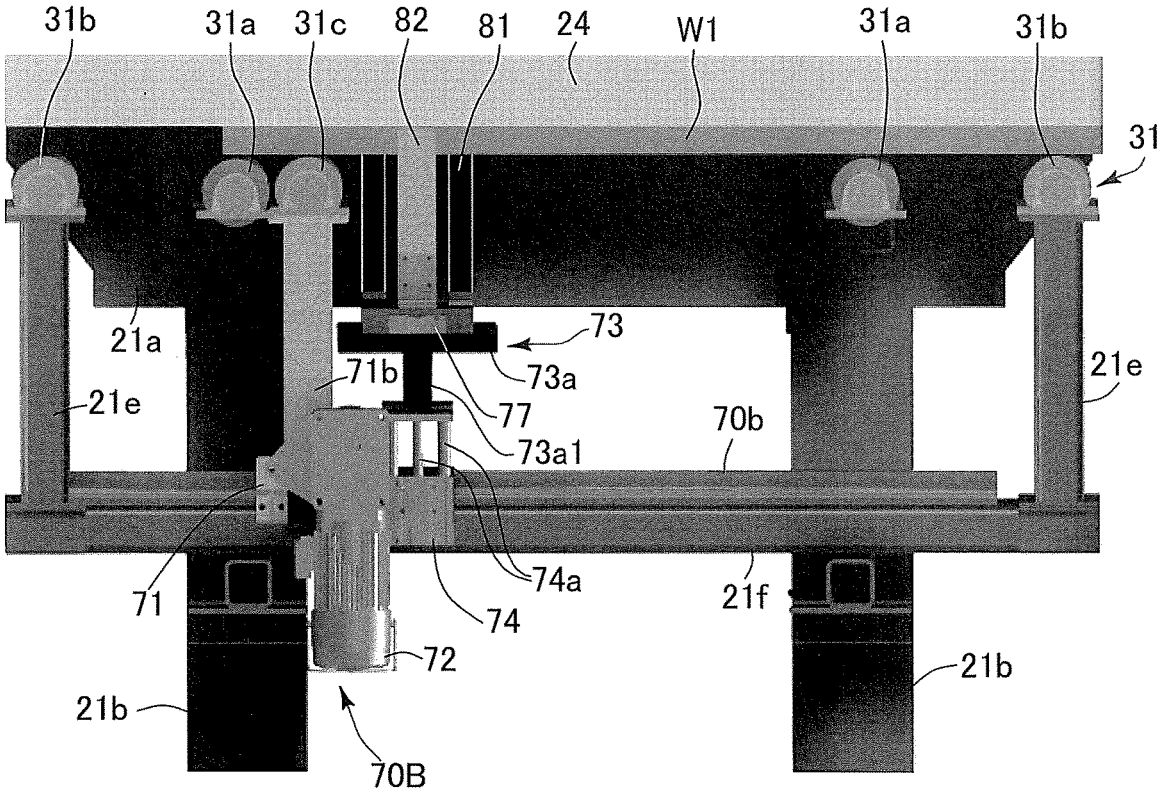

Next, the electromagnetic switching valve 211A is switched to the grip releasing position, and the gripping pieces 81 and 82 of the loader unit gripping body 70A are brought into the grip releasing state. That is, switching the electromagnetic switching valve 211B to the gripping position and switching the electromagnetic switching valve 211A to the grip releasing position shift the gripping position of the veneer sheet W1 from the upper part to the lower part to support the veneer sheet W1. Thereafter, as shown in FIG. 31, the traveling body motor 72 of the hot press unit gripping body 70B is driven to rotate forward and the traveling body 71 is made to move forward to the operation position (S39).

This operation position is set to a position where the roller 31*c* comes into contact with the roller 31*a* or a position near the roller 31*a*.

It should be noted that when the photoelectric sensor 202*d* detects that no veneer sheet W1 remains in the loader shelf 14, the control board 100 reversely drives the traveling body motor 72 of the loader unit gripping body 70A at the timing, for example, when the loader device 10 receives a new veneer sheet W1 from the feed mechanism and returns the loader unit gripping body 70A to the original position. At this time, the electromagnetic switching valve 213A is switched to the descent position, and along with the contraction operation of the conveyor elevating cylinder 16, the loader unit conveyor 15 is made to descend. Thereafter, the loader treatment in FIG. 17 is executed in the loader device 10 in the same manner as described above.

Figure 32:
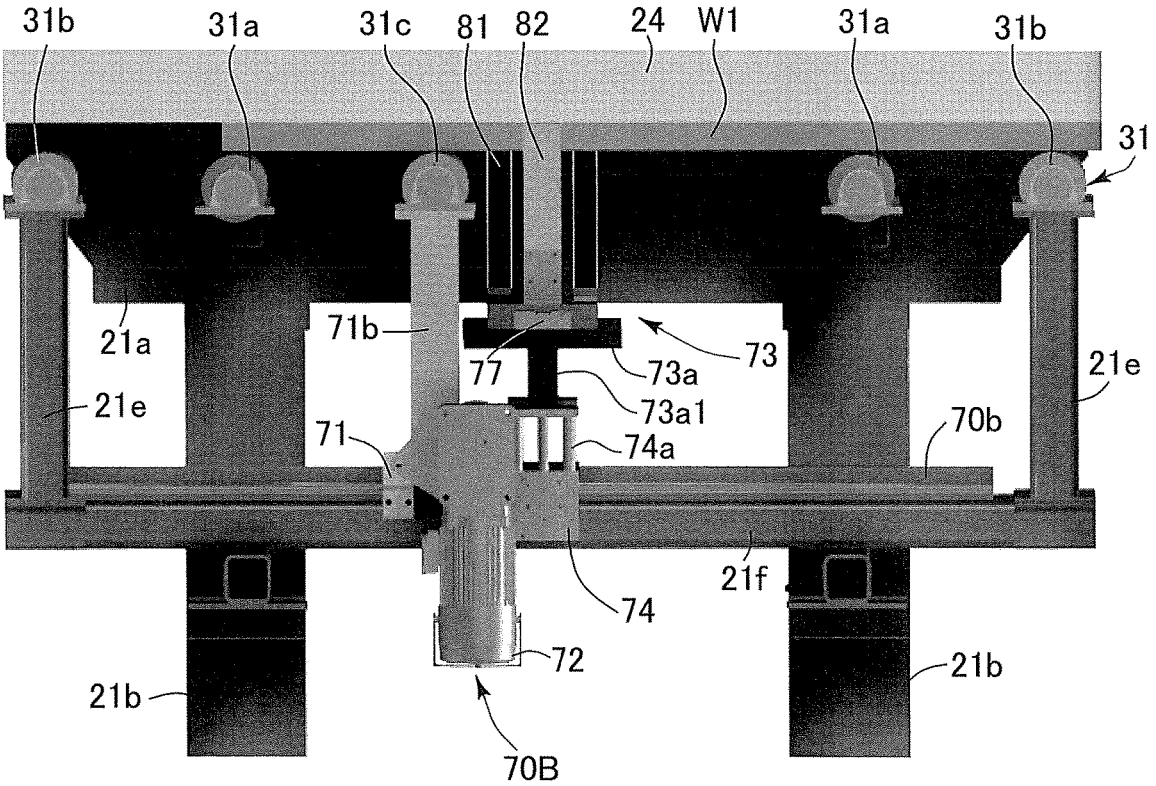
Figure 33:
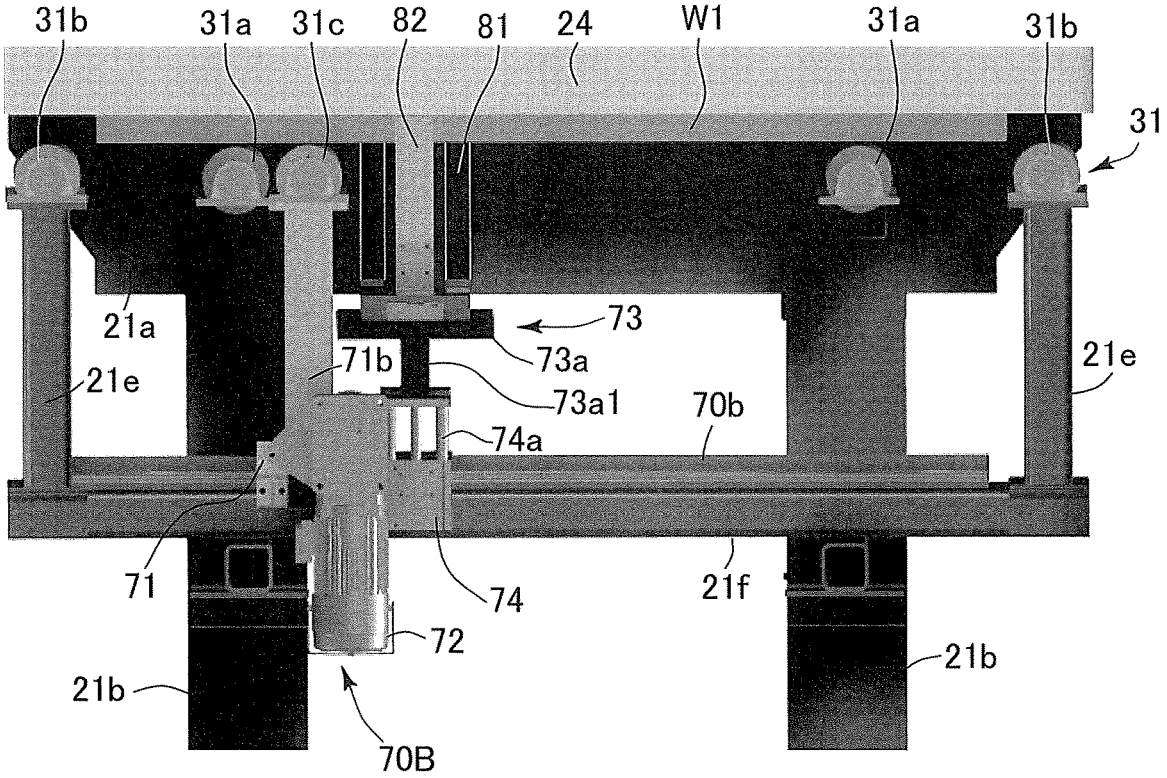
Figure 34:
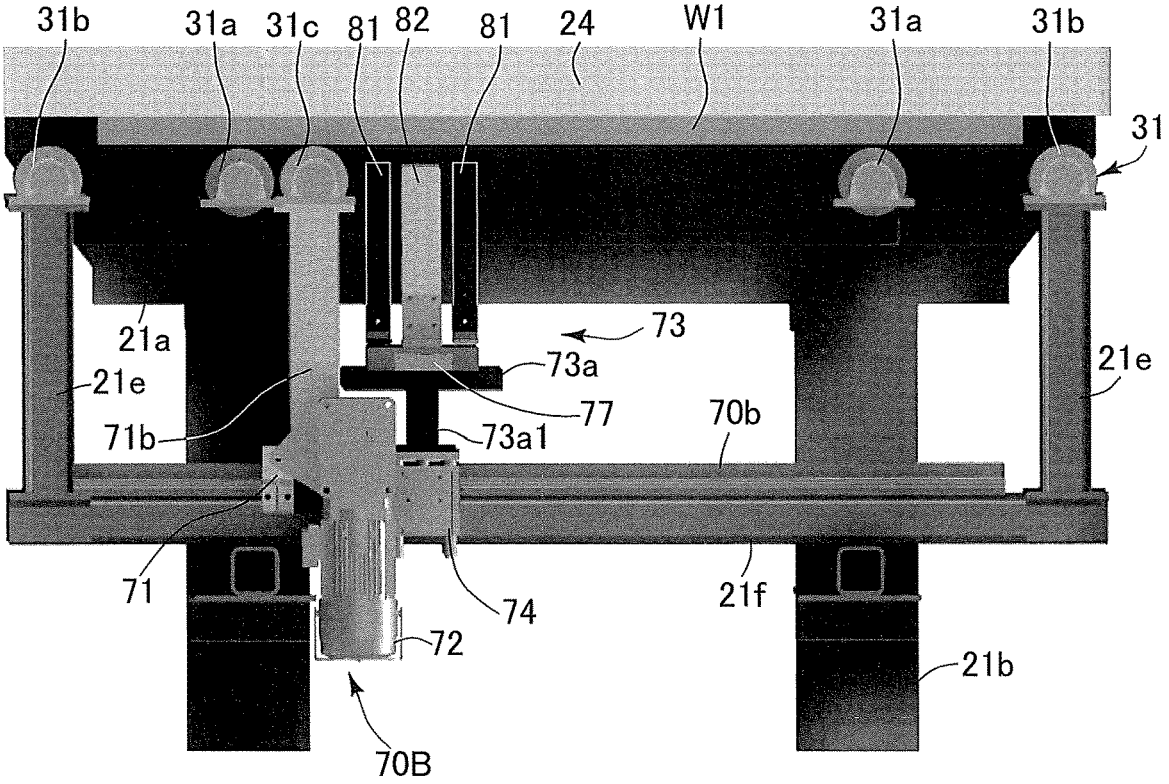
Figure 35:
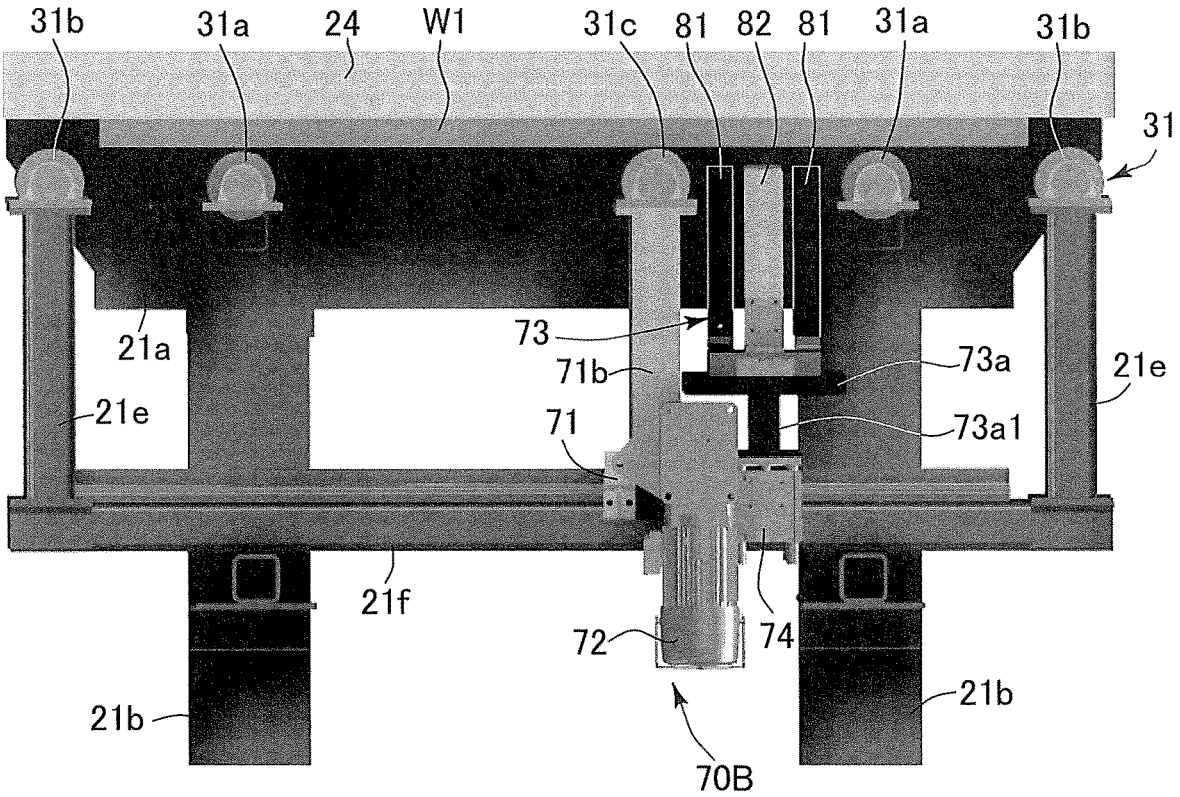
Figure 36:
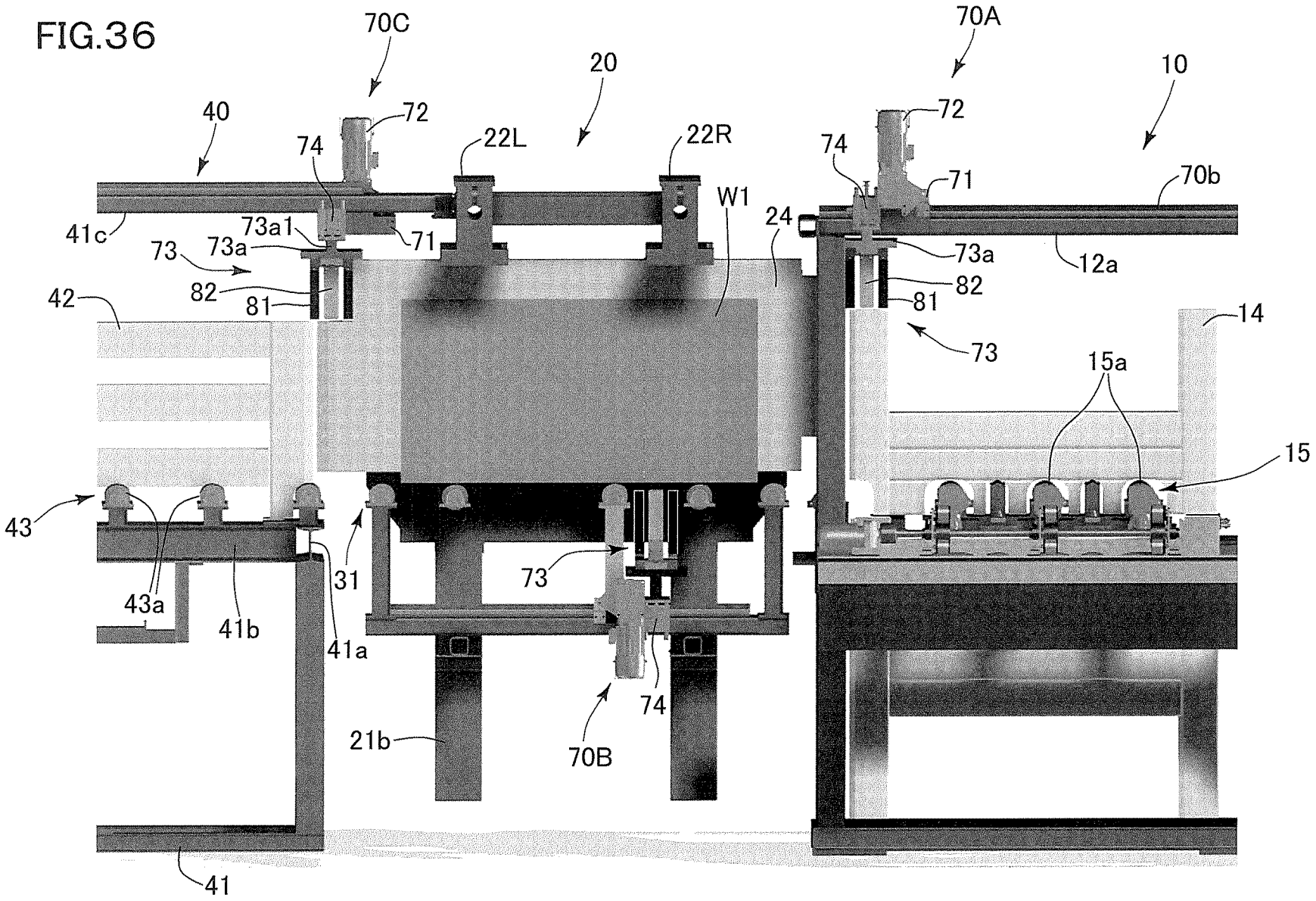
FIGS. 36 to 40 are 3D image explanatory diagrams corresponding to the contents of the second conveyance treatment in FIG. 19.

If the traveling body 71 reaches the operation position once, and the veneer sheet W1 reaches the press position (predetermined pressurizing position) of the hot press device 20, the process proceeds to S41 according to the determination of "YES" in S40, and if the traveling body 71 reaches the operation position only once, and the veneer sheet W1 does not reach the press position (predetermined pressurizing position) of the hot press device 20 ("NO" in S40), feed control by the traveling body 71 is performed according to the length of the veneer sheet W1 so that the veneer sheet W1 is fed to its press position. For example, the electromagnetic switching valve 211B is switched to the grip releasing position, the gripping pieces 81 and 82 of the hot press unit gripping body 70B are brought into the grip releasing state, the traveling body 71 is made to return by the necessary amount according to the length of the veneer sheet W1, and then, as shown in FIG. 32, the electromagnetic switching valve 211B is switched to the gripping position, and the gripping pieces 81 and 82 of the hot press unit gripping body 70B are caused to grip the lower part of the veneer sheet W1 again. In this state, as shown in FIG. 33, the traveling body motor 72 is driven to rotate forward and the traveling body 71 is again made to move forward to the operation position (S39). Thus, the veneer sheet W1 is fed to the press position of the hot press device 20.

If the veneer sheet W1 is fed to the press position of the hot press device 20 ("YES" in S40), the electromagnetic switching valve 211B is switched to the grip releasing position, and the gripping pieces 81 and 82 of the hot press unit gripping body 70B are brought into the grip releasing state, and then, the electromagnetic switching valve 212B is switched to the descent position, and along with the contraction operation of the gripping member elevating cylinder 74, the gripping member 73 is made to descend. In this state, the traveling body motor 72 of the hot press unit gripping body 70B is driven to rotate reversely and the traveling body 71 is made to return to its original position (see S41 and FIGS. 35 and 36). After execution of the treatment in S41, the first conveyance treatment is ended. In the first example, the treatment from S35 to S37 in FIG. 18 corresponds to the upstream side carry-out step, and the treatment in S38 and S39 corresponds to the downstream side carry-in step.

Returning to FIG. 15, in the hot press step in S4, the control board 100 switches the electromagnetic switching valve 214B to the closing position, and closes the plurality of hot plates 24 simultaneously along with the elongation operation of the press cylinder 27 of the hot press device 20. Pressurizing and heating are performed for a predetermined time according to the type of the veneer sheet W1, and then the electromagnetic switching valve 214B is switched to the open position, and along with the contraction operation of the press cylinder 27 of the hot press device 20, the plurality of hot plates 24 are simultaneously opened. The hot press step in S4 corresponds to a second treatment step.

Figure 19:
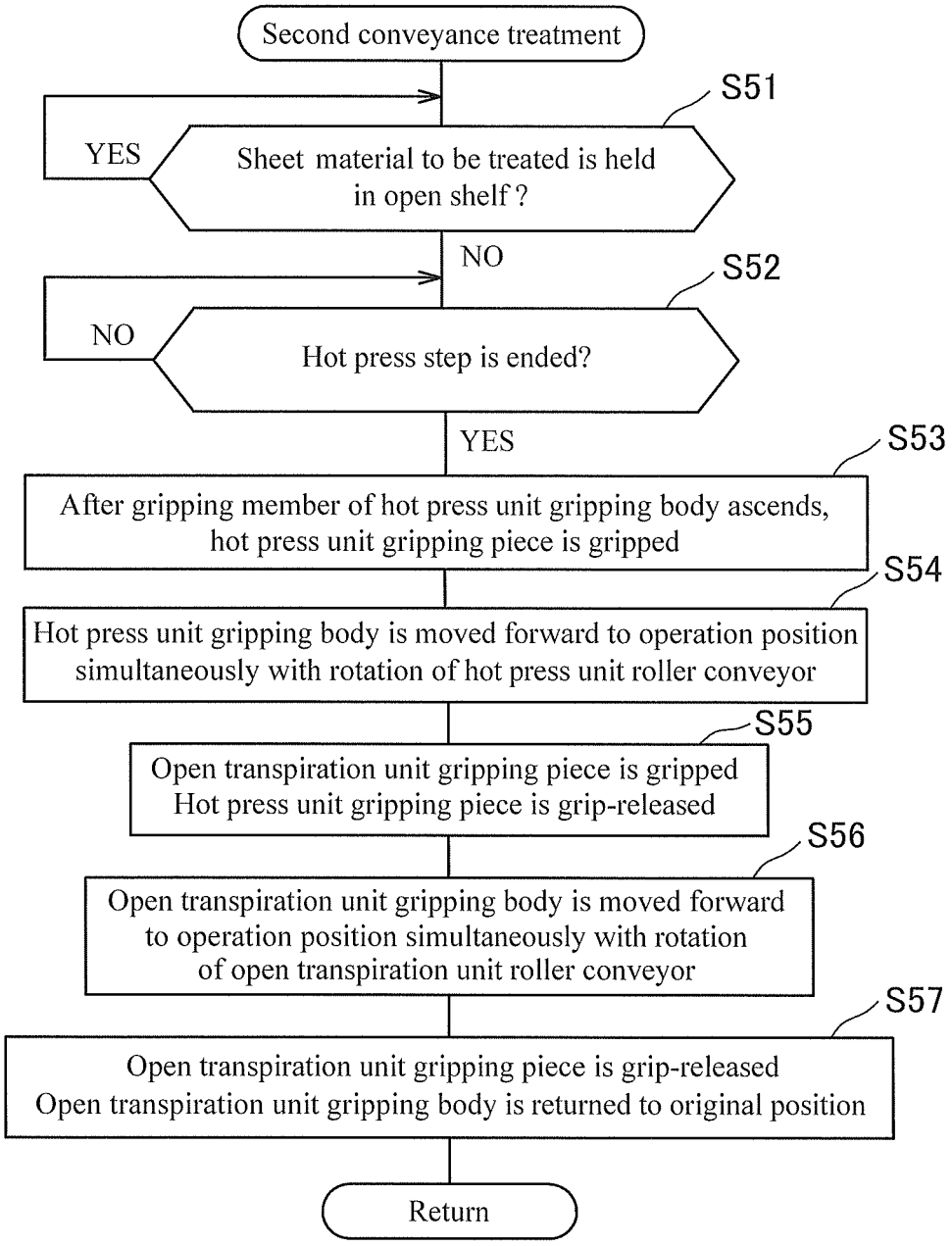
FIG. 19 is a flowchart showing the contents of a second conveyance step in step S5 in FIG. 15.
Figure 37:
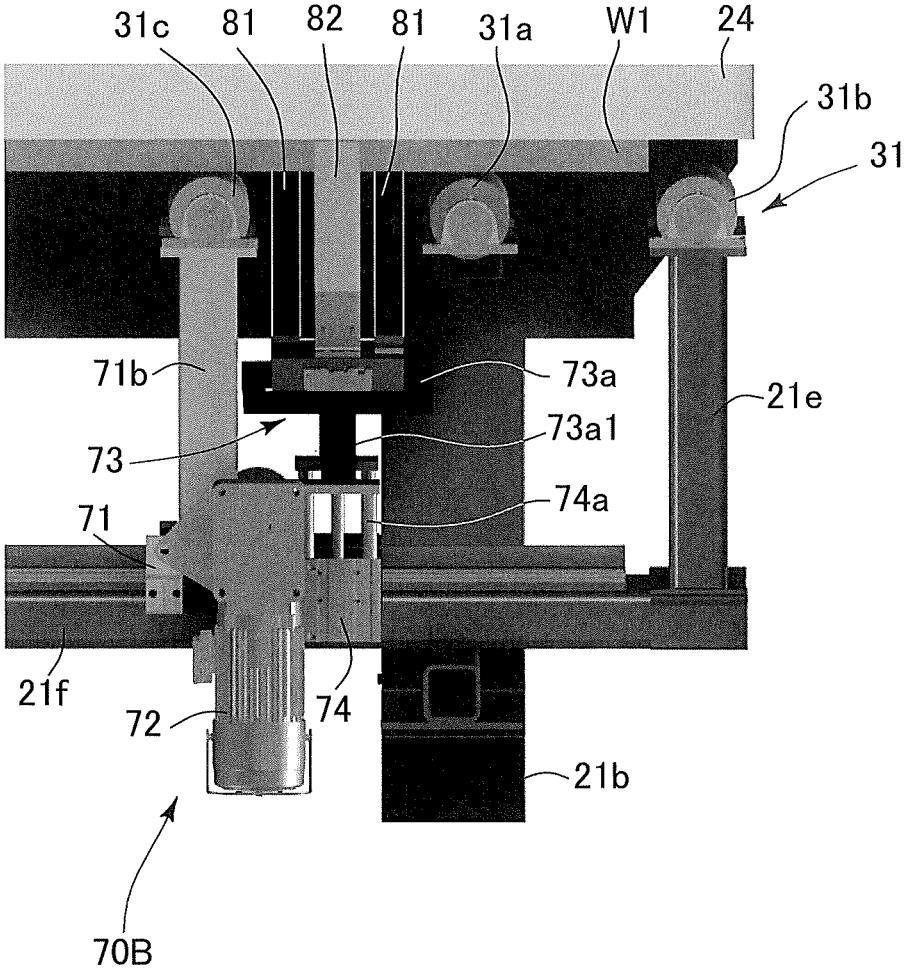

The control board 100 executes the second conveyance treatment program shown in the flowchart in FIG. 19 in the second conveyance step in S5 in FIG. 10. In S51, the photoelectric sensor 202*f* determines, whether or not the veneer sheet W1 (sheet material to be treated) is held in the open shelf 42. When S51 is executed first, since the veneer sheet W1 is not held in the open shelf 42 (see FIG. 36), "NO" is determined in S51, on the condition that the hot press step is ended ("YES" in S52), the electromagnetic switching valve 212B is switched to the ascent position, and along with the elongation operation of the gripping member elevating cylinder 74, the gripping member 73 of the hot press unit gripping body 708 in the original position is made to ascend. Thus, as shown in FIG. 37, the gripping pieces 81 and 82 of the gripping member 73 enter the gap between the plurality of veneer sheets W1 held in the hot plates 24 in as standing state. After the ascent of the gripping member 73, the electromagnetic switching valve 211B is switched to the gripping position, and the gripping pieces 81 and 82 of the hot press unit gripping body 70B are caused to grip the lower part of the veneer sheet W1 (S53).

Figure 38:
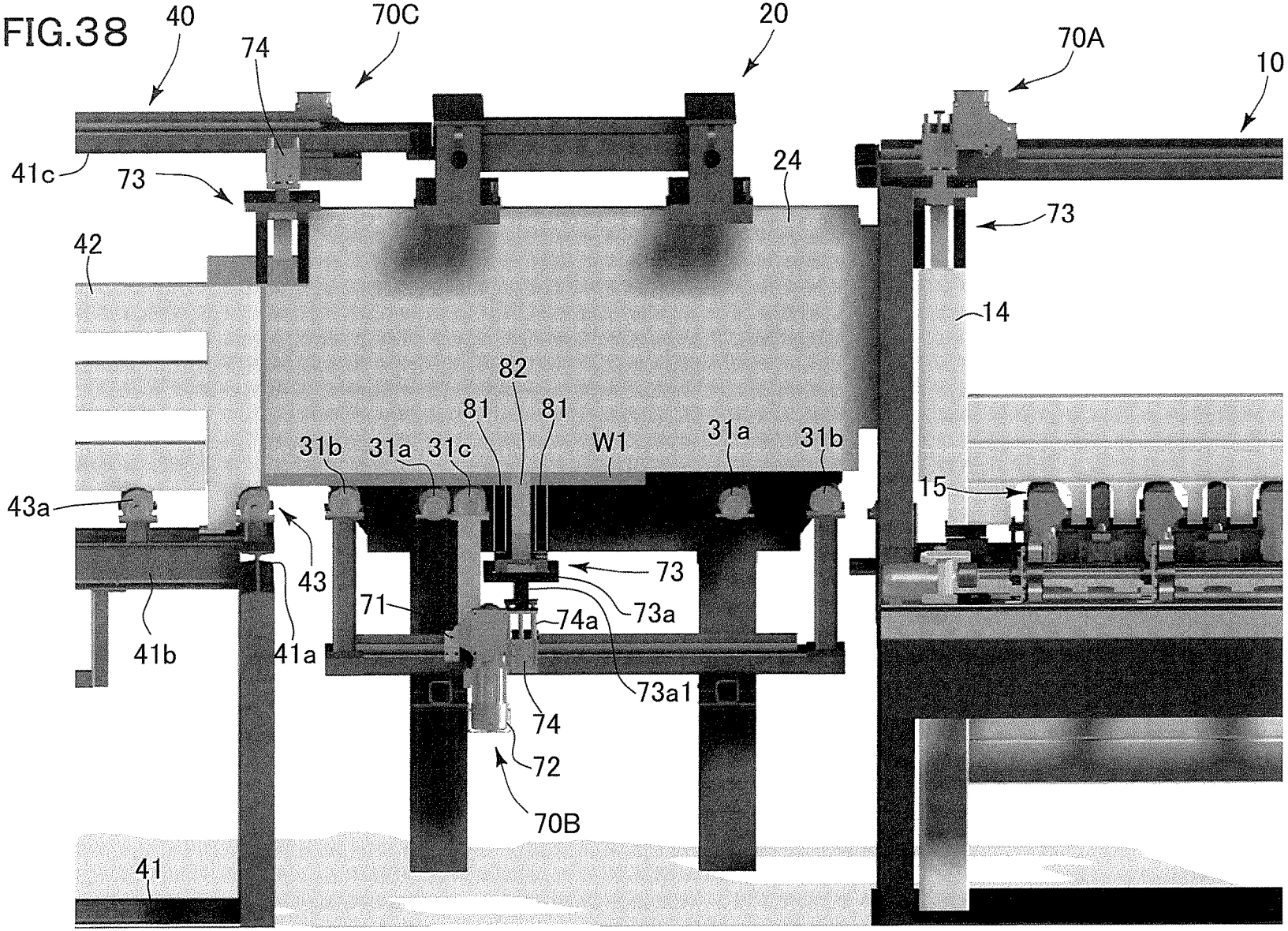

In this state, as shown in FIG. 38, the traveling body motor 72 of the hot press unit gripping body 70B is driven to rotate forward and the traveling body 71 is made to move forward to the operation position (S54). At this time, the drive of the hot press unit conveyor motor 204 is synchronized with the drive of the traveling body motor 72, and the rollers 31*a* and 31*b* are rotated for a predetermined time in accordance with the moving speed of the traveling body 71 (S54). Since the open transpiration unit gripping body 70C is normally on standby in the original position, and moreover, the gripping pieces 81 and 82 of the gripping member 73 are in the expanded state, the plurality of veneer sheets W1 enter between the open shelves 42 of the open transpiration device 40 along each approach path while the upper part of the plurality of veneer sheets W1 passes through the gripping pieces 81 and 82.

When the photoelectric sensor 202*e* detects that the hot press unit gripping body 70B reaches the operation position, the electromagnetic switching valve 211C is switched to the gripping position, and along with the elongation operation of the gripping piece cylinders 77 and 78 of the open transpiration unit gripping body 70C, the gripping pieces 81 and 82 are made to grip both side surfaces in the upper part of each of the plurality of veneer sheets W1. At the same time, the electromagnetic switching valve 211B is switched to the grip releasing position, and the gripping pieces 81 and 82 of the hot press unit gripping body 70B are brought into the grip releasing state (S55). That is, switching the electromagnetic switching valve 211C to the gripping position and switching the electromagnetic switching valve 211B to the grip releasing position shift the gripping position of the veneer sheet W1 from the lower part to the upper part to support the veneer sheet W1.

Figure 39:
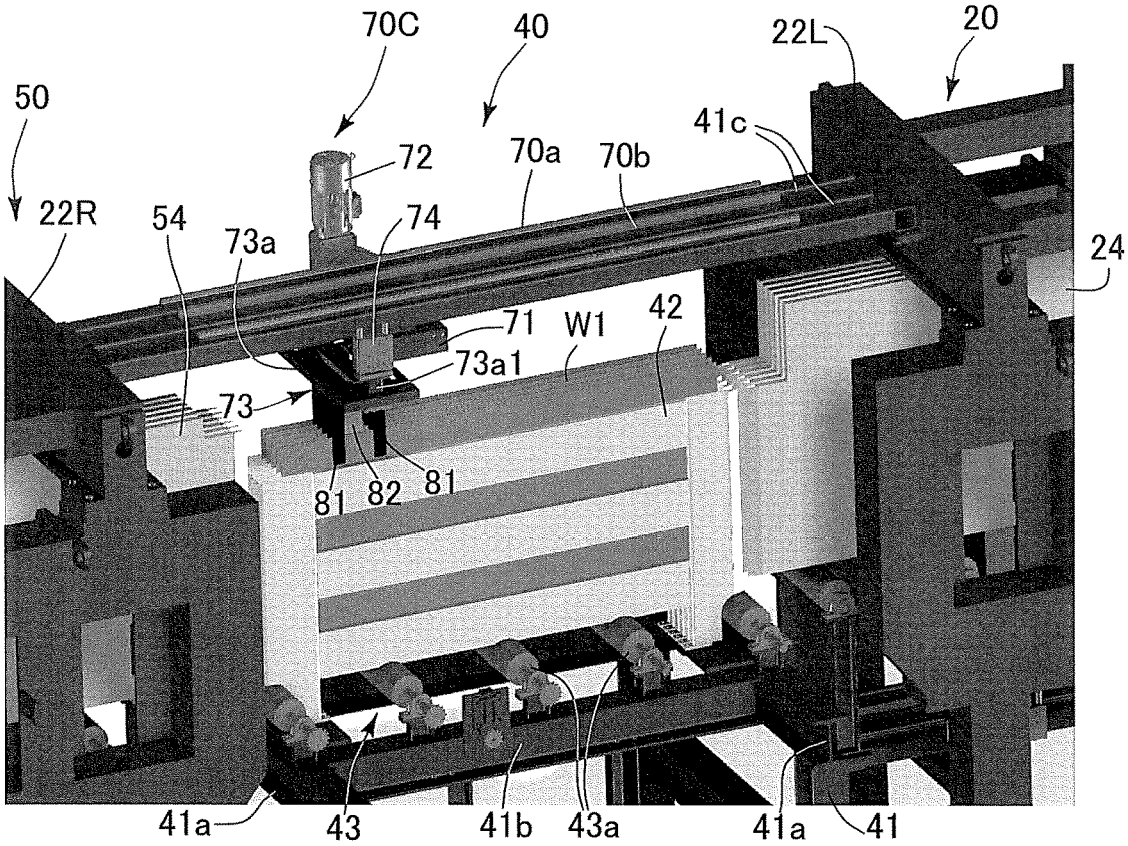
Figure 40:
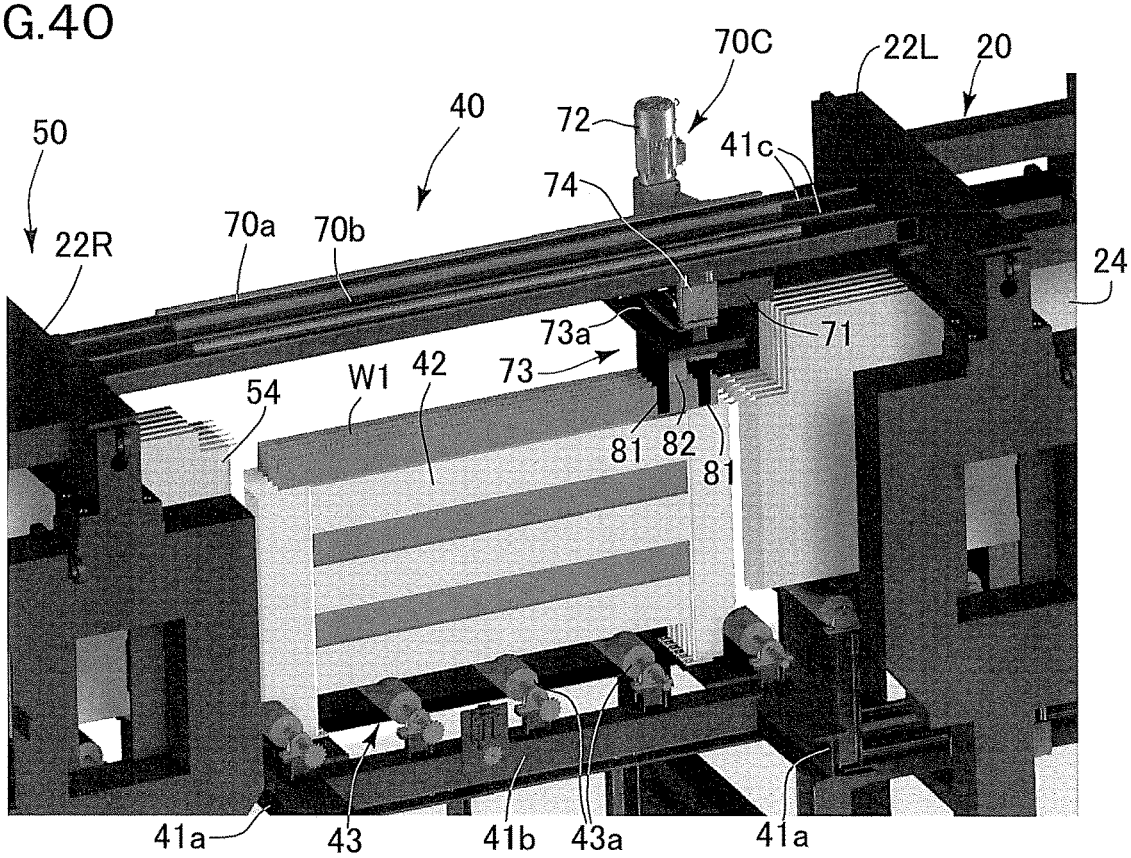

Thereafter, as shown in FIG. 39, the traveling body motor 72 of the open transpiration unit gripping body 70C is driven to rotate forward and the traveling body 71 is caused to move forward to the operation position (S56). At this time, the drive of the open transpiration unit conveyor motor 204 is synchronized with the drive of the traveling body motor 72, and the roller 43*a* is rotated for a predetermined time in accordance with the moving speed of the traveling body 71. Thus, each of the plurality of veneer sheets W1 is held in the open transpiration position (atmospheric release position) at predetermined intervals in the open shelf 42, which allows water vapor to evaporate from both surfaces in the standing state into the atmosphere.

When the photoelectric sensor 202*b* detects that the open transpiration unit gripping body 70C reaches the operation position, the electromagnetic switching valve 211C is switched to the grip releasing position, and along with the contraction operation of the gripping piece cylinders 77 and 78, the gripping pieces 81 and 82 are brought into the grip releasing state, and then the traveling body motor 72 of the open transpiration unit gripping body 70C is reversely driven, and the traveling body 71 is made to return to its original position (see S57 and FIG. 40), After the execution of the treatment in S57, the second conveyance treatment is ended.

Returning to FIG. 15, in the open transpiration step in S6, the control board 100 holds each veneer sheet W1 in a standing state in the open shelf 42 for a predetermined time, for example, until the pressing and heating time in the hot press device 20 of the next veneer sheet W1 elapses. The moisture contained in each veneer sheet W1 is evaporated into the atmosphere while steaming from both surfaces of each veneer sheet W1. The open transpiration step in S6 corresponds to a first treatment step.

Figure 20:
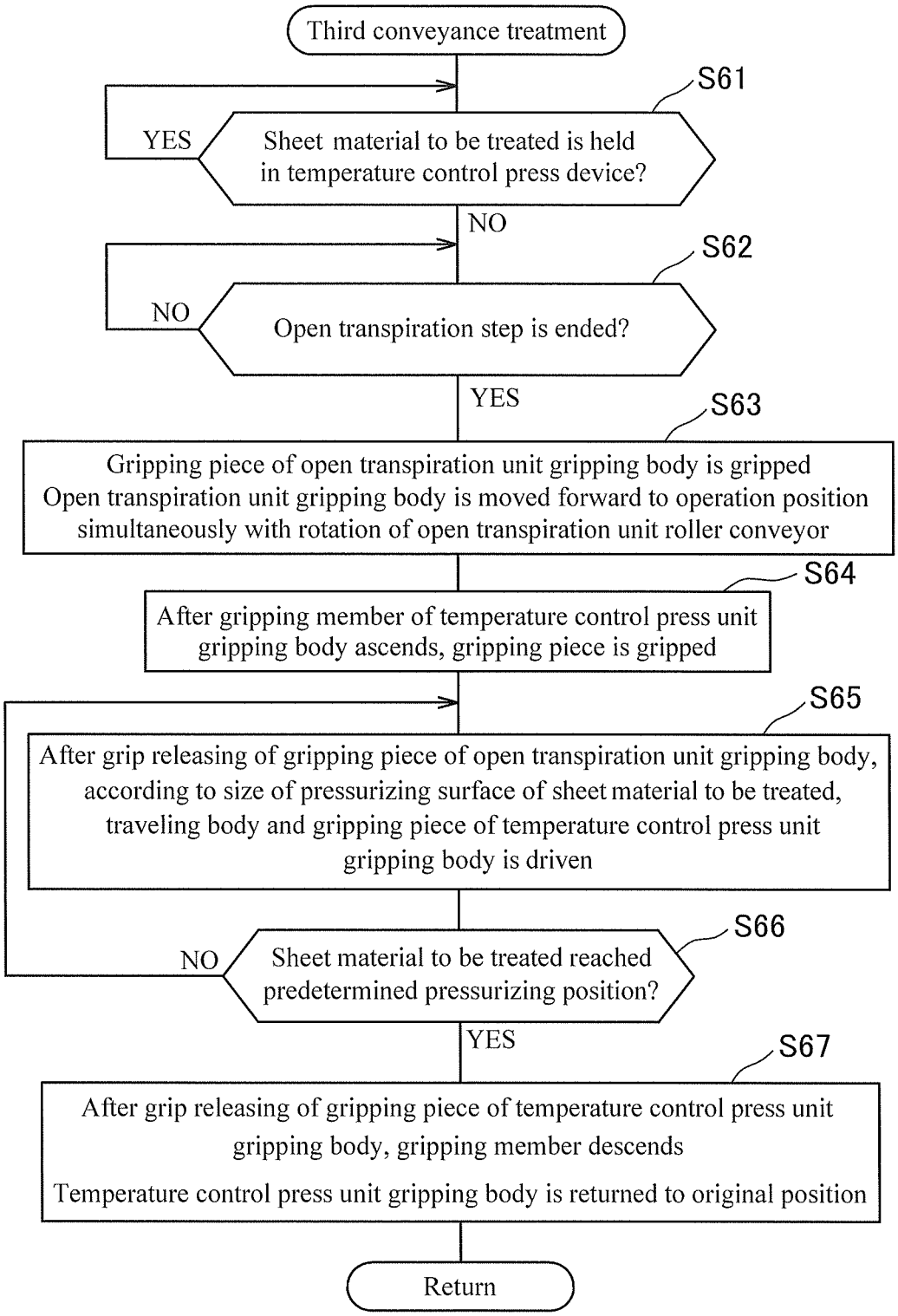
FIG. 20 is a flowchart showing the contents of a third conveyance step in step S7 in FIG. 15.

The control board 100 executes the third conveyance treatment program shown in the flowchart in FIG. 20 in the third conveyance step S7 in FIG. 15. In S61, the photoelectric sensor 202*g* determines whether or not the veneer sheet W1 (sheet material to be treated) is held in the temperature control press device 50. When S61 is executed first, since the veneer sheet W1 is not held in the temperature control press device 50 (see FIG. 40), "NO" is determined in S61, and on the condition that the open transpiration step is ended in S62 ("YES" in S62), the treatment in S63 is executed.

Figure 41:
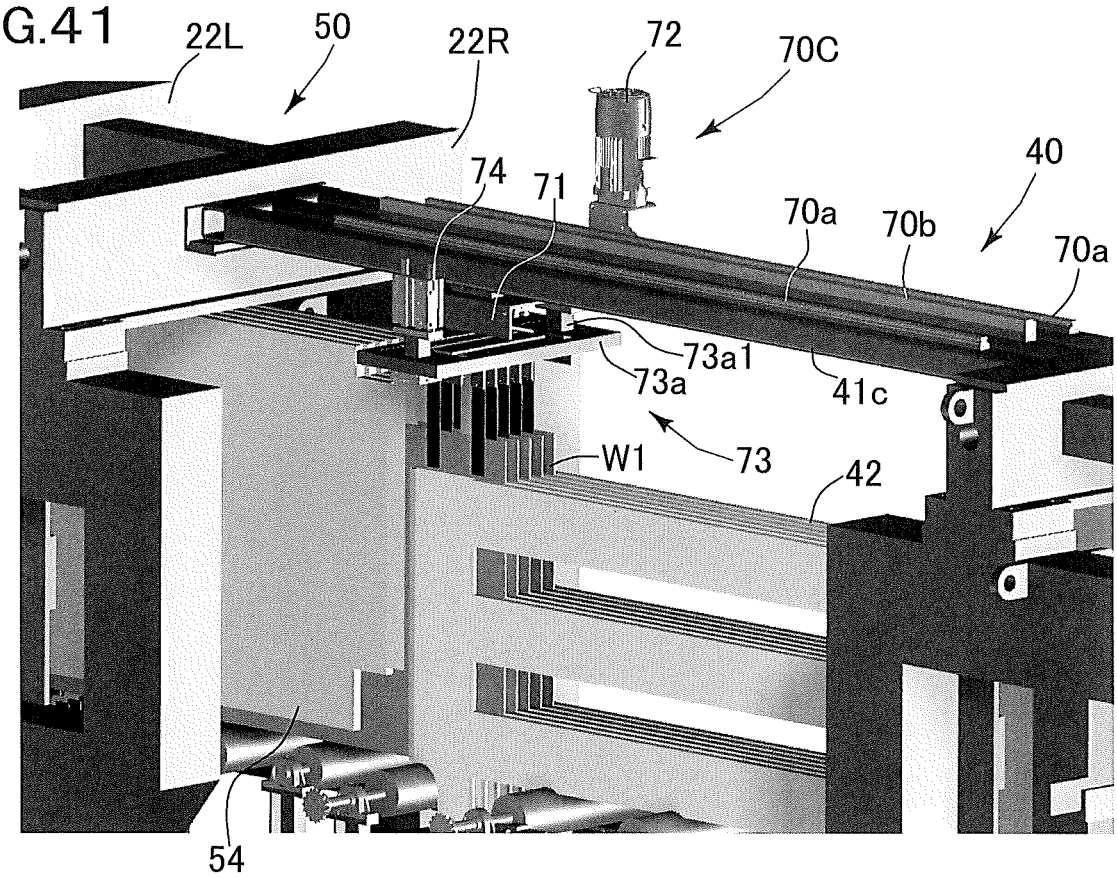
FIGS. 41 to 47 are 3D image explanatory diagrams corresponding to the contents of the third conveyance treatment in FIG. 20.

In S63, the electromagnetic switching valve 211C is switched to the gripping position, and along with the elongation operation of the gripping piece cylinders 77 and 78, the gripping pieces 81 and 82 of the open transpiration unit gripping body 70C in the original position are made to grip both side surfaces in the upper part of each of the plurality of veneer sheets W1. In this state, as shown in FIG. 41, the traveling body motor 72 of the open transpiration unit gripping body 70C is driven to rotate forward and the traveling body 71 is caused to move forward to the operation position. At this time, the drive of the open transpiration unit conveyor motor 204 is synchronized with the drive of the traveling body motor 72, and the roller 43*a* is rotated for a predetermined time in accordance with the moving speed of the traveling body 71 (S63). Thus, the plurality of veneer sheets W1 enter between the temperature control plates 54 of the temperature control press device 50 along the respective approach paths.

Figure 42:
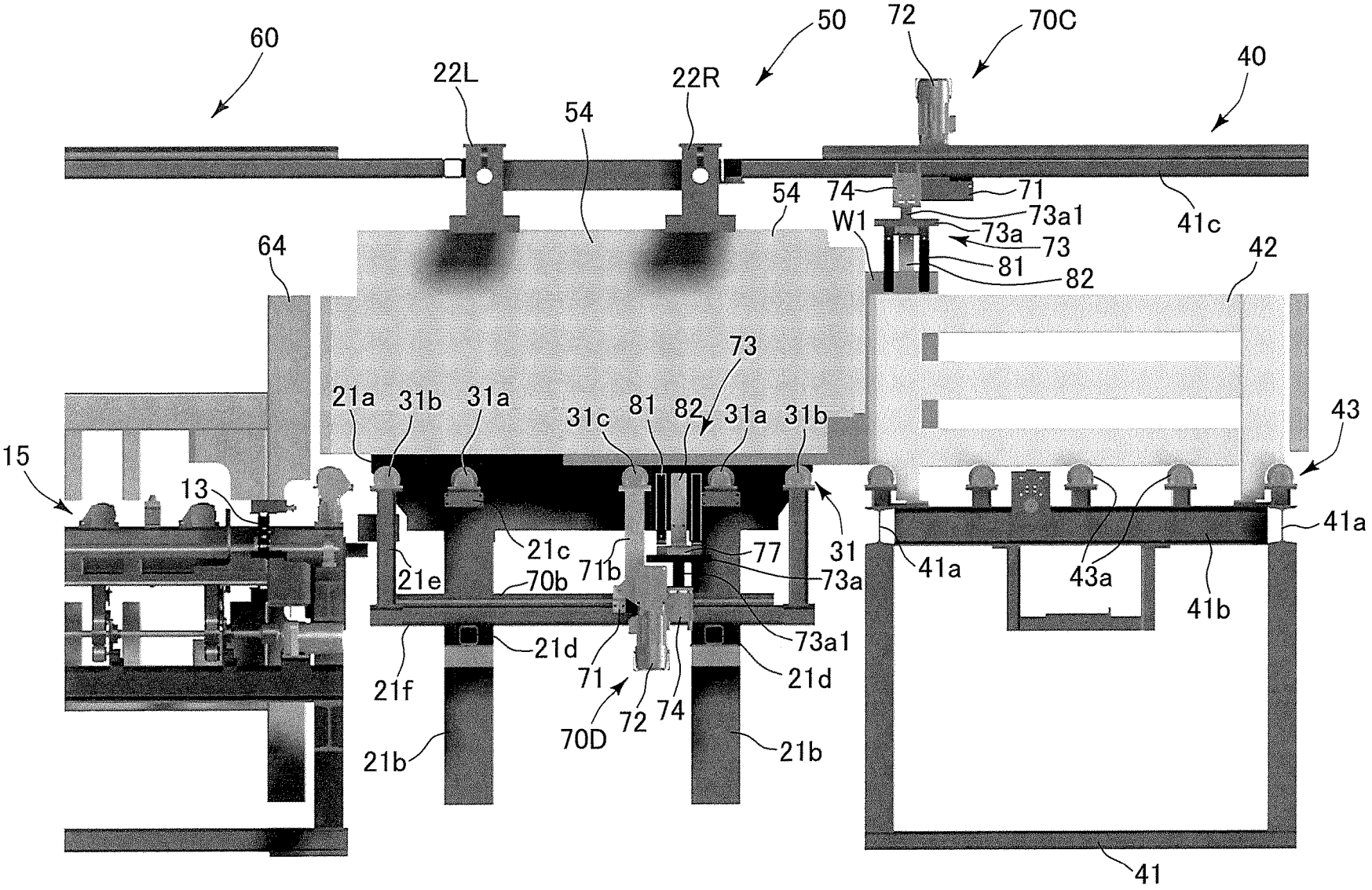
Figure 43:
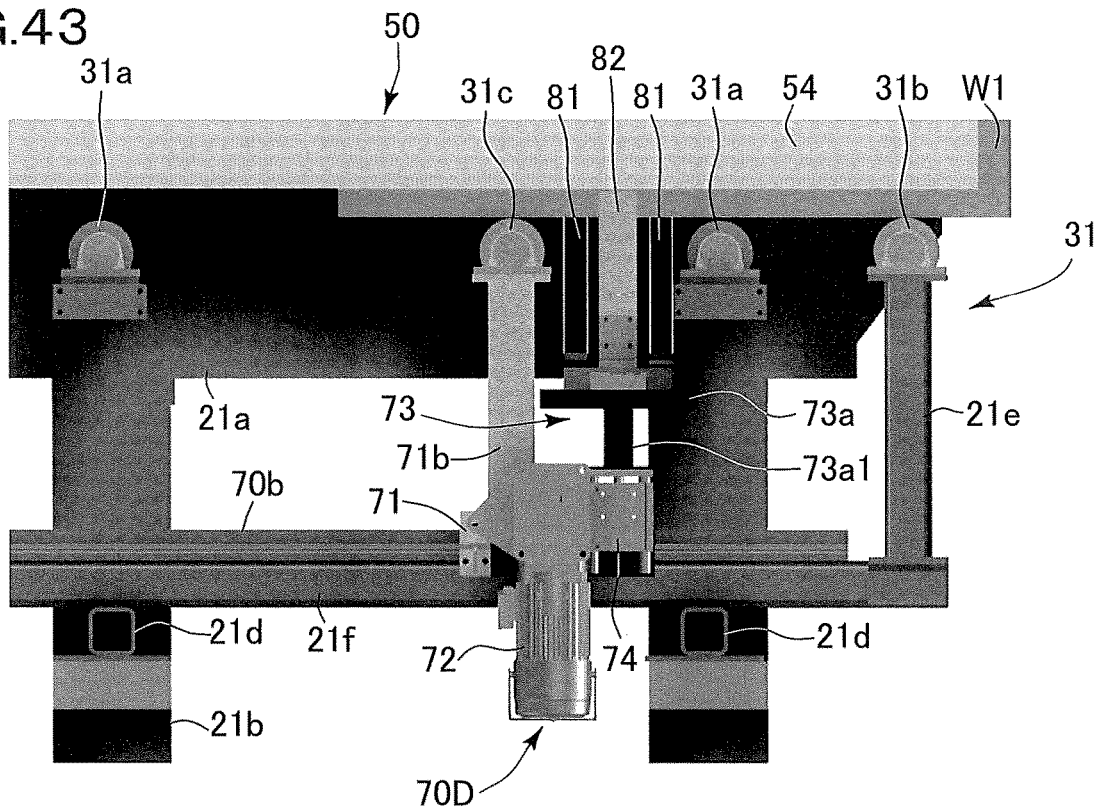

At this time, as shown in FIG. 42, for example, the temperature control press unit gripping body 70D is in a standby state with the position where the upper end of the gripping member 73 is opposed to the lower end of the left end portion (starting end portion) of the veneer sheet W1 as its original position. The roller 31*c* of the temperature control press unit roller conveyor 31 supports and guides the lower end of the veneer sheet W1 entering between the temperature control plates 54 together with the rollers 31*a* and 31*b*.

After execution of the treatment in S63, on the condition that the open transpiration unit gripping body 70C reaching the operation position (grip releasing position) is detected by the photoelectric sensor 202*b*, the electromagnetic switching valve 212D is switched to the ascent position, and along with the elongation operation of the gripping member elevating cylinder 74 of the temperature control press unit gripping body 70D, the gripping member 73 is made to ascend. The gripping pieces 81 and 82 of the gripping member 73 in the expanded state enter the gap between the plurality of veneer sheets W1 held in the standing state between the temperature control plates 54. After the gripping member 73 is raised, the electromagnetic switching valve 211D is switched to the gripping position, and along with the elongation operation of the gripping piece cylinders 77 and 78, the gripping pieces 81 and 82 are made to grip both side surfaces in the lower part of each of the plurality of veneer sheets W1 (see S64 and FIG. 43).

Figure 44:
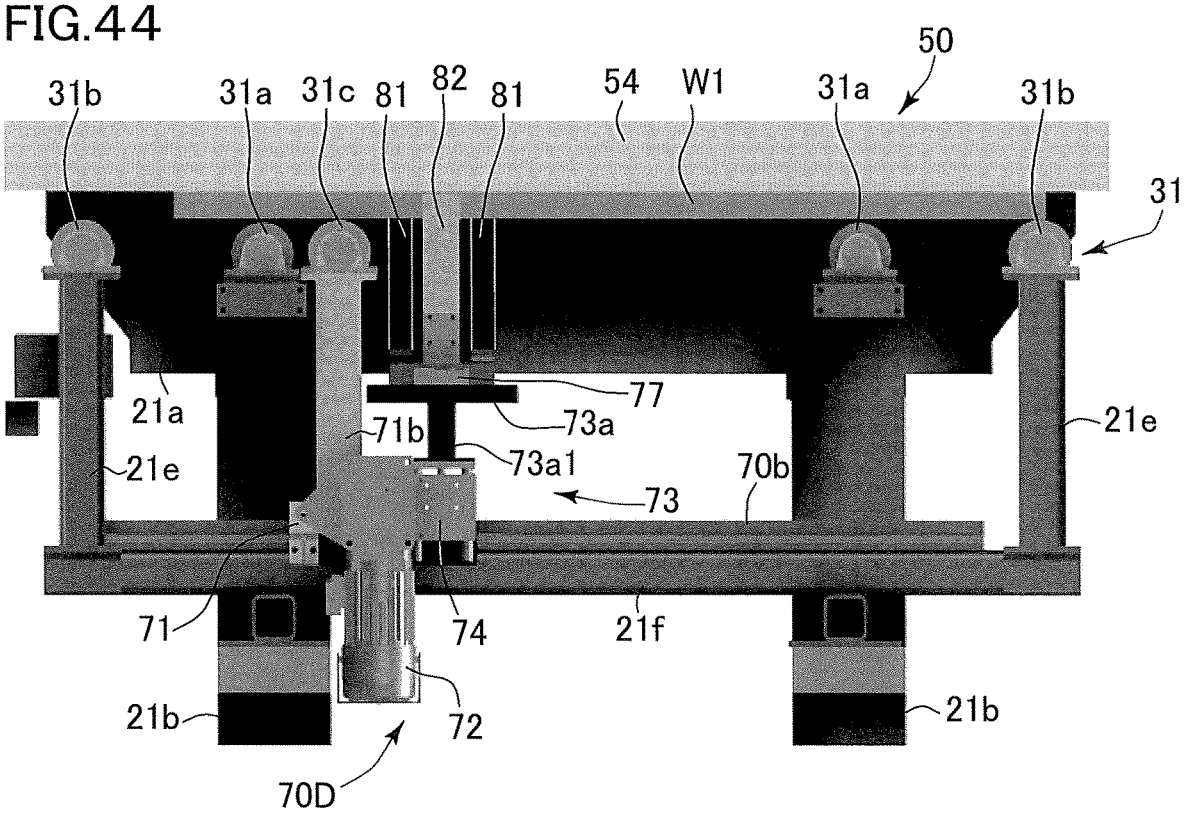

Next, the electromagnetic switching valve 211C is switched to the grip releasing position, and the gripping pieces 81 and 82 of the open transpiration unit gripping body 70C are brought into the grip, releasing state. That is, switching the electromagnetic switching valve 211D to the gripping position and switching the electromagnetic switching valve 211C to the grip releasing position change the gripping position of the veneer sheet W1 from the upper part to the lower part to support the veneer sheet W1. Thereafter, as shown in FIG. 44, the traveling body motor 72 of the temperature control press unit gripping body 70D is driven to rotate forward and the traveling body 71 is caused to move forward to the operation position (S65).

This operation position is set to a position where the roller 31*c* comes into contact with the roller 31*a* or a position near the roller 31*a*. It should be noted that when the photoelectric sensor 202*f* detects that no veneer sheet W1 is left in the open shelf 42, the control board 100 executes the second conveyance treatment in FIG. 19 in the open transpiration device 40 in the same manner as described above.

Figure 45:
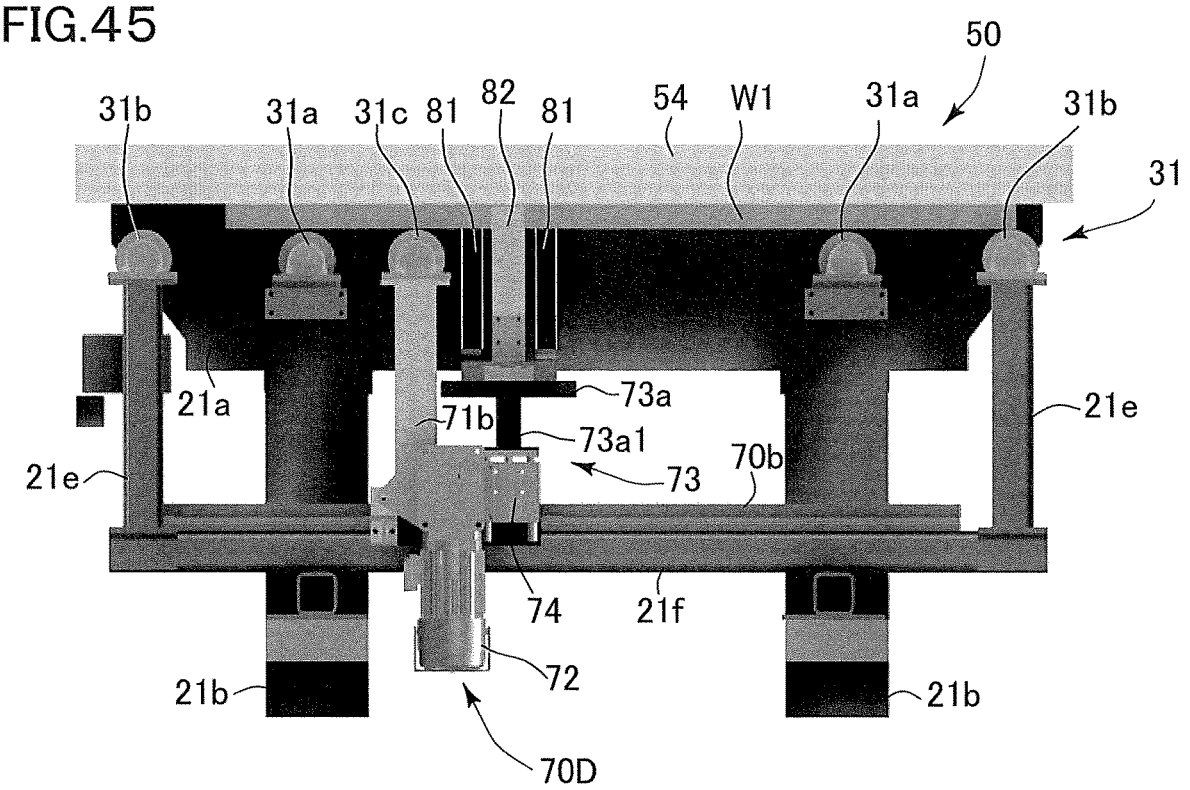
Figure 46:
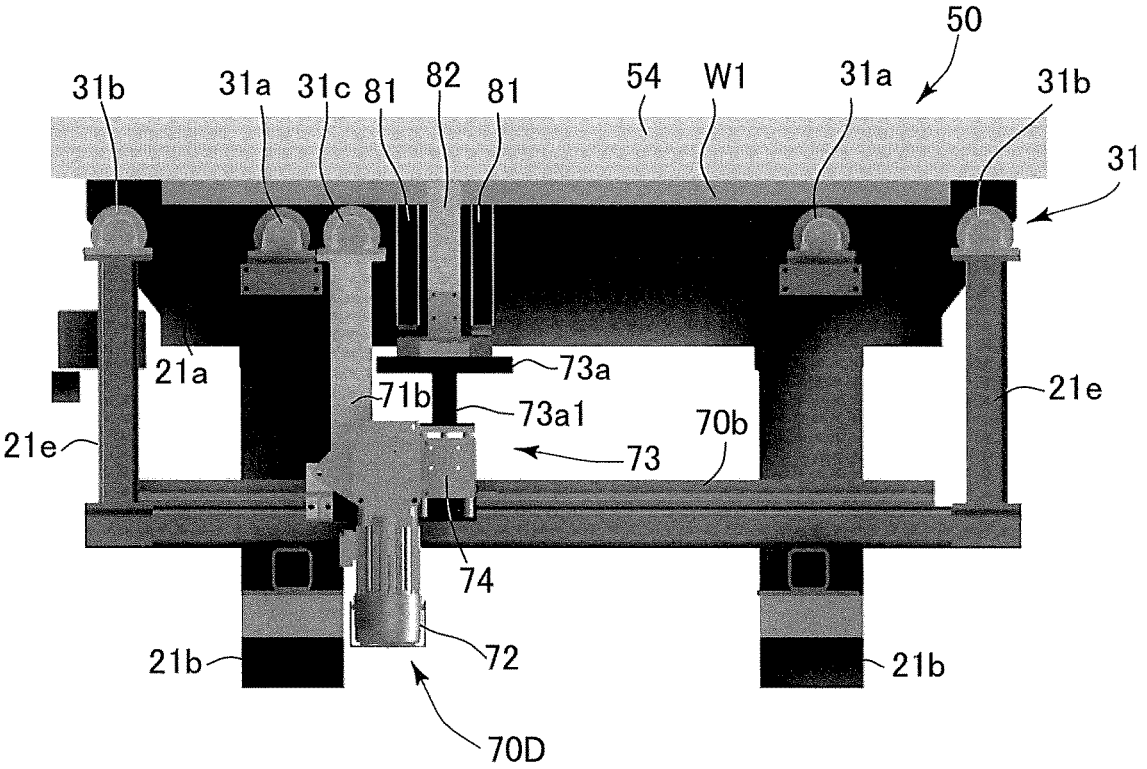
Figure 47:
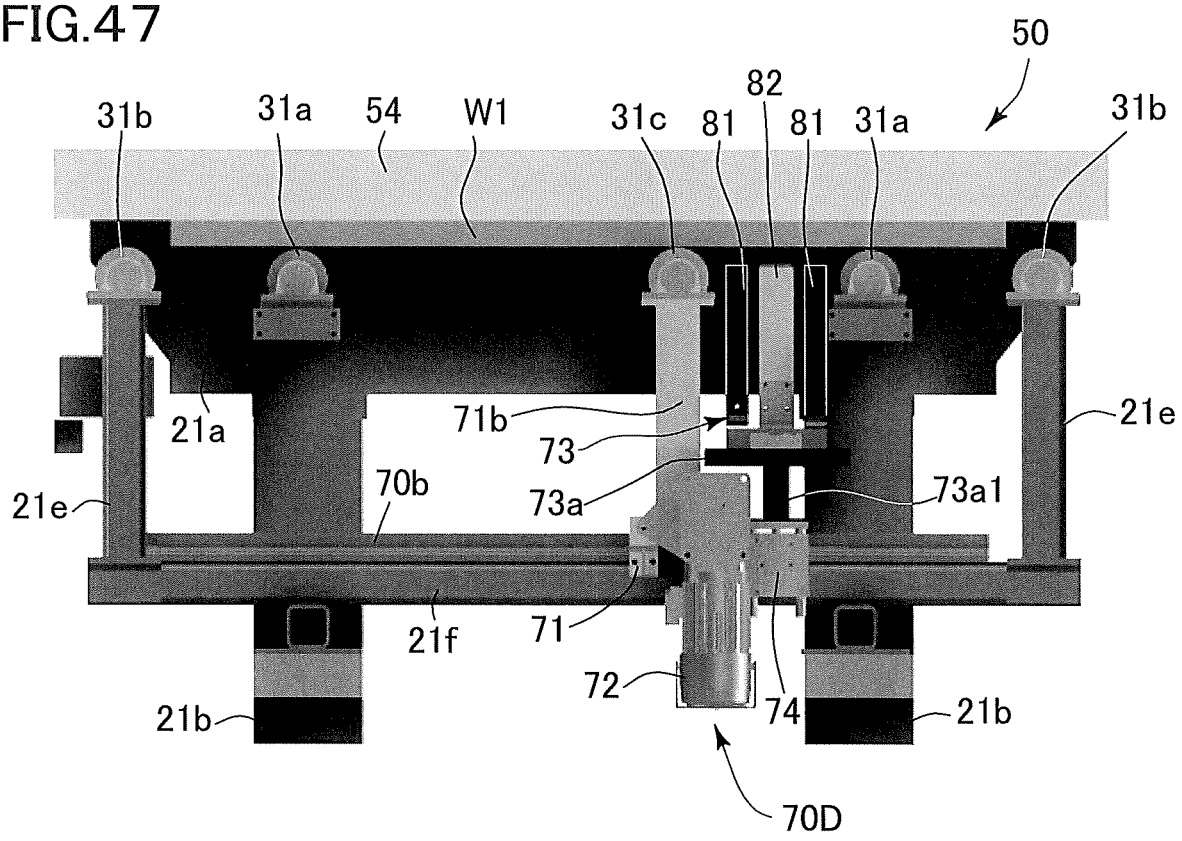

If the traveling body 71 reaches the operation position once, and the veneer sheet W1 reaches the press position (predetermined pressurizing position) of the temperature control press device 50, the process proceeds to S67 according to the determination of "YES" in S66, and if the traveling body 71 reaches the operation position only once, and the veneer sheet W1 does not reach the press position (predetermined pressurizing position) of the temperature control press device 50 ("NO" in S66), feed control by the traveling body 71 is performed according to the length of the veneer sheet W1 so that the veneer sheet W1 is fed to its press position. For example, the electromagnetic switching valve 211*a* is switched to the grip releasing position, the gripping pieces 81 and 82 of the temperature control press unit gripping body 70D are brought into the grip releasing state, the traveling body 71 is made to return by the necessary amount according to the length of the veneer sheet W1, and then, as shown in FIG. 45, the electromagnetic switching valve 211D is switched, and the gripping pieces 81 and 82 of the temperature control press unit gripping body 70D are caused to grip the lower part of the veneer sheet W1 again. In this state, as shown in FIG. 46, the traveling body motor 72 is driven to rotate forward and the traveling body 71 is again made to move forward to the operation position (S65). Thus, the veneer sheet W1 is fed to the press position of the temperature control press device 50.

If the veneer sheet W1 is fed to the press position of the temperature control press device 50 ("YES" in S66), the electromagnetic switching valve 211D is switched to the grip releasing position, and the gripping pieces 81 and 82 of the temperature control press unit gripping body 70D are brought into the grip releasing state, and then, the electromagnetic switching valve 212D is switched to the descent position, and along with the contraction operation of the gripping member elevating cylinder 74 of the temperature control press unit gripping body 70D, the gripping member 73 is made to descend. In this state, the traveling body motor 72 of the temperature control press unit gripping body 70D is driven to rotate reversely and the traveling body 71 is made to return to its original position (see S67 and FIG. 47). After the execution of the treatment in S67, the third conveyance treatment is ended. In the first example, the treatment in S63 in FIG. 20 corresponds to the upstream side carry-out step, and the treatment in S64 and S65 corresponds to the downstream side carry-in step.

Returning to FIG. 15, in the temperature control press step in S8, the control board 100 switches the electromagnetic switching valve 214D to the closing position, and closes the plurality of temperature control plates 54 simultaneously along with the elongation operation of the press cylinder 27 of the temperature control press device 50. The temperature control plate 54 is set to a temperature according to the outside air temperature or the like by the supply and discharge of the temperature control medium such as water, hot water, and hot oil, or by energization or the like, and is pressurized and temperature-controlled for a predetermined time according to the type of the veneer sheet W1, and then the electromagnetic switching valve 214D is switched to the open position, and along with the contraction operation of the press cylinder 27 of the temperature control press device 50, the plurality of temperature control plates 54 are made to simultaneously open. The temperature control press step in S8 corresponds to a second treatment step.

The control board 100 executes the fourth conveyance treatment program shown in the flowchart in FIG. 21 in the fourth conveyance step in S9 in FIG. 15. If the photoelectric sensor 202*h* does not detect the veneer sheet W1 (sheet material to be treated) in the unloader shelf 64 ("NO" in S71), and if the temperature control step is ended ("YES" in S72), and the unloader unit roller conveyor 15 is in the operation position, a conveyance surface F3 horizontally continuous with the conveyance surface F2 of the temperature control press unit roller conveyor 31 is formed (see FIG. 48), and on the condition that the unloader unit gripping body 70E returns to the original position (gripping position) ("YES" in S74), the control board 100 switches the electromagnetic switching valve 212E to the descent position, and along with the elongation operation of the gripping member elevating cylinder 74, makes the gripping member 73 to descend (see 376 and FIG. 49).

Figure 51:
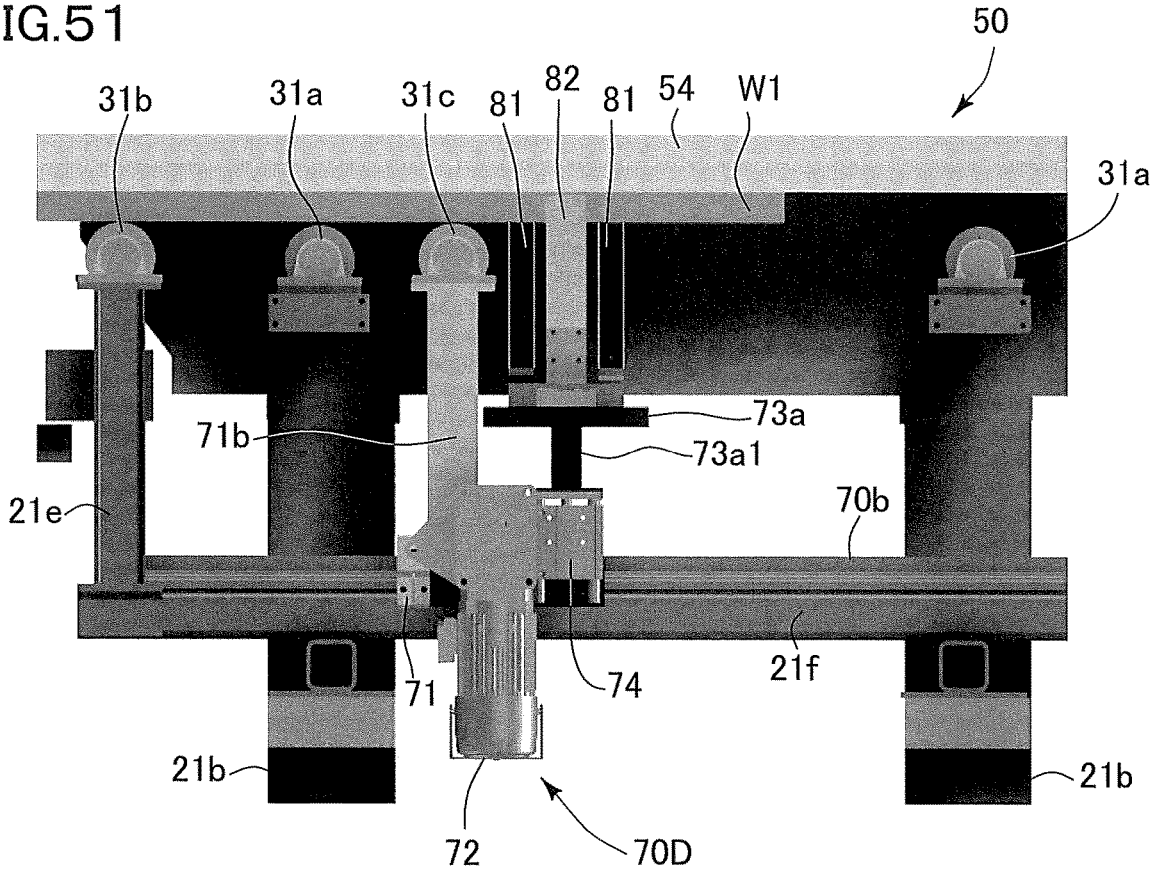
Figure 52:
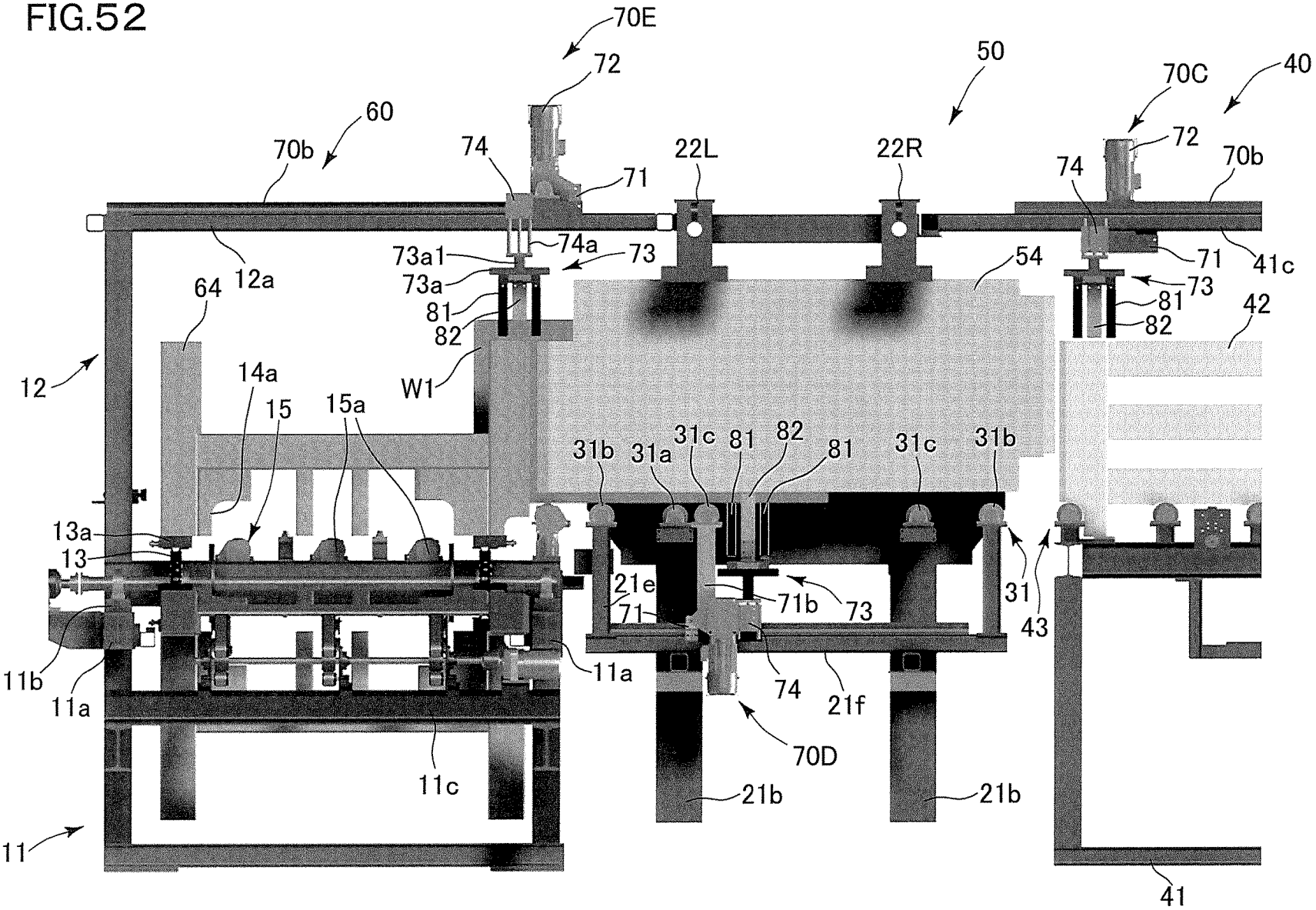
Figure 53:
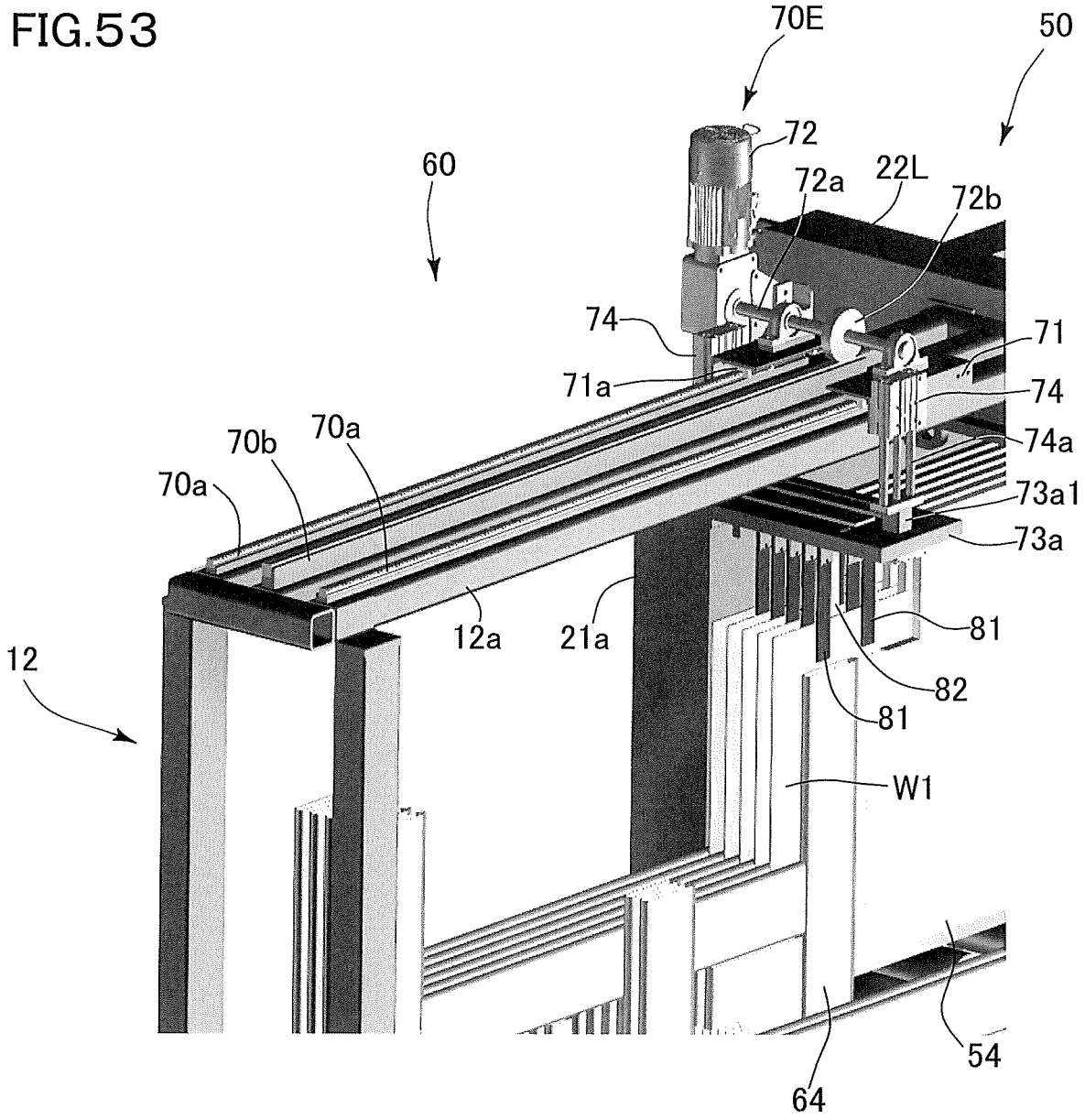
Figure 54:
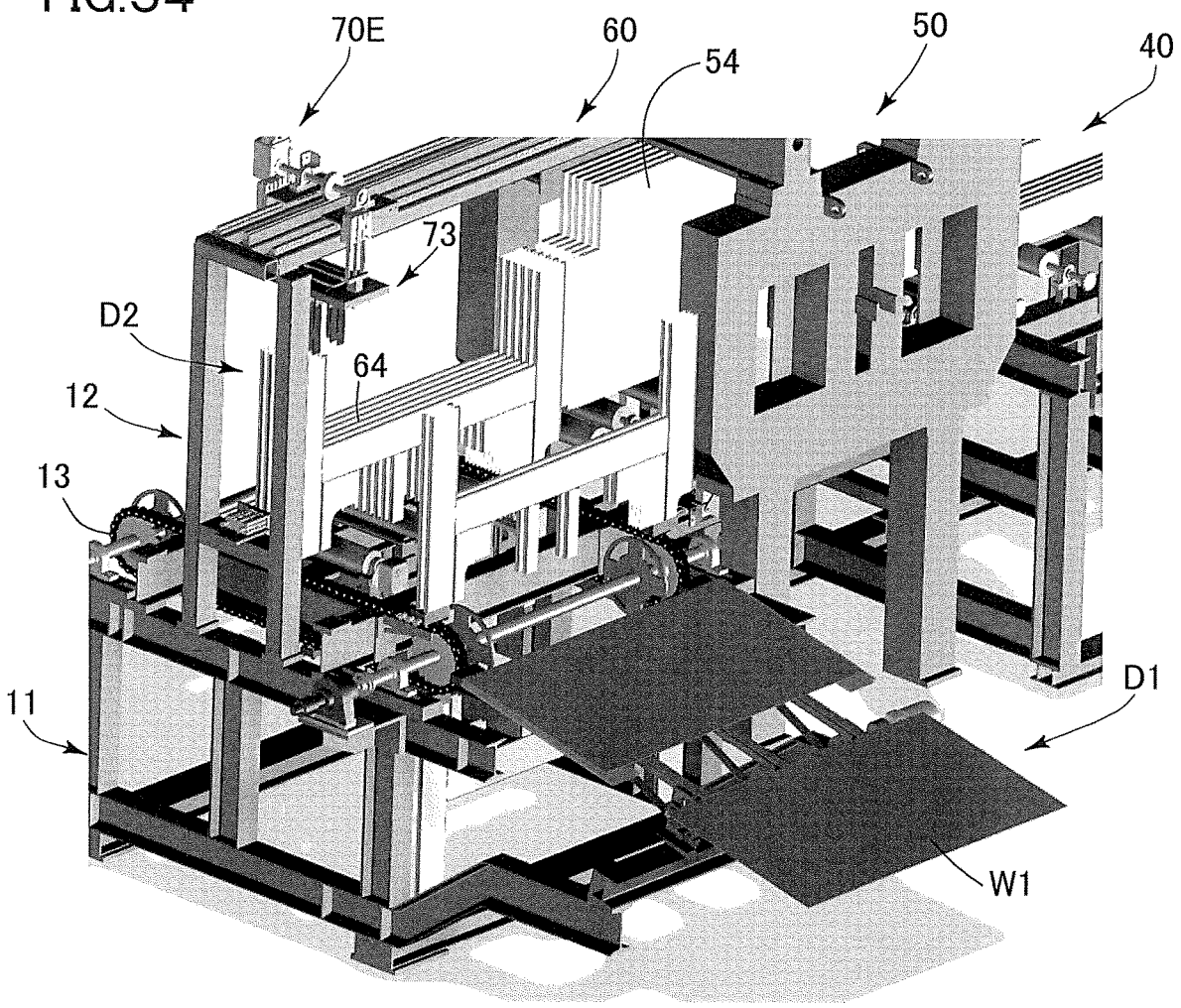
FIG. 54 is a 3D image explanatory diagram corresponding to the contents of the unloader treatment in FIG. 22.

Thereafter, the feed control by the traveling body 71 of the temperature control press unit gripping body 70D is performed according to the length of the veneer sheet W1 so that the veneer sheet W1 is carried into the unloader shelf 64 with one forward movement operation by the unloader unit gripping body 70E. For example, from the state shown in FIG. 50, the electromagnetic switching valve 211D is switched to the grip releasing position, the gripping pieces 81 and 82 of the temperature control press unit gripping body 70D are brought into the grip releasing state, the traveling body 71 is made to return by the necessary amount according to the length of the veneer sheet W1, and then, as shown in FIG. 51, the electromagnetic switching valve 211D is switched, and the gripping pieces 81 and 82 of the temperature control press unit gripping body 70D are caused to grip the lower part of the veneer sheet W1 again. Thus, the veneer sheet W1 is fed by a predetermined amount to the unloader shelf 64 side, the upper part of the left end portion (starting end portion) of the veneer sheet W1 is guided into between the expanded gripping pieces 81 and 82, and the lower end of the left end portion (starting end portion) of the veneer sheet W1 is supported and guided on the unloader unit roller conveyor 15 (see S76 and FIG. 52). The treatment in S76 corresponds to a back side carry-out step.

After the treatment in 376, the electromagnetic switching valve 211E is switched to the gripping position, and along with the elongation operation of the gripping piece cylinders 77 and 78, the gripping pieces 81 and 82 are made to grip both side surfaces in the upper part of each of the plurality of veneer sheets W1. At the same time, the electromagnetic switching valve 211D is switched to the grip releasing position, and the gripping pieces 81 and 82 of the temperature control press unit gripping body 70D are brought into the grip releasing state (S77). That is, switching the electromagnetic switching valve 211E to the gripping position and switching the electromagnetic switching valve 211D to the grip releasing position shift the gripping position of the veneer sheet W1 from the lower part to the upper part to support the veneer sheet W1.

Next, the traveling body motor 72 of the unloader unit gripping body 70E is driven to rotate forward and the traveling body 71 is made to move forward to the operation position (grip releasing position). At this time, the drive of the unloader unit conveyor motor 204 is synchronized with the drive of the traveling body motor 72, and the roller 15*a* is rotated for a predetermined time in accordance with the moving speed of the traveling body 71 (S78). Thus, the plurality of veneer sheets W1 enter the standing position in the unloader shelf 64 along the respective approach paths. The treatment in S77 and S78 corresponds to a back side carry-in step.

After the execution of the treatment in S78, on the condition that the photoelectric sensor 202*c* detects the unloader unit gripping body 70E reaching the operation position (grip releasing position), the electromagnetic switching valve 211E is switched to the grip releasing position, and the gripping pieces 81 and 82 of the unloader unit gripping body 70E are brought into the grip releasing state. Next, the electromagnetic switching valve 212E is switched to the ascent position, the gripping member 73 of the unloader unit gripping body 70E is made to ascend, and then, the unloader unit gripping body 70E is made to return to the original position (gripping position). Thereafter, the electromagnetic switching valve 213E is switched to the descent position, and along with the contraction operation of the conveyor elevating cylinder 16, the unloader unit roller conveyor 15 is made to descend to the original position (S79). Thus, along with the descent of the unloader unit roller conveyor 15, the plurality of veneer sheets W1 descend while the respective lower ends are supported by the roller 15*a* of the unloader unit roller conveyor 15 (see FIG. 7B). Since the veneer sheet W1 having undergone the open transpiration step and the temperature control press step is hardened by moisture escape, as shown in FIG. 7B, the lower end is not rounded when supported by the roller 15*a*. After the execution of the treatment in S79, the fourth conveyance treatment is ended.

In the unloader step in S10 in FIG. 15, the control board 100 executes the unloader treatment program shown in the flowchart in FIG. 22. In S81, it is determined whether or not the unloader unit roller conveyor 15 is in the original position. If the unloader unit roller conveyor 15 is in the original position ("YES" in S81), and the gripping member 73 of the unloader unit gripping body 70E ascends ("YES" in S82), the chain conveyor 13 is driven by a predetermined rotation amount (S84), and the veneer sheet W1 is pulled out one by one from the unloader shelf 64 (see FIG. 54). If the gripping member 73 of the unloader unit gripping body 70E does not ascend ("NO" in S82), the electromagnetic switching valve 212E is switched to the ascent position, the gripping member 73 of the unloader unit gripping body 70E is made to ascend (S83), and then the chain conveyor 13 is driven by a predetermined rotation amount. The pulled out veneer sheet W1 is taken out to the outside of the unloader device 60 by a carry-out mechanism (not shown). If the treatment in S84 and S85 (determined as "YES") are repeatedly executed in this order, and the veneer sheet W1 disappears in the unloader shelf 64 ("NO" in S85), the electromagnetic switching valve 213E is switched to the ascent position, and along with the elongation operation of the conveyor elevating cylinder 16, the unloader unit roller conveyor 15 is made to ascend to the operation position (S86). Thereafter, the unloader treatment is ended. The unloader step corresponds to a third treatment step.

As is apparent from the above description, in the horizontal multistage press apparatus 1 and the multistage drying method using the same for a veneer sheet W1 in the first example, the veneer sheet W1 is conveyed in a standing state from the loader device 10 to the unloader device 60 through the hot press device 20, the open transpiration device 40, and further, the temperature control press device 50. Thus, since each veneer sheet W1 is conveyed and pressurized in a standing state, the space occupied by the entire apparatus (floor space) can be set smaller than that of the vertical type.

Then, in the open transpiration device 40, each veneer sheet W1 is opened and held in a standing state, and water vapor can be evaporated from both surfaces of the veneer sheet W1. Therefore, the transpiration becomes uniform in each veneer sheet W1, and since inconsistency is hard to occur in the moisture state between the upper part and the lower part of each veneer sheet W1, it is also possible to keep constant the quality of the veneer sheet, such as the occurrence condition of cracks and warpage.

In addition, since the finished temperature of the veneer sheet W1 becomes a desired temperature by the temperature control press device 50, the curing period conventionally required can be shortened. Then, in manufacturing plywood or laminated materials, it is also possible to make uniform the viscosity of glue throughout the year in the gluing step being the next step. Therefore, it is unnecessary to adjust the viscosity of glue every time according to the change in the outside air temperature, and labor-saving can be achieved in the subsequent steps. Along with this, it is possible to make uniform the press cycle of plywood, laminated materials, and the like.

In addition, in the first example, the conveyance paths of the loader unit gripping body 70A, the open transpiration unit gripping body 70C, and the unloader unit gripping body 70E for gripping and conveying the upper part of the veneer sheet W1 of the conveyance paths R1 to R4 are arranged in a straight line in both plan view and front view, and the hot press unit gripping body 70B and the temperature control press unit gripping body 70D for gripping and conveying the lower part of the Veneer sheet W1 are arranged in a straight line in both plan view and front view. Therefore, in particular, it is possible to reduce the upward protrusion amount of the conveyance paths R1 to R4, and to save space even in the height direction.

In addition, in the first example, in the conveyance path R1, the gripping position is shifted from the loader unit gripping body 70A for gripping the upper part of the veneer sheet W1 to convey the veneer sheet W1 to the hot press unit gripping body 70B for gripping the lower part of the veneer sheet W1 to convey the veneer sheet W1, and in the conveyance path R3, the gripping position is shifted from the open transpiration unit gripping body 70C for gripping the upper part of the veneer sheet W1 to convey the veneer sheet W1 to the temperature control press unit gripping body 70D for gripping the lower part of the veneer sheet W1 to convey the veneer sheet W1.

Meanwhile, in the conveyance path R2, the gripping position is shifted from the hot press unit gripping body 70B for gripping the lower part of the veneer sheet W1 to convey the veneer sheet W1 to the open transpiration unit gripping body 70C for gripping the upper part of the veneer sheet W1 to convey the veneer sheet W1, and in the conveyance path R4, the gripping position is shifted from the temperature control press unit gripping body 70D for gripping the lower part of the veneer sheet W1 to convey the veneer sheet W1 to the unloader unit gripping body 70E for gripping the upper part of the veneer sheet W1 to convey the veneer sheet W1.

Thus, since in the hot press device 20 and the temperature control press device 50, any of the devices effectively utilize the spaces below the insides of the respective devices, and are respectively provided with the hot press unit gripping body 70B and the temperature control press unit gripping body 70D, it is possible to satisfactorily avoid interference with existing facilities such as fluid pipes for heating or temperature control provided in the upper space.

Here, when the horizontal multistage press apparatus 1 is designed to have specifications to be applicable to various sizes of veneer sheets W1, in the hot press device 20 and the temperature control press device 50, it can be considered that the region of the non-pressurized part where pressurization by the hot plate 24 and the temperature control plate 54 is impossible can be set smaller in the method of gripping the lower part of the veneer sheet W1 to convey the veneer sheet W1 than in the method of gripping the upper part of the veneer sheet W1 to convey the veneer sheet W1.

That is, even if the veneer sheet W1 is small, in order for the upper part to be gripped by the gripping pieces 81 and 82, it is necessary to set the original position of the gripping body to be provided in the upper part lower to some extent. This means that the region of the non-pressurized part protruding from the hot plate 24 and the temperature control plate 54 in the upper part of the veneer sheet W1 becomes larger. This non-pressurized part is a region with high moisture content and eventually becomes a part to be removed. In addition, in particular, in the hot press device 20, since adhesive substances such as resin transpiring during the opening of the hot plate 24 after completion of the hot press step are likely to adhere to the device, providing a gripping body in the upper part of the veneer sheet W1 may invite malfunction of the traveling body 71.

In contrast, in the first example, any of the hot press unit gripping body 70B corresponding to the hot press device 20 in the conveyance paths R1 and R2 and the temperature control press unit gripping body 70D corresponding to the temperature control press device 50 in the conveyance paths R3 and R4 are configured to grip the lower part of the veneer sheet W1 to convey the veneer sheet W1. Thus, the region of the non-pressurized part can be set small, and eventually the removal part of the veneer sheet W1 can be reduced. In addition, malfunction of the traveling body 71 can be favorably prevented.

In addition, in the first example, the control board 100 is configured to independently execute respective processes (subroutines) corresponding to S1 to S10 in FIG. 15. Therefore, for example, when the closing time of the hot plate 24 in the hot press step in S4 is at least not less than the sum of the evaporation time in the open transpiration step in S6, the conveyance time of the veneer sheet W1 in the third conveyance step in S7, and the closing time of the temperature control plate 54 in the temperature control press step in S8, it is possible to respectively independently execute the open transpiration step in S6, the conveyance of the veneer sheet W1 in the third conveyance step in S7, and the temperature control press step in S8 during execution of the hot press step in S4, and in some cases, before the hot press step is completed, it is possible to terminate earlier the treatment in S6 to S8, and furthermore, S9 and S10. Therefore, it is possible to operate each device efficiently and to shorten the operation time.

It should be noted that as in the first example, in place of the control mode in which the control board 100 independently executes (individually executes at different timings) the processes (subroutines) corresponding to S1 to S10 in FIG. 15, for example, on the condition that the time required for the processing in S1 to S10 is almost the same, it is also possible to adopt a control mode in which the processes corresponding to S1 to S10 are simultaneously executed in synchronization. Since the conveyance paths R1 to R4 are arranged in a straight line in plan view over between adjacent devices, this synchronization control can be executed.

In the first example, each of the hot press step, the open transpiration step, the temperature control press step, and the first to fourth conveyance steps is configured to be executed by the control board 100, but it is possible to omit, for example, the temperature control press step among these. That is, the case is where in an environment where the material and thickness of the veneer sheet W1, the weather conditions during drying, the use of the veneer sheet W1, and the like, and furthermore, the outside air temperature are substantially constant, or in an environment where the temperature in the factory is substantially constantly controlled, only executing the open transpiration step obtains the same effect as the effect obtained when the temperature control step is performed on the veneer sheet W1.

In addition, in the first example, the open transpiration device 40 is configured to evaporate water vapor from both surfaces of each veneer sheet in an standing state when the open transpiration unit gripping body 70C is in the conveyance stop state, but the invention is not limited to this, and for example, on condition that the veneer sheet W1 does not remain in the temperature control press device 50, as in the case where the open transpiration unit gripping body 70C feeds the veneer sheet W1 into the temperature control press device 50 at a very small moving speed, it is also possible to cause water vapor to evaporate from both surfaces of each veneer sheet in the conveyance continuation state of the veneer sheet W1. According to this, it is possible to omit the conveyance time of the veneer sheet W1 in the third conveyance step.

In addition, in the first example, the conveyance surface F1 when the loader unit conveyor 15 is in the operation position, the conveyance surface F2 of the hot press unit roller conveyor 31, the open transpiration unit roller conveyor 43, and the temperature control press unit roller conveyor, and the conveyance surface F3 when the unloader unit roller conveyor 15 is in the operation position are set to the same height. Thus, the veneer sheet W1 can be conveyed more smoothly.

In addition, in the loader unit conveyor 15, the hot press unit roller conveyor 31, the temperature control press unit roller conveyor 31, and the unloader unit roller conveyor 15, a non-drive idling roller may be adopted in place of some or all of the drive rollers.

In addition, when the sheet material to be treated is plywood, in the open transpiration device 40, water vapor is evaporated from both surfaces of each sheet of plywood Opened and held in a standing state, and wood-based resin components, what are called "resin" will also be evaporated. Each sheet of plywood reaches the temperature control press device 50 without contacting each other, is pressurized and temperature-controlled by a temperature control plate 54 set to a finished temperature, and is cooled from the plywood temperature after pressurized heating (for example, around 100° C.) to a desired temperature (for example, the plywood temperature is 25° C. to 35° C.) of a normal temperature. Since the plywood cooled to the normal temperature is released from the thermal expansion state, after passing through the unloader device 60, the plywood can be immediately sawed on the four sides by the four-side sawing device in the next step without temporarily piled. As a result, it is possible to improve work efficiency satisfactorily.

Furthermore, when the sheet material to be treated is plywood, instead of using the loader unit gripping body 70A and the open transpiration unit gripping body 70C as an upper part gripping body, and the hot press unit gripping body 70B and the temperature control press unit gripping body 70D as a lower part gripping body, for example, as described in JP S63-99903 A, the configuration may be adopted in which providing protrusions in some or all of a plurality of rollers and locking these protrusions to the bottom of the plywood causes the plywood to be driven in the conveying direction.

In addition, the invention is not limited to the above-described example and modifications thereof, and can be implemented in various modified forms without departing from the spirit of the invention.

REFERENCE SIGNS LIST

- 1, 1B horizontal multistage press apparatus (multistage conveyance apparatus, multistage press apparatus)
- 10 loader device (first treatment device)
- 15 loader unit conveyor (first conveyance body, preceding conveyance device)
- 20 hot press device (second treatment device)
- 31 hot press unit roller conveyor (downstream side conveyance body, second conveyance body, preceding conveyance device)
- 31 temperature control press unit roller conveyor (downstream side conveyance body, second conveyance body, subsequent conveyance device)
- 24 hot plate (first contact plate)
- 40 open transpiration device (first treatment device)
- 43 open transpiration unit roller conveyor (first conveyance body, subsequent conveyance device)
- 50 temperature control press device (second treatment device)
- 54 temperature control plate (second contact plate)
- 60 unloader device
- 70A loader unit gripping body (upstream side conveyance body, upper part gripping body, preceding conveyance device)
- 70B hot press unit gripping body (downstream side conveyance body, lower part gripping body, preceding conveyance device)

70C open transpiration unit gripping body (upstream side conveyance body, upper part gripping body, subsequent conveyance device)

70D temperature control press unit gripping body (downstream side conveyance body, lower part gripping body, subsequent conveyance device)

100 control board (control unit)

W1 veneer sheet (sheet material to be treated)

R1 to R4 conveyance path (first to fourth conveyance paths)

F1 to F3 conveyance surface

The invention claimed is:

1. A multistage drying apparatus for a sheet material to be treated including in order from an upstream side in a conveying direction:

a loader device configured to load a plurality of sheet materials to be treated, a hot press device configured to sandwich, pressurize, and heat each sheet material to be treated from both sides with a first contact plate, an open transpiration device configured to evaporate water vapor from a surface of each sheet material to be treated, a temperature control press device configured to sandwich, pressurizes, and temperature-control each sheet material to be treated from both sides with a second contact plate, and an unloader device configured to unload a plurality of sheet materials to be treated, the multistage drying apparatus for a sheet material to be treated comprising:

a first conveyance path positioned over the loader device and the hot press device, the first conveyance path in which a plurality of sheet materials to be treated set in a standing state by the loader device are carried out while being held in parallel along a conveying direction, and are carried into a press position of the hot press device in a standing state;

a second conveyance path positioned over the hot press device and the open transpiration device, the second conveyance path in which a plurality of sheet materials to be treated released from pressing force by the first contact plate are carried out in a standing state from a press position of the hot press device, and are carried into an open transpiration position of the open transpiration device in a standing state while being held in parallel along a conveying direction;

a third conveyance path positioned over the open transpiration device and the temperature control press device, the third conveyance path in which a plurality of sheet materials to be treated from which water vapor is evaporated are carried out in a standing state from an open transpiration position of the open transpiration device, and are carried into a press position of the temperature control press device in a standing state while being held in parallel along a conveying direction; and a fourth conveyance path positioned over the temperature control press device and the unloader device, the fourth conveyance path in which a plurality of sheet materials to be treated released from pressing force by the second contact plate are carried out in a standing state from a press position of the temperature control press device, and are carried into an unloader position of the unloader device in a standing state while being held in parallel along a conveying direction, wherein the first to fourth conveyance paths are arranged in a straight line in plan view, water vapor is configured to be evaporated from both surfaces of each sheet material to be treated in a standing state that is supported from the lower side in the open transpiration position after each sheet material to be treated being pressurized and heated by the hot press device, and a finished temperature of each sheet material to be treated is maintained at a desired temperature by the temperature control press device, wherein in each of the first to fourth conveyance paths, an upper part gripping body configured to grip and convey an upper part of a sheet material to be treated and a lower part gripping body configured to grip and convey a lower part of a sheet material to be treated are provided in association with each sheet material to be treated, and wherein in each conveyance path, each sheet material to be treated is alternately held to be switched by the upper part gripping body and the lower part gripping body during conveyance.

2. The multistage drying apparatus for a sheet material to be treated according to claim 1, wherein in the first and third conveyance paths, each sheet material to be treated is held to be switched from the upper part gripping body to the lower part gripping body, and in the second and fourth conveyance paths, each sheet material to be treated is held to be switched from the lower part gripping body to the upper part gripping body.

3. The multistage drying apparatus for a sheet material to be treated according to claim 2, wherein when the upper part gripping body is in a conveyance stop state or a conveyance continuation state, the open transpiration device evaporates water vapor from both surfaces of each sheet material to be treated in a standing state.

4. The multistage drying apparatus for a sheet material to be treated according to claim 1, wherein the hot press device or the temperature control press device simultaneously closes and simultaneously opens each sheet material to be treated with the first or second contact plate.

5. A multistage drying method for a sheet material to be treated including from an upstream side in a conveying direction:

a loader step of loading a plurality of sheet materials to be treated, a hot press step of sandwiching, pressurizing, and heating each sheet material to be treated from both sides with a first contact plate, an open transpiration step of evaporating water vapor from a surface of each sheet material to be treated, a temperature control press step of sandwiching, pressurizing, and temperature-controlling each sheet material to be treated from both sides with a second contact plate, and an unloader step of unloading a plurality of sheet materials to be treated, the multistage drying method for a sheet material to be treated comprising:

a first conveyance step performed between the loader step and the hot press step, the first conveyance step of carrying out while holding in parallel along a conveying direction a plurality of sheet materials to be treated set in a standing state by the loader step, and of carrying in a standing state the plurality of sheet materials to be treated into a press position when performing the hot press step;

a second conveyance step performed between the hot press step and the open transpiration step, the second conveyance step of carrying out a plurality of sheet materials to be treated released from pressing force by the first contact plate in a standing state from a press position when performing the hot press step, and of carrying in a standing state while holding in parallel along a conveying direction the plurality of sheet materials to be treated into an open transpiration position when performing the open transpiration step;

a third conveyance step performed between the open transpiration step and the temperature control press step, the third conveyance step of carrying out a plurality of sheet materials to be treated from which water vapor is evaporated in a standing state from the open transpiration position, and of carrying in a standing state while holding in parallel along a conveying direction the plurality of sheet materials to be treated into a press position when performing the temperature control press step; and a fourth conveyance step performed between the temperature control press step and the unloader step, the fourth conveyance step of carrying out a plurality of sheet materials to be treated released from pressing force by the second contact plate in a standing state from a press position when performing the temperature control press step, and of carrying in a standing state while holding in parallel along a conveying direction the plurality of sheet materials to be treated into an unloader position when performing the unloader step, wherein the first to fourth conveyance steps are performed along a conveyance path in a straight line in plan view, water vapor is configured to be evaporated from both surfaces of each sheet material to be treated in a standing state that is supported from the lower side in the open transpiration step after each sheet material to be treated being pressurized and heated by the hot press step, and a finished temperature of each sheet material to be treated is maintained at a desired temperature by the temperature control press step, wherein in each of the first to fourth conveyance steps, each sheet material to be treated is alternately held to be switched between an upper part gripping state and a lower part gripping state during conveyance.

6. The multistage drying method for a sheet material to be treated according to claim 5, wherein in the hot press step or the temperature control press step, the first or second contact plate simultaneously closes and simultaneously opens each sheet material to be treated.

7. The multistage drying method for a sheet material to be treated according to claim 5, further comprising:

controlling operations of at least the hot press step, the open transpiration step, the temperature control press step, and the first to fourth conveyance steps with a control unit, and wherein the control unit performs control so that a closing time of the first contact plate in the hot press step is at least not less than a sum of an evaporation time in the open transpiration step, a conveyance time of a sheet material to be treated in the third conveyance step, and a closing time of the second contact plate in the temperature control press step.

8. The multistage drying method for a sheet material to be treated according to claim 5, further comprising controlling operations of at least the hot press step, the open transpiration step, the temperature control press step, and the first to fourth conveyance steps with a control unit, and wherein the control unit is configured to omit the temperature control press step.

* * * * *